US007507125B2

(12) United States Patent
Okamura et al.

(10) Patent No.: US 7,507,125 B2
(45) Date of Patent: Mar. 24, 2009

(54) CONNECTOR AND DEVICE EQUIPPED WITH THE SAME

(75) Inventors: Toshio Okamura, Tokyo (JP); Osamu Hashiguchi, Tokyo (JP); Akihiro Onogawa, Tokyo (JP); Hiroyuki Ebihara, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/009,403

(22) Filed: Jan. 18, 2008

(65) Prior Publication Data

US 2008/0188119 A1 Aug. 7, 2008

(30) Foreign Application Priority Data

Feb. 2, 2007 (JP) ..... 2007-024369
Feb. 6, 2007 (JP) ..... 2007-026781
Feb. 20, 2007 (JP) ..... 2007-039520

(51) Int. Cl.
*H01R 13/64* (2006.01)

(52) U.S. Cl. ..... 439/680; 439/902; 439/903

(58) Field of Classification Search ..... 439/610, 439/902, 903, 466, 468, 680, 582, 587, 660
See application file for complete search history.

(56) References Cited

U.S. PATENT DOCUMENTS 4,477,022 A * 10/1984 Shuey et al. ..... 439/590
6,551,137 B2 * 4/2003 Pfaff et al. ..... 439/607
6,811,422 B1 * 11/2004 Muller ..... 439/314

FOREIGN PATENT DOCUMENTS

JP 2001-267006 A 9/2001

* cited by examiner

*Primary Examiner*—Phuong K Dinh
(74) *Attorney, Agent, or Firm*—Frishauf, Holtz, Goodman & Chick, P.C.

(57) ABSTRACT

A connector capable of setting a direction of running a cable connected thereto, as desired. An angle end bell has eight positioning protrusions formed on a foremost end of a surrounding portion thereof at circumferentially equally-spaced intervals. Eight positioning recesses for engagement with the positioning protrusions are formed in a rear end of a barrel. The barrel has three erroneous fitting-preventing key grooves formed in an outer peripheral surface thereof at circumferentially equally-spaced intervals.

11 Claims, 48 Drawing Sheets

CONNECTOR AND DEVICE EQUIPPED WITH THE SAME

BACKGROUND OF THE INVENTION

1. Field of the Invention

This invention relates to a connector and a device equipped with the connector, and more particularly to a connector in which a direction of running a cable from the connector is substantially at right angles with respect to a fitting/removing direction of the connector, and a device equipped with the connector.

2. Description of the Related Art

Conventionally, there has been proposed a connector comprised of a plug, an end bell, and an assembly nut (see Japanese Laid-Open Patent Publication (Kokai) No. 2001-267006 (paragraphs [0024] and [0027] and FIG. 8).

The plug is comprised of contacts, an insulator and a barrel. The contacts are male contacts. The insulator has a generally cylindrical shape, and holds the contacts. The barrel has a substantially hollow cylindrical shape, and covers the insulator. The barrel has radially-protruding four keys formed thereon at circumferentially equally-spaced intervals.

One end of the end bell is fitted to one end of the plug, and the other end of the end bell guides cables connected to the respective contacts in a direction at right angles to a fitting/removing direction of the plug. The end bell has four key grooves formed in an inner peripheral surface of the one end thereof at circumferentially equally-spaced intervals. The key grooves receive the four keys of the barrel. This makes it possible to select the orientation of the other end of the end bell from four directions.

The assembly nut has a hollow cylindrical shape, and connects between the plug and the end bell such that the plug can be removed from the end bell.

In the above-described connector, the orientation of the other end of the end bell, that is, the direction of running the cables from the connector can be changed in units of 90°.

However, it has been desired for industrial uses that the direction of running the cable can be changed in units of angles smaller than 90°.

SUMMARY OF THE INVENTION

The present invention has been made in view of these circumstances, and an object thereof is to provide a connector which is capable of setting a direction of running a cable connected to the connector to any of angles at equal intervals.

To attain the above object, in a first aspect of the present invention, there is provided a connector for being fitted to a mating connector in a predetermined fitting direction, comprising a connector body including a contact which has a cable connected thereto, and a housing for holding the contact, an end bell including a surrounding portion which surrounds at least part of the housing, a cable running portion which is connected to the surrounding portion, for running the cable in a direction at right angles to the fitting direction, and an end bell-side locking portion which is formed on an outer peripheral surface of the surrounding portion, a barrel including an erroneous fitting-preventing portion which prevents erroneous fitting of the connector to the mating connector, and is coaxially abutted against a foremost end of the surrounding portion such that the barrel covers a remaining part of the housing, barrel rotational position-determining means for determining a relative position of the barrel with respect to the end bell in a rotational direction, thereby causing the position of the erroneous fitting-preventing portion in the rotational direction to correspond to a position of the contact, and a coupling nut including a first coupling nut-side locking portion which is engaged with the end bell-side locking portion, and a second coupling nut-side locking portion which is engaged with a mating connector-side locking portion provided on the mating connector, for locking the mating connector, the coupling nut covering the end bell and the barrel, and causing the barrel to abut against the end bell.

With the arrangement of the connector according to the first aspect of the present invention, the barrel rotational position-determining means is provided which determines relative position of the barrel with respect to the end bell, in a rotational direction, and causes the position of the erroneous fitting-preventing portion in the rotational direction to correspond to a position of the contact. Therefore, even when the barrel is relatively rotated with respect to the end bell, the barrel can be always fitted to the mating connector in the same state, and the position of the cable running portion in the rotational direction is changed according to the position of the barrel in the rotational direction. This makes it possible to set a direction of running the cable connected to the connector to any of angles at equal intervals.

Preferably, the barrel rotational position-determining means comprises a plurality of positioning protrusions, and a plurality of positioning recesses associated with the positioning protrusions.

Preferably, the end bell-side locking portion is a locking nail, the first coupling nut-side locking portion being a locking hole, the second coupling nut-side locking portion being a locking piece having a hole for engagement with the mating connector-side locking portion.

Preferably, the connector body has a shield member for covering the housing, the cable having a shielding wire, the shielding wire being electrically connected to the shield member.

Preferably, the end bell has an end bell-side fitting portion formed thereon such that the end bell-side fitting portion extends along one end of the cable, and the coupling nut has a coupling nut-side fitting portion formed thereon for being fitted to the end bell-side fitting portion, a gland nut being mounted on the end bell and the coupling nut in a state in which the gland nut has received the end bell-side fitting portion and the coupling nut-side fitting portion.

Preferably, the connector further comprises a first seal member disposed between the end bell and the barrel, for sealing between the end bell and the barrel, and a second seal member mounted on one end of the cable, for sealing between the cable and the end bell and between the cable and the gland nut.

Preferably, the contact includes a cable connecting portion soldered to a cable conductor of the cable, and the housing includes a contact holding portion for holding the contact in a state in which the cable connecting portion is exposed, and a cable holding portion for holding one end of the cable and positioning the cable conductor with respect to the cable connecting portion.

Preferably, the contact holding portion and the cable holding portion are integrally formed.

Preferably, the contact has a generally plate-like shape.

Preferably, the cable connecting portion has a central portion formed with a recess for positioning the cable conductor.

Preferably, the cable holding portion has a sloping surface formed thereon for soldering.

To attain the above object, in a second aspect of the present invention, there is provided a connector comprising a connector body including a contact, and a positioning portion, and a casing for accommodating the connector body, the casing including a front-side casing portion which is disposed to surround a fitting-side portion of the connector body to be fitted to a mating connector, with a space therebetween, and a rear-side casing portion which is mounted on a rear end of the front-side casing portion, for accommodating a rear-side portion of the connector body opposite from the fitting-side portion of the connector body, the front-side casing portion having a positioned portion capable of being fitted to the positioning portion.

Preferably, the connector body includes a housing for holding the contact, and a gland shell mounted in a manner covering the housing.

Preferably, the positioning portion is formed in the gland shell.

Preferably, an O ring is mounted on an inner peripheral surface of the front-side casing portion.

To attain the above object, in a third aspect of the present invention, there is provided a device comprising a connector including a connector body including a contact, and a positioning portion, and a casing for accommodating the connector body, the casing including a front-side casing portion which is disposed to surround a fitting-side portion of the connector body to be fitted to a mating connector, with a space therebetween, and a rear-side casing portion which is mounted on a rear end of the front-side casing portion, for accommodating a rear-side portion of the connector body opposite from the fitting-side portion of the connector body, the front-side casing portion having a positioned portion capable of being fitted to the positioning portion, and a CCD module.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
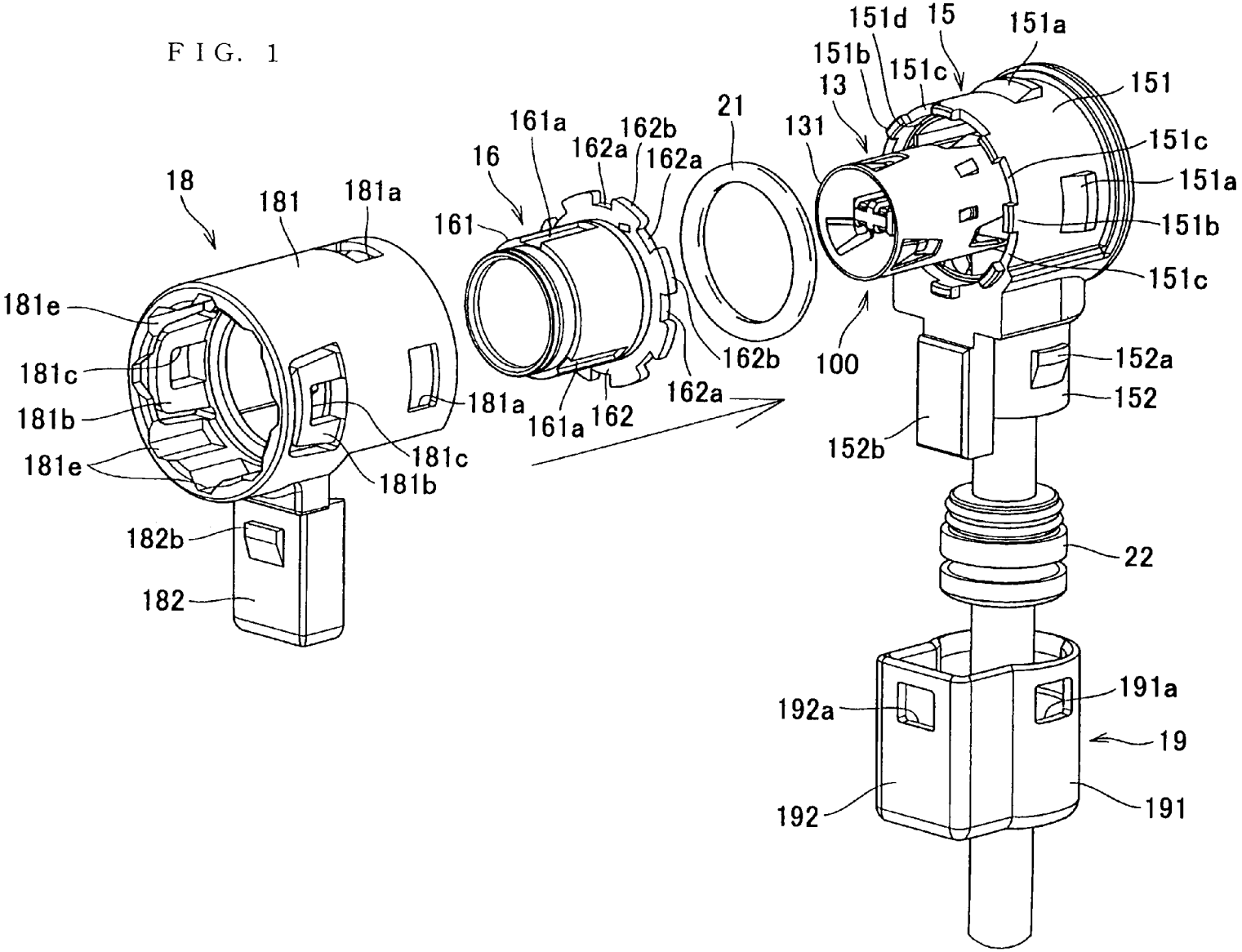
FIG. 1 is an exploded perspective view of an angle-type plug connector according to a first embodiment of the present invention.
Figure 2:
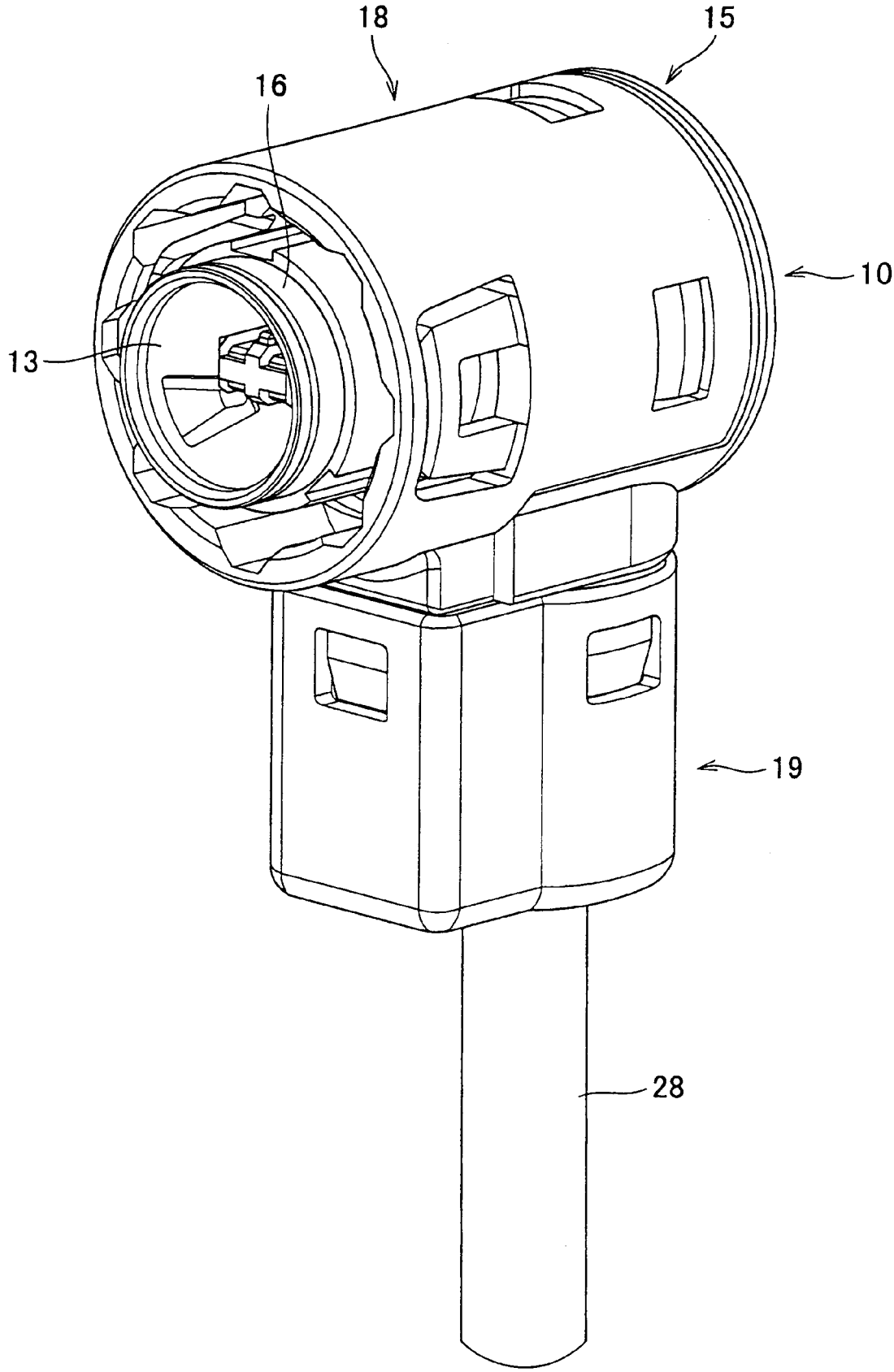
FIG. 2 is a perspective view of the angle-type plug connector shown in FIG. 1.
Figure 3:
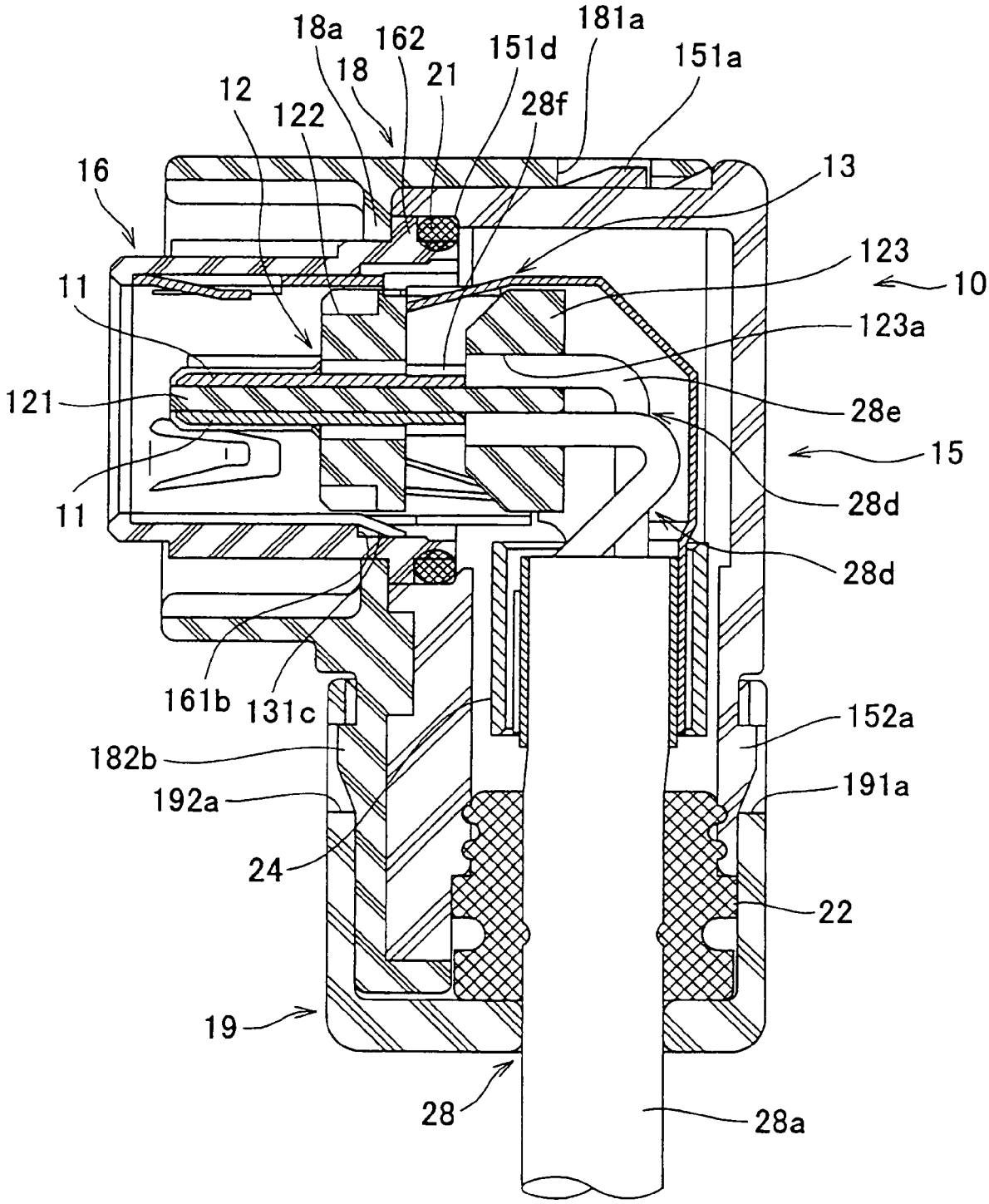
FIG. 3 is a cross-sectional view of the angle-type plug connector shown in FIG. 1.
Figure 4:
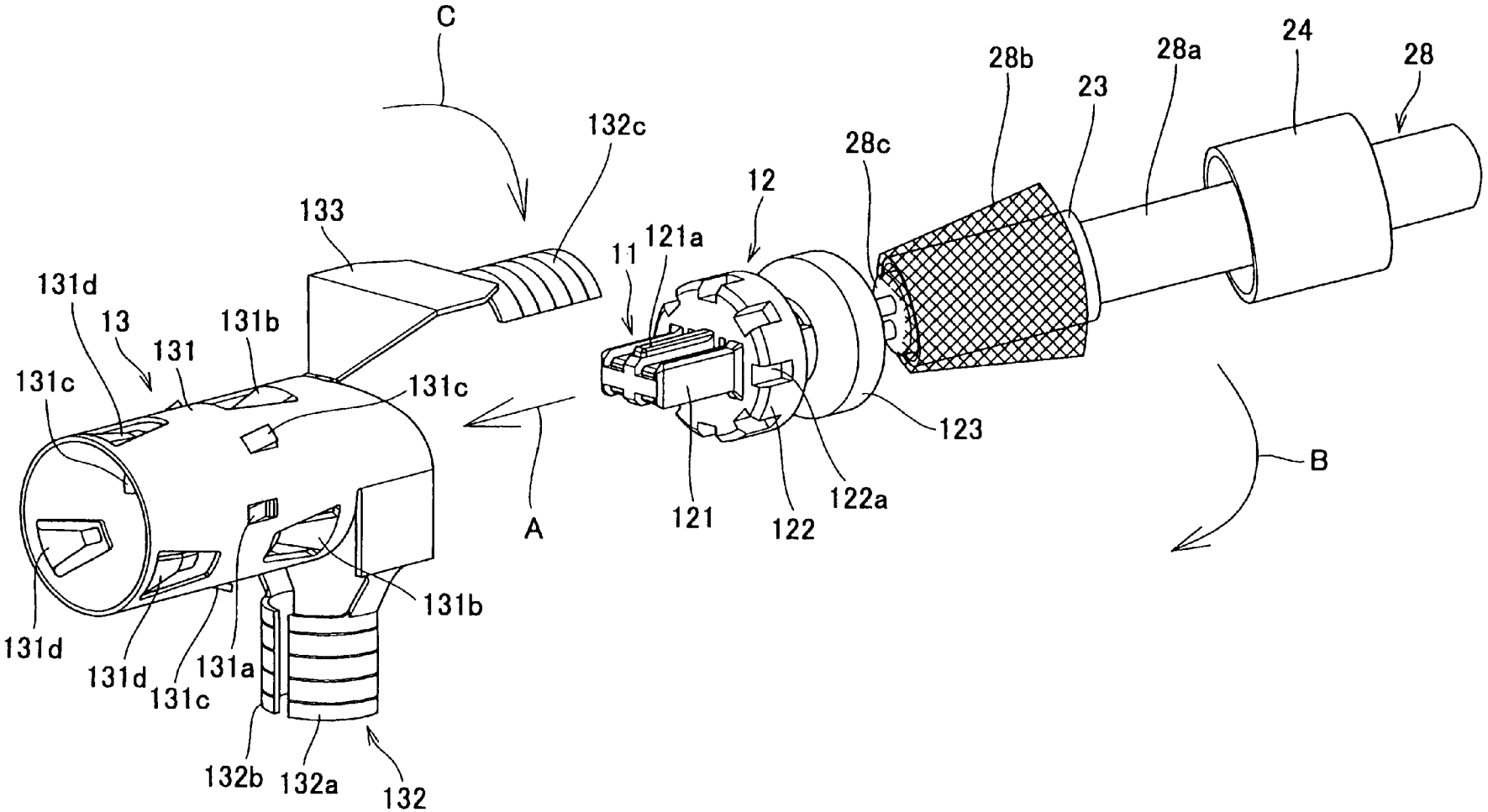
FIG. 4 is a perspective view of a housing and a shield member appearing in FIG. 1, in a state in which the shield member is about to be mounted on the housing.

FIG. 1 is an exploded perspective view of an angle-type plug connector according to a first embodiment of the present invention. FIG. 2 is a perspective view of the angle-type plug connector shown in FIG. 1. FIG. 3 is a cross-sectional view of the angle-type plug connector shown in FIG. 1. FIG. 4 is a perspective view of a housing and a shield member appearing in FIG. 1, in a state in which the shield member is about to be mounted on the housing.

Referring to FIGS. 1 to 3, the angle-type plug connector 10 is comprised of a connector body 100, an angle end bell (end bell) 15, a barrel 16, a coupling nut 18, and a gland nut 19.

As shown in FIG. 4, the connector body 100 includes male terminals (contacts) 11, a plug-side housing (housing) 12, and a shield member 13.

Each male terminal 11 has a generally plate-like shape.

The plug-side housing 12 has a terminal holding portion 121, a contact holding portion 122, and a wire holding portion 123. The plug-side housing 12 is fitted to or removed from a receptacle-side housing 52 of a receptacle connector 50, described hereinafter, in a predetermined fitting/removing direction. The terminal holding portion 121, the contact holding portion 122, and the wire holding portion 123 are integrally formed of resin. The terminal holding portion 121 is generally prism-shaped, and has contact portions of the male terminals 11 disposed therein. Further, the terminal holding portion 121 has an upper and lower surfaces each formed with a positioning key 121*a*. The contact holding portion 122, which is generally disk-shaped, and has the male terminals 11 press-fitted therein, for holding the terminals 11. The contact holding portion 122 has eight positioning key grooves 122*a* formed in an outer peripheral surface thereof at circumferentially equally-spaced intervals. The wire holding portion 123 has a generally truncated conical shape, and is continuous with the rear end of the contact holding portion 122. The wire holding portion 123 is formed with wire insertion holes 123*a* (see FIG. 3).

The shield member 13 includes a shield portion 131 and a clamp portion 132. The shield portion 131 and the clamp portion 132 are made of conductive thin metal plates to form a unitary member. The shield portion 131 has a hollow cylindrical shape, and is rotatably mounted on the plug-side housing 12 to cover the same. The shield portion 131 has a pair of positioning keys 131*a* formed therein by cutting and raising predetermined portions thereof. The pair of positioning keys 131*a* are in respective point-symmetric locations with respect to the center of the shield portion 131 and are recessed into the interior of the shield portion 131. The pair of positioning keys 131*a* are inserted into the positioning key grooves 122*a* of the plug-side housing 12. When the positioning keys 131*a* are inserted into the positioning key grooves 122*a*, the rotation of the shield portion 131 with respect to the plug-side housing 12 is blocked to thereby hold the clamp portion 132 in a fixed orientation with respect to the plug-side housing 12, and the plug-side housing 12 is blocked from moving within the shield portion 131 in the fitting direction. The shield portion 131 has three lances 131*b* formed in an outer peripheral surface thereof at circumferentially equally-spaced intervals. The lances 131*b* are formed by cutting and raising predetermined portions of the shield portion 131 in a manner recessed into the interior of the shield portion 131. The lances 131*b* support the side surface of the contact holding portion 122 toward the wire holding portion 123. When the lances 131*b* support the side surface of the contact holding portion 122, the plug-side housing 12 is blocked from moving within the shield portion 131 in the removing direction. Further, the shield portion 131 has three engaging pieces 131*c* formed in the outer peripheral surface thereof at circumferentially equally-spaced intervals.

The clamp portion 132 is connected to the shield portion 131 substantially at right angles thereto, for clamping one end of a cable 28. In the present embodiment, the cable 28 connected to the angle-type plug connector has a shielding wire 28*b* (see FIG. 4). The clamp portion 132 is comprised of three clamp pieces 132*a*, 132*b*, and 132*c*. The clamp pieces 132*a* and 132*b* are connected to the shield portion 131. The clamp piece 132*c* is connected to a cover 133, and the cover 133 is connected to the shield portion 131. The cover 133 opens and closes the rear end face of the shield portion 131.

As shown in FIG. 1, the angle end bell 15 includes a surrounding portion 151 and a cable running portion 152. The surrounding portion 151 and the cable running portion 152 are integrally formed of resin. The surrounding portion 151 has a hollow cylindrical shape, and covers the rear end of the shield portion 131. The surrounding portion 151 has three locking nails (end bell-side locking portions) 151*a* formed on an outer peripheral surface thereof at circumferentially equally-spaced intervals. Further, the surrounding portion 151 has eight positioning protrusions (barrel rotational position-determining means) 151*b* formed on a front end thereof at equally-spaced intervals. Further, positioning recesses (barrel rotational position-determining means) 151*c* are defined by adjacent ones of the positioning protrusions 151*b*. Further, the surrounding portion 151 has a riser surface 151*d* formed inside a foremost end thereof.

The cable running portion 152 has a generally cylindrical shape, and is coupled with the surrounding portion 151 substantially at right angles thereto, for covering the clamp portion 132 of the shield member 13. The cable running portion 152 has three locking nails 152*a* formed on an outer peripheral surface thereof at circumferentially equally-spaced intervals. The cable running portion 152 has a front surface formed with a fitting protrusion (end bell-side fitting portion) 152*b*. The fitting protrusion 152*b* has a generally rectangular parallelepiped shape.

The barrel 16 includes a hollow cylindrical portion 161 and a flange portion 162. The hollow cylindrical portion 161 and the flange portion 162 are integrally formed of resin. The hollow cylindrical portion 161 covers the foremost end of the shield portion 131 of the shield member 13. The hollow cylindrical portion 161 has three erroneous fitting-preventing key grooves (erroneous fitting-preventing portions) 161*a* formed in an outer peripheral surface thereof at circumferentially equally-spaced intervals. The erroneous fitting-preventing key grooves 161*a* extend in the fitting/removing direction. The hollow cylindrical portion 161 has a riser surface 161*b* formed on an inner peripheral surface of a rear end thereof (see FIG. 3). The riser surface 161*b* is engaged with the engaging pieces 131*c* of the shield member 13.

The flange portion 162 is continuous with the rear end of the hollow cylindrical portion 161. The flange portion 162 has eight positioning recesses (barrel rotational position-determining means) 162*a* formed in an outer peripheral surface thereof at equally-spaced intervals. Further, eight positioning protrusions (barrel rotational position-determining means) 162*b* are formed by adjacent ones of the positioning recesses 162*a*. The positioning recesses 162*a* are fitted to the positioning protrusions 151*b* of the angle end bell 15, and the positioning protrusions 162*b* are fitted in the positioning recesses 151*c* of the angle end bell 15. When the positioning recesses 162*a* are fitted on the positioning protrusions 151*b* of the angle bell end bell 15, and the positioning protrusions 162*b* are fitted in the positioning recesses 151*c*, the position of the barrel 16 relative to the angle end bell 15 in the direction of rotation of the barrel 16 is determined. At this time, since the positional relationship between the erroneous fitting-preventing key grooves 161*a* of the barrel 16 and the male terminals 11 of the connector body 100 is not changed, the circumferential positional relationship between the erroneous fitting-preventing key grooves 161*a* and the male terminals 11 held in the plug-side housing 12 is held fixed. Further, the orientation of the cable running portion 152 of the angle end bell 15 is changed according to the position of the barrel 16 in the rotational direction thereof. As described above, the positioning protrusions 151*b*, the positioning recesses 151*c*, the positioning recesses 162*a*, and the positioning protrusions 162*b* form the barrel rotational position-determining means.

After the positioning recesses 162*a* and the positioning protrusions 162*b* are fitted to the positioning protrusions 151*b* and the positioning recesses 151*c*, respectively, the flange portion 162 is abutted against the riser surface 151*d* of the angle end bell 15 via an O ring (first seal member) 21. Thus, the inner spaces of the angle end bell 15 and the barrel 16 are sealed (see FIG. 3). At this time, the surrounding portion 151 of the angle end bell 15 and the barrel 16 are coaxially located.

Figure 8:
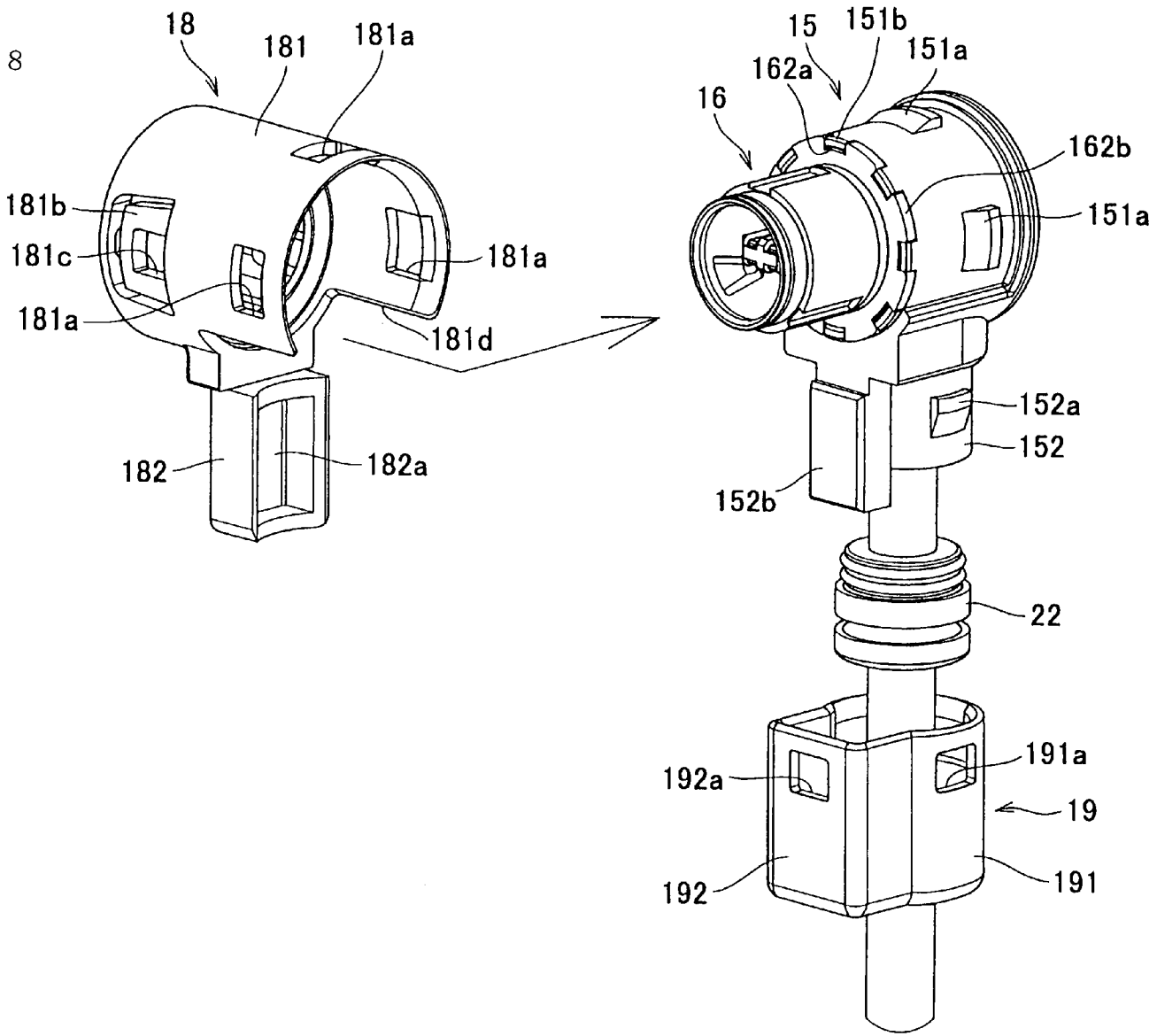
FIG. 8 is a perspective view of a coupling nut and the angle end bell of the angle-type plug connector shown in FIG. 1, in a state before the former is mounted on the latter.

Referring to FIGS. 1 and 8, the coupling nut 18 includes a cover 181 and a fitting portion 182. The cover 181 and the fitting portion 182 are integrally formed of resin. The cover 181 has a generally hollow cylindrical shape, and covers the surrounding portion 151 of the angle end bell 15 and the barrel 16. The cover 181 has three locking holes (first coupling nut-side locking portions) 181*a* formed in a rear end thereof at circumferentially equally-spaced intervals. Further, a cutout 181*d* is formed in a lower surface of the rear end of the cover 181. The cutout 181*d* is provided for inhibiting the coupling nut 18 from being brought into contact with the angle end bell 15. Further, the cutout 181*d* is capable of expanding and shrinking the rear end of the cover 181 in a radial direction of the cover 181. Therefore, when the coupling nut 18 is mounted on the angle end bell 15 along the fitting/removing direction, the rear end of the cover 181 climbs over the locking nails 151*a*, to have the locking nails 151*a* of the angle end bell 15 inserted into the locking holes 181*a*. As a result, the coupling nut 18 is locked to the angle end bell 15.

The cover 181 has a front end formed with a pair of locking pieces (second coupling nut-side locking portions) 181*b*. The pair of locking pieces 181*b* are at respective point-symmetric locations with respect to the center of the cover 181. The locking pieces 181*b* can be deformed in the radial direction of the cover 181, and each have a hole 181*c*. The holes 181*c* receive locking nails 54*c* of the receptacle connector 50, respectively. At this time, the locking pieces 181*b* are engaged with the locking nails 54*c*, respectively. Further, the cover 181 has a plurality of positioning key grooves 181*e* formed in an inner peripheral surface of the front end of the cover 181 at circumferentially equally-spaced intervals. The key grooves 181*e* receive the locking nails 54*c* of the receptacle connector 50 (see FIG. 1 and 11).

The fitting portion 182 is connected to the cover 181 substantially at right angles thereto. The fitting portion 182 has a back surface formed with a fitting recess (coupling nut-side fitting portion) 182*a* (see FIG. 8). The fitting recess 182*a* receives the fitting protrusion 152*b* of the angle end bell 15.

After the fitting recess 182*a* and the fitting protrusion 152*b* are fitted to each other, the gland nut 19 is inserted into the fitting portion 182 and the cable running portion 152, and three components of the plug connector, i.e. the coupling nut 18, the angle end bell 15, and the gland nut 19 are engaged with and locked to each other. This makes it possible to fix the three component parts more rigidly, and increases the strength of the connector in the direction of rotation about the fitting axis.

The gland nut 19 has a bottomed hollow cylindrical shape, and includes a first accommodating portion 191 and a second accommodating portion 192. The first accommodating portion 191 and the second accommodating portion 192 are integrally formed of resin. The first accommodating portion 191 is generally circular in transverse cross-section, and has an upper end thereof formed with three locking holes 191*a*. The three locking holes 191*a* are formed at circumferentially equally-spaced intervals. The locking holes 191*a* receive the locking nails 152*a* of the angle end bell 15, respectively. Since the upper end of the first accommodating portion 191 is capable of expanding and shrinking in a radial direction thereof, the three locking holes 191*a* are engaged with the locking nails 152*a* in the radial direction of the first accommodating portion 191.

The second accommodating portion 192 is generally rectangular in transverse cross-section, and has an upper end thereof formed with a locking hole 192*a*. The locking hole 192*a* receives a locking nail 182*b* of the coupling nut 18. Since the upper end of the second accommodating portion 192 is capable of bending in the direction of thickness thereof, the locking hole 192*a* can be engaged with the locking nail 182*b*.

Next, a description will be given of a procedure of assembling the angle-type plug connector 10.

First, as shown in FIG. 4, a jacket 28*a* is removed from a leading end of the cable 28 to expose the shielding wire.

Then, a sleeve 23 is mounted on the leading end of the cable 28, and the shielding wire 28*b* is folded back toward the sleeve 23.

After that, an insulator 28*c* is removed from the leading end of the cable 28 to expose four wires 28*d* (see FIG. 3).

Thereafter, a sheath 28*e* is removed from ends of the wires 28*d* to expose electrical wires 28*f* (see FIG. 3). The electrical wires 28*f* are soldered to the male terminals 11.

Then, as indicated by an arrow A in FIG. 4, the plug-side housing 12 is inserted into the shield portion 131 of the shield member 13. At this time, the pair of positioning keys 131*a* of the shield member 13 are inserted into the positioning key grooves 122*a* of the contact holding portion 122 of the plug-side housing 12 such that the orientation of the clamp portion 132 of the shield member 13 is substantially at right angles to the upper and lower surfaces (surfaces on which the positioning keys 121*a* are formed) of the terminal holding portion 121 of the plug-side housing 12.

Next, as indicated by an arrow B in FIG. 4, the cable 28 is bent at right angles, and is clamped by the clamp portion 132 on the shielding wire 28*b*. At this time, the rear end face of the shield portion 131 is closed by the cover 133.

Figure 5:
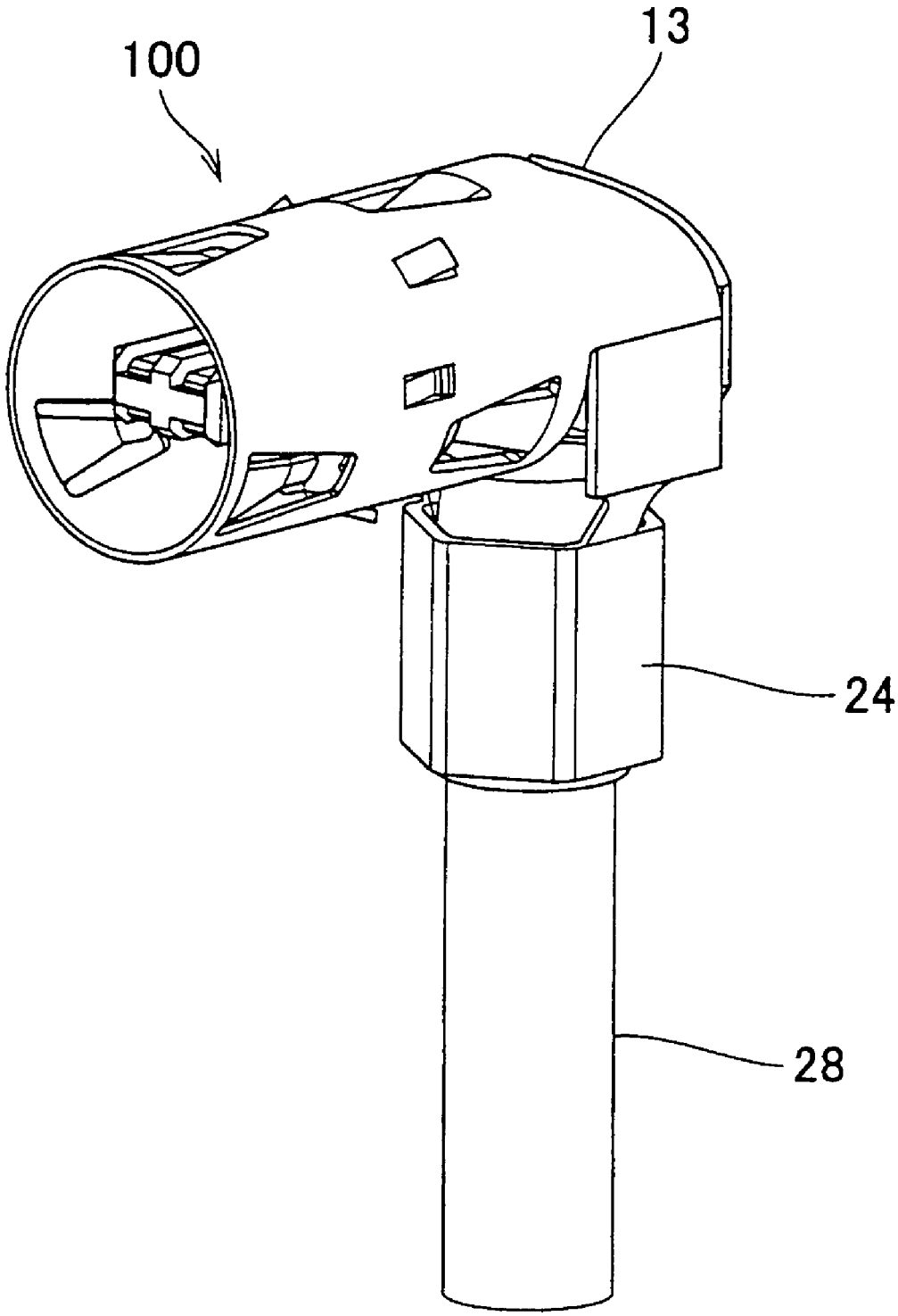
FIG. 5 is a perspective view of the housing and the shield member appearing in FIG. 4, in a state in which the shield member has been mounted on the housing.

After that, a ferrule 24 is mounted on the clamp portion 132, and is swaged into a hexagonal columnar shape, as shown in FIG. 5.

The cable 28 is connected to the male terminals 11 and the shield member 13 by the above operations.

Figure 6:
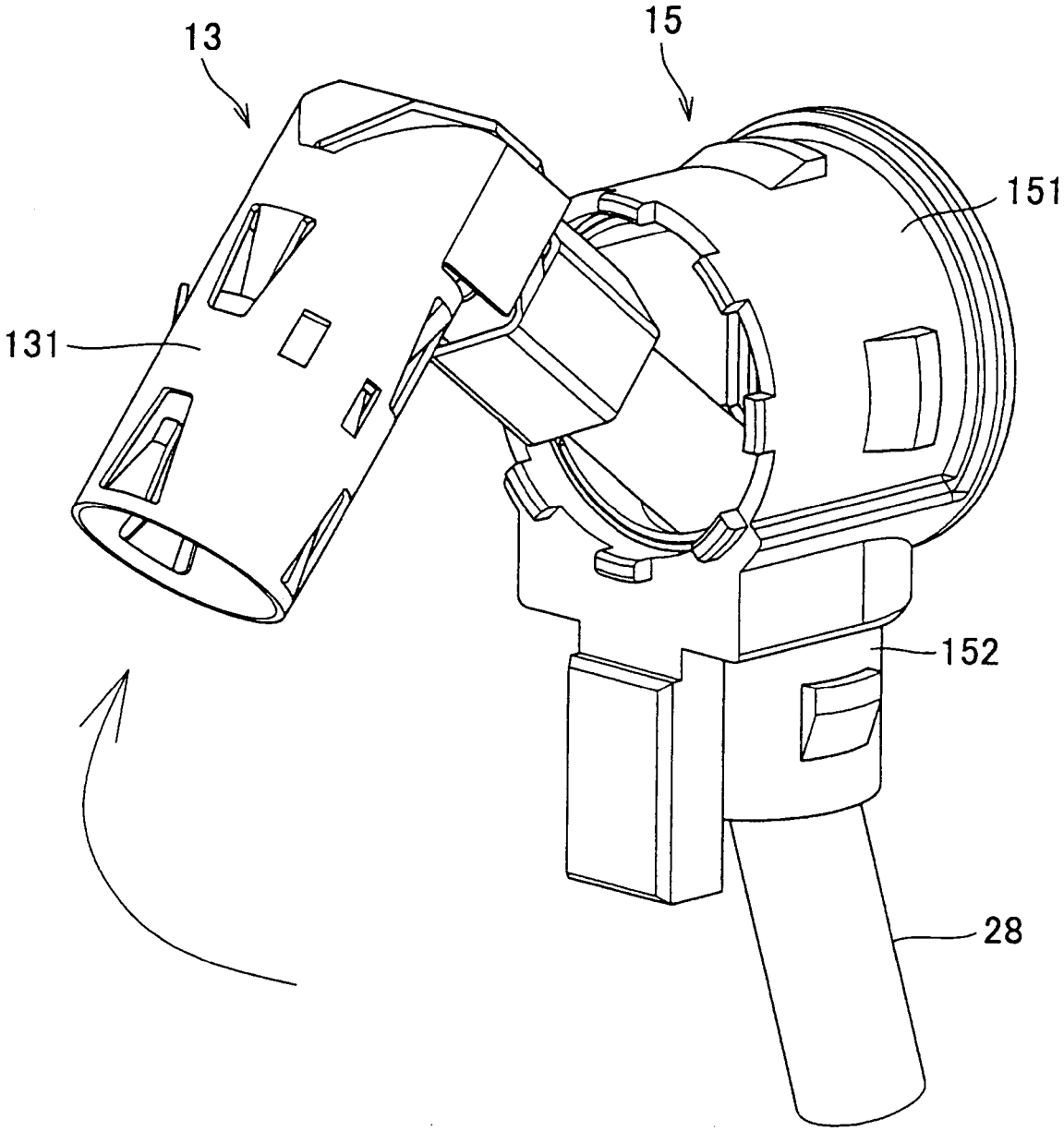
FIG. 6 is a perspective view of an angle end bell and the shield member of the angle-type plug connector shown in FIG. 1, in a state in which the shield member is being mounted in the angle end bell in a shield member mounting process.

Then, as shown in FIG. 6, the cable 28 is passed through the surrounding portion 151 and the cable running portion 152 of the angle end bell 15.

Figure 7:
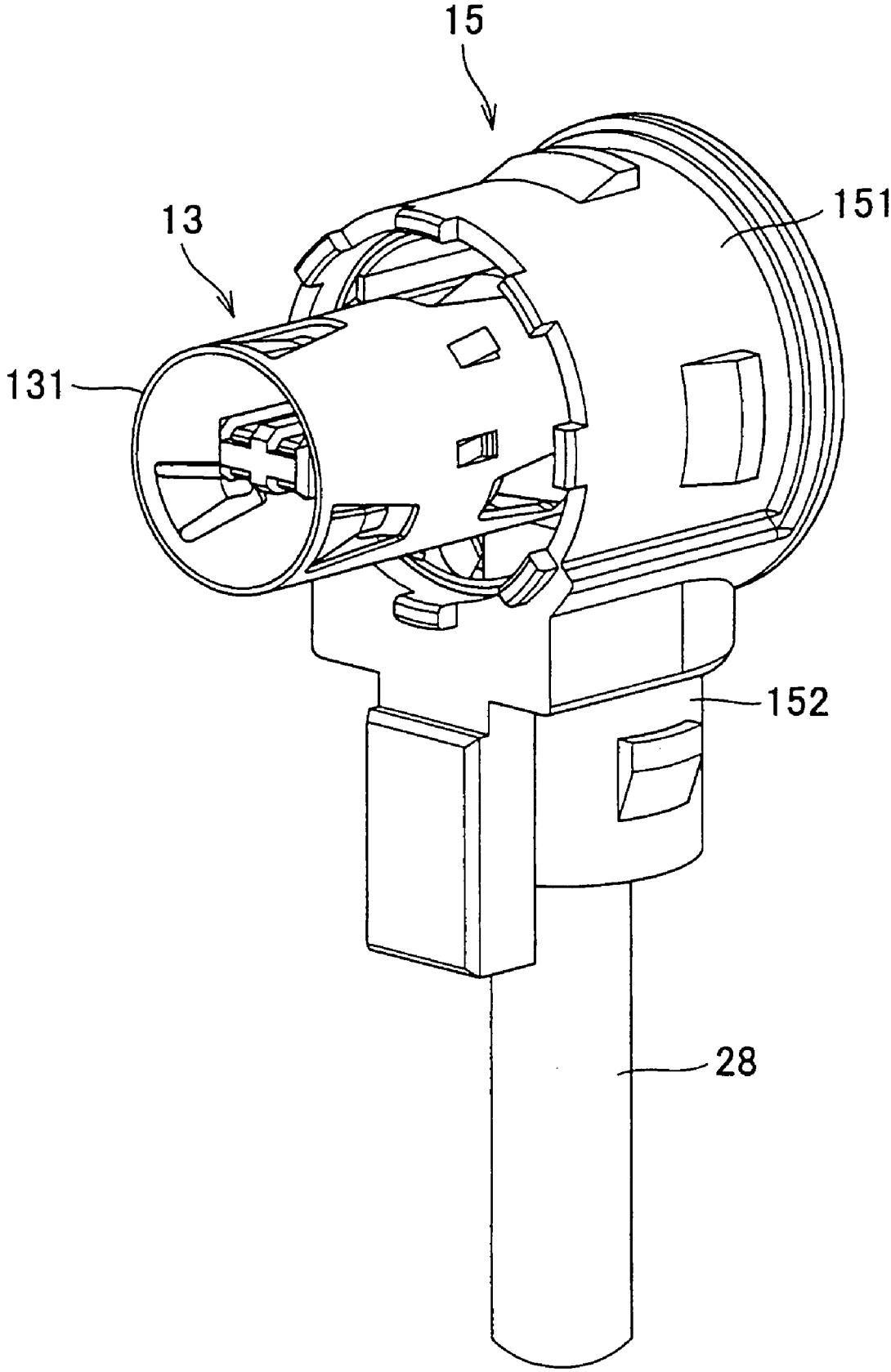
FIG. 7 is a perspective view of the angle end bell and the shield member appearing in FIG. 6, in a state in which the shield member has been mounted in the angle end bell

Next, as shown in FIG. 7, the shield member 13 is disposed within the angle end bell 15.

Then, as shown in FIG. 1, the O ring 21 is mounted on the shield portion 131 of the shield member 13. After that, the positioning recesses 162*a* and the positioning protrusions 162*b* of the barrel 16 are fitted to the positioning protrusions 151*b* and the positioning recesses 151*c* of the angle end bell 15, respectively, and the flange portion 162 of the barrel 16 is brought into abutment with the riser surface 151*d* of the angle end bell 15 via the O ring 21 (see FIG. 3).

Next, the coupling nut 18 is fitted on the angle end bell 15 in the fitting direction, as indicated by an arrow shown in FIG. 1. At this time, the rear end of the coupling nut 18 is widened in a radial direction thereof. The rear end of the coupling nut 18 climbs over the locking nails 151*a* of the angle end bell 15 to have the locking nails 151*a* inserted into the locking holes 181*a* of the coupling nut 18, so that the radius of the rear end of the coupling nut 18 is restored. As a consequence, the locking nails 151*a* are prevented from being easily disengaged from the locking holes 181*a*, whereby the coupling nut 18 is firmly locked to the angle end bell 15. Further, at this time, the fitting protrusion 152*b* of the angle end bell 15 is fitted in the fitting recess 182*a* (see FIG. 8) of the coupling nut 18. When the coupling nut 18 is locked to the angle end bell 15, the flange portion 162 is urged by a protruding portion 18*a* of the coupling nut 18, whereby the barrel 16 is held by the coupling nut 18 and the angle end bell 15.

Figure 9:
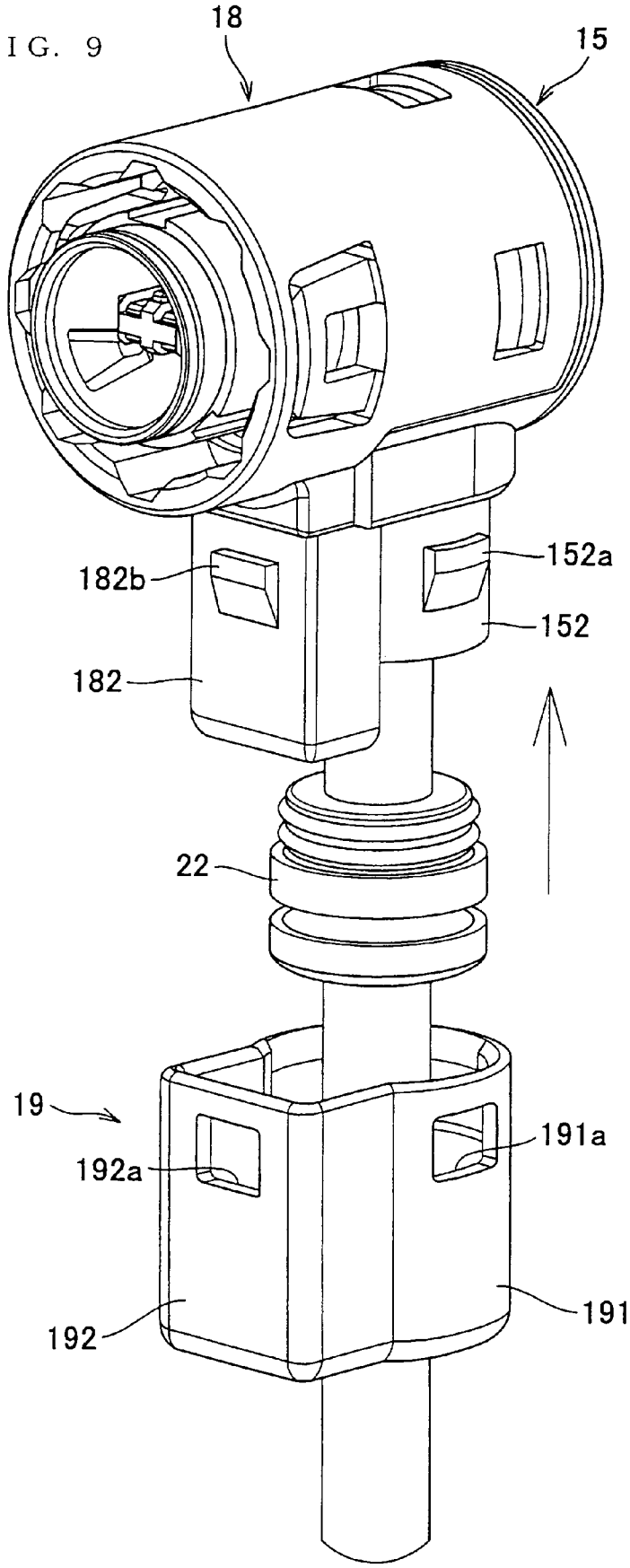
FIG. 9 is a perspective view of a bushing, a gland nut, the angle end bell, and the coupling nut of the angle-type plug connector shown in FIG. 1, in a state before the bushing and the gland nut are mounted to the angle end bell and the coupling nut.
Figure 10:
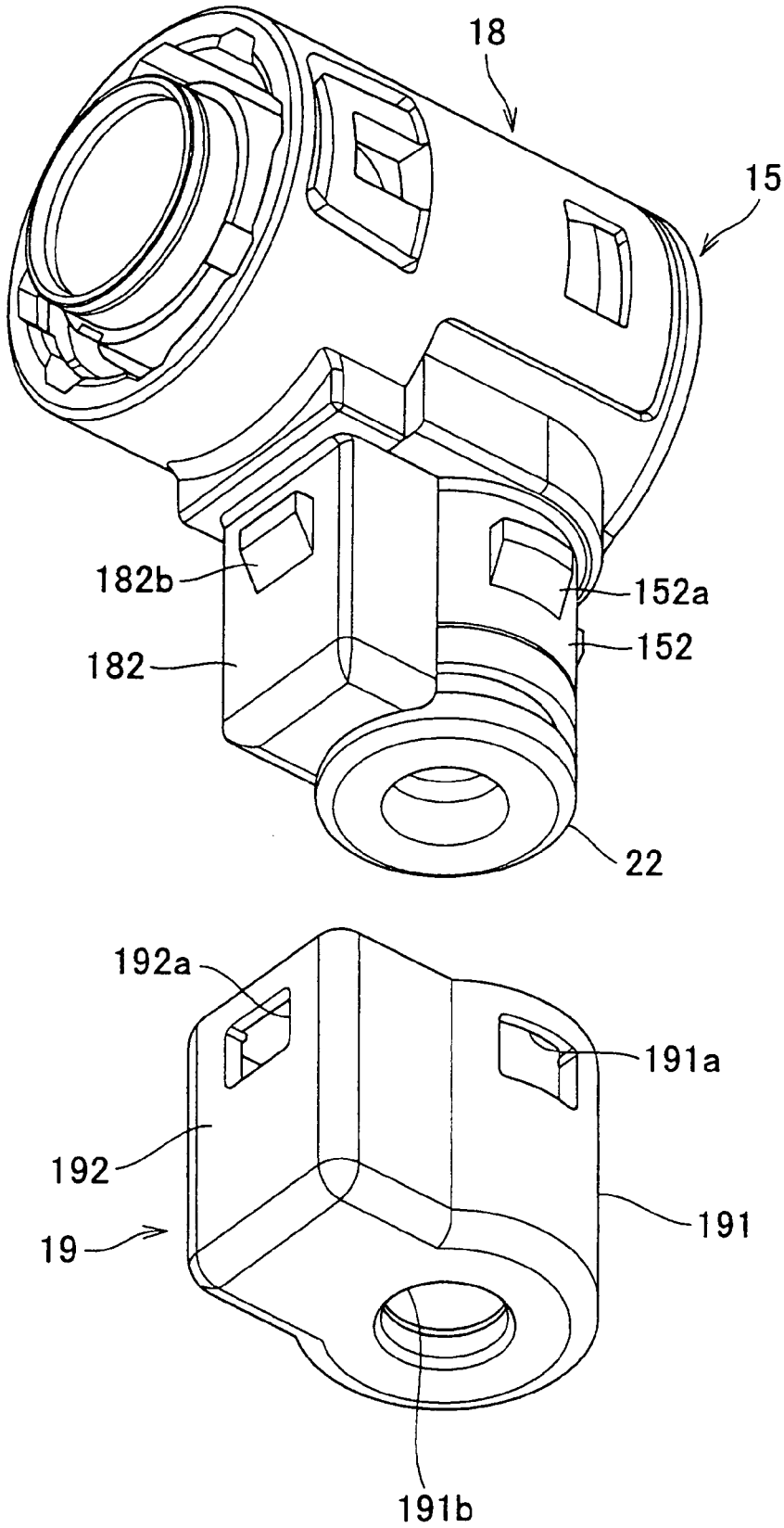
FIG. 10 is a perspective view of the bushing, the angle end bell, and the coupling nut appearing in FIG. 9, in a state in which the bushing is mounted to the angle end bell and the coupling nut.

Then, after a bushing (second shield member) 22 and the gland nut 19 are fitted on the cable 28, the bushing 22 is moved upward, as indicated by an arrow in FIG. 9, and is inserted into the cable running portion 152 of the angle end bell 15, as shown in FIG. 10. At this time, the bushing 22 is compressed. After that, the gland nut 19 is fitted to the cable running portion 152 of the angle end bell 15 and the fitting recess 182*a* of the coupling nut 18. At this time, since the upper end of the gland nut 19 is widened in a radial direction thereof, the upper end of the gland nut 19 climbs over the locking nails 152*a* of the angle end bell 15 and the locking nail 182*b* of the coupling nut 18 to have the locking nails 152*a* and 182*b* fitted in the locking holes 191*a* and 192*a*, whereby the radius of the upper end of the gland nut 19 is restored. As a consequence, the locking nails 152*a* and 182*b* are prevented from being easily disengaged from the locking holes 191*a* and 192*a*, whereby the gland nut 19 is firmly locked to the angle end bell 15 and the coupling nut 18. Further, the bushing 22 is further compressed to positively seal the inner space of the angle end bell 15.

Figure 11:
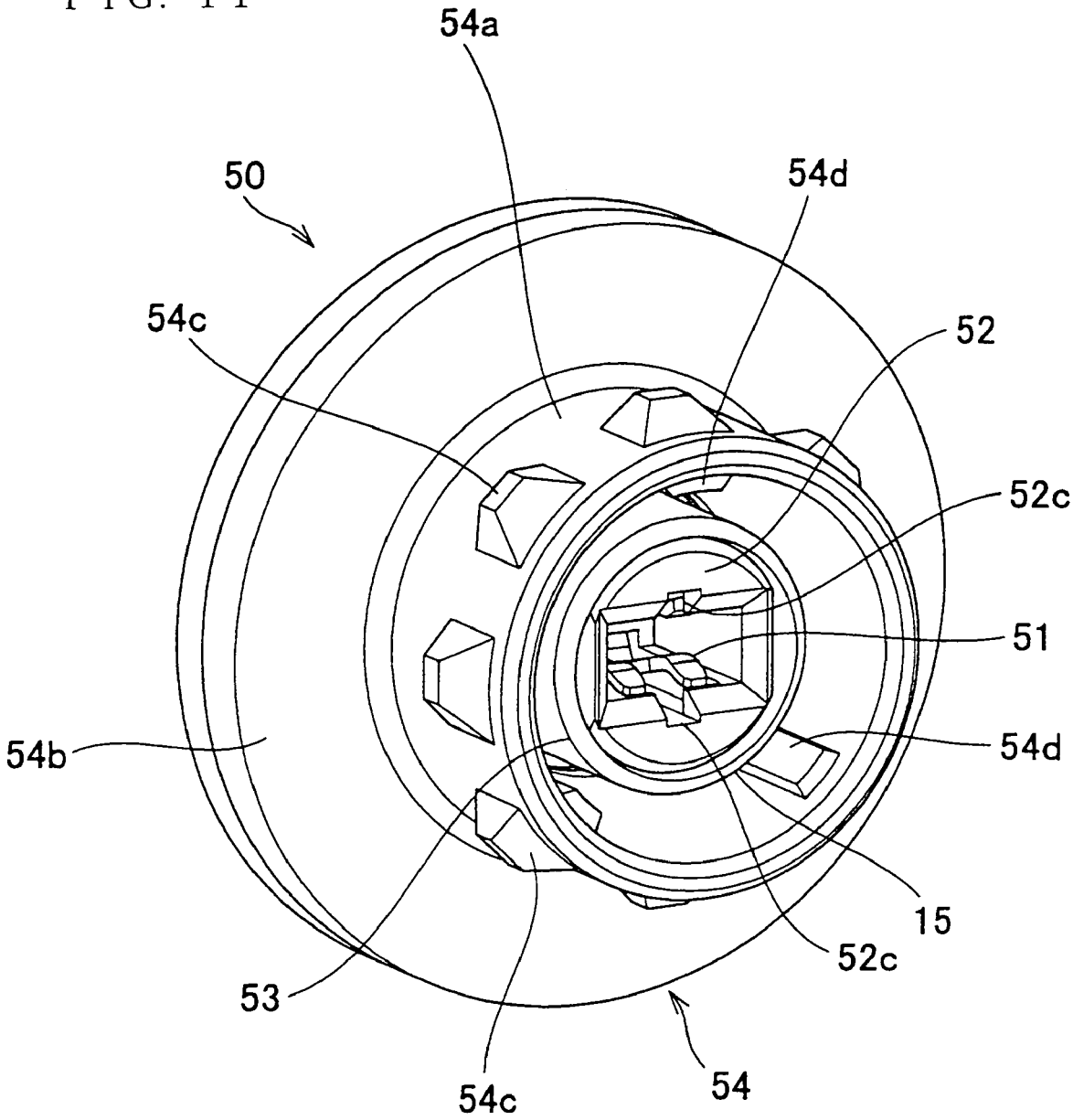
FIG. 11 is a perspective view of a receptacle connector for being connected to the angle-type plug connector shown in FIG. 1.
Figure 12:
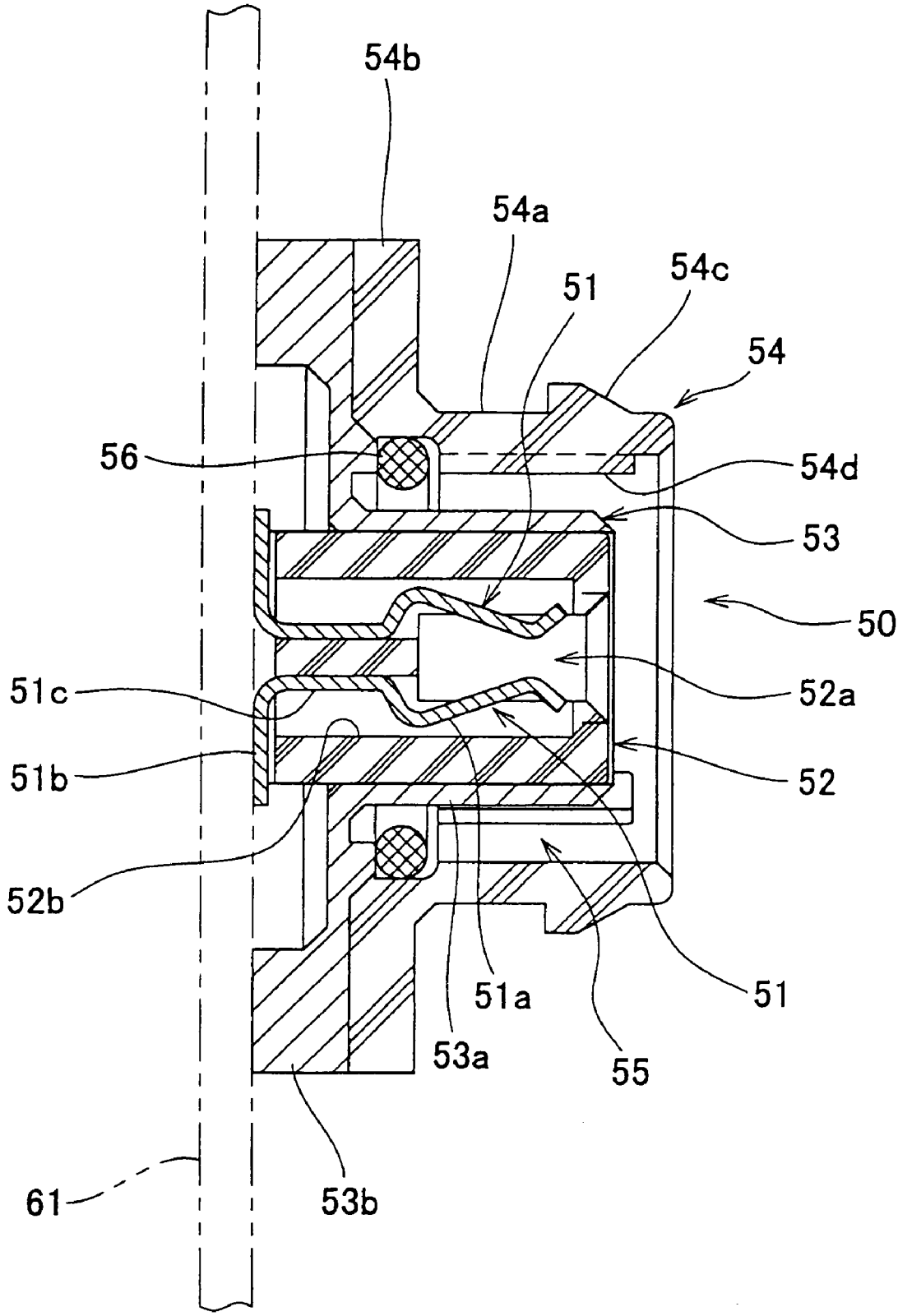
FIG. 12 is a cross-sectional view of the receptacle connector shown in FIG. 11.
Figure 13:
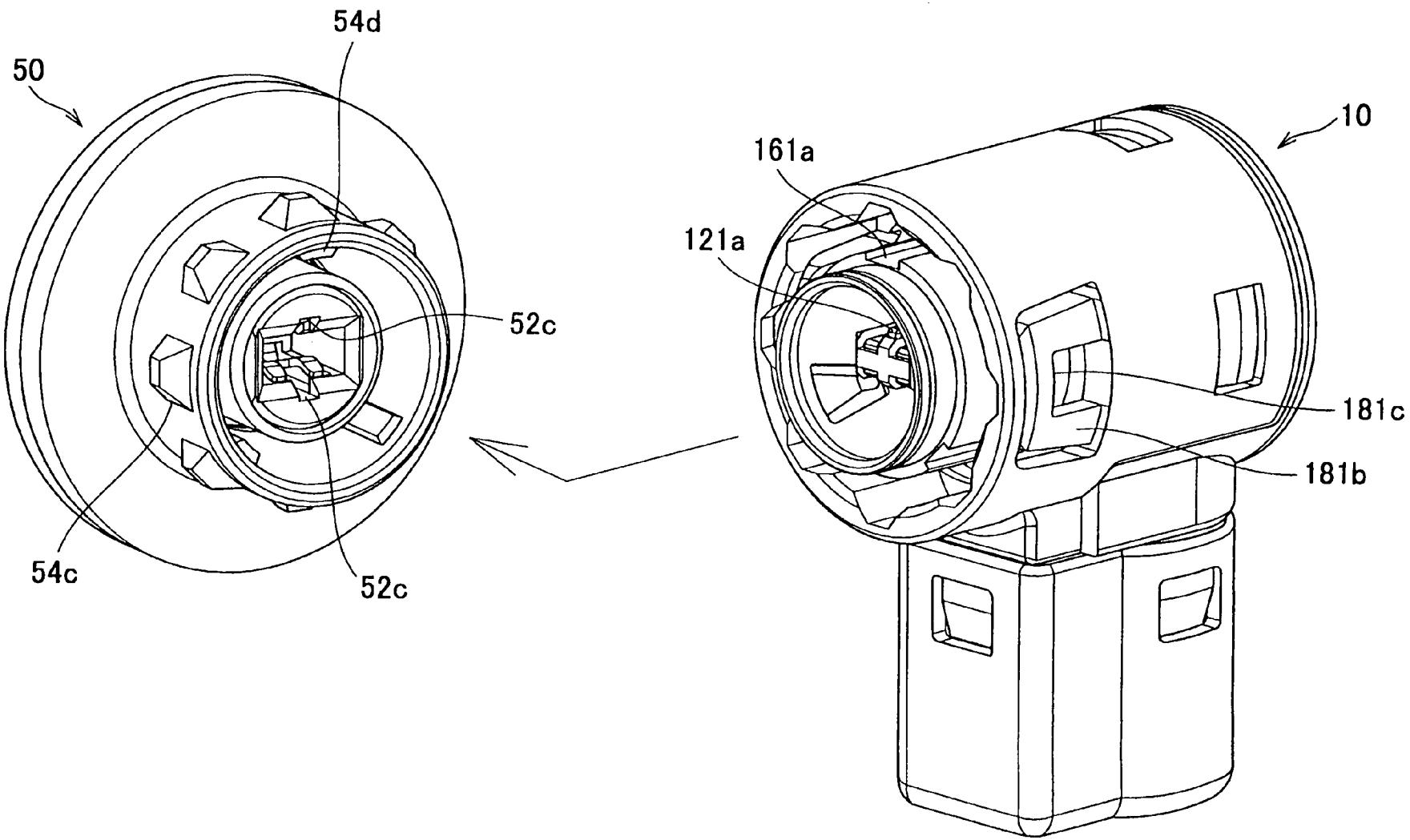
FIG. 13 is a perspective view of the angle-type plug connector shown in FIG. 1 and the receptacle connector shown in FIG. 11, in a state before the former is connected to the latter.
Figure 14:
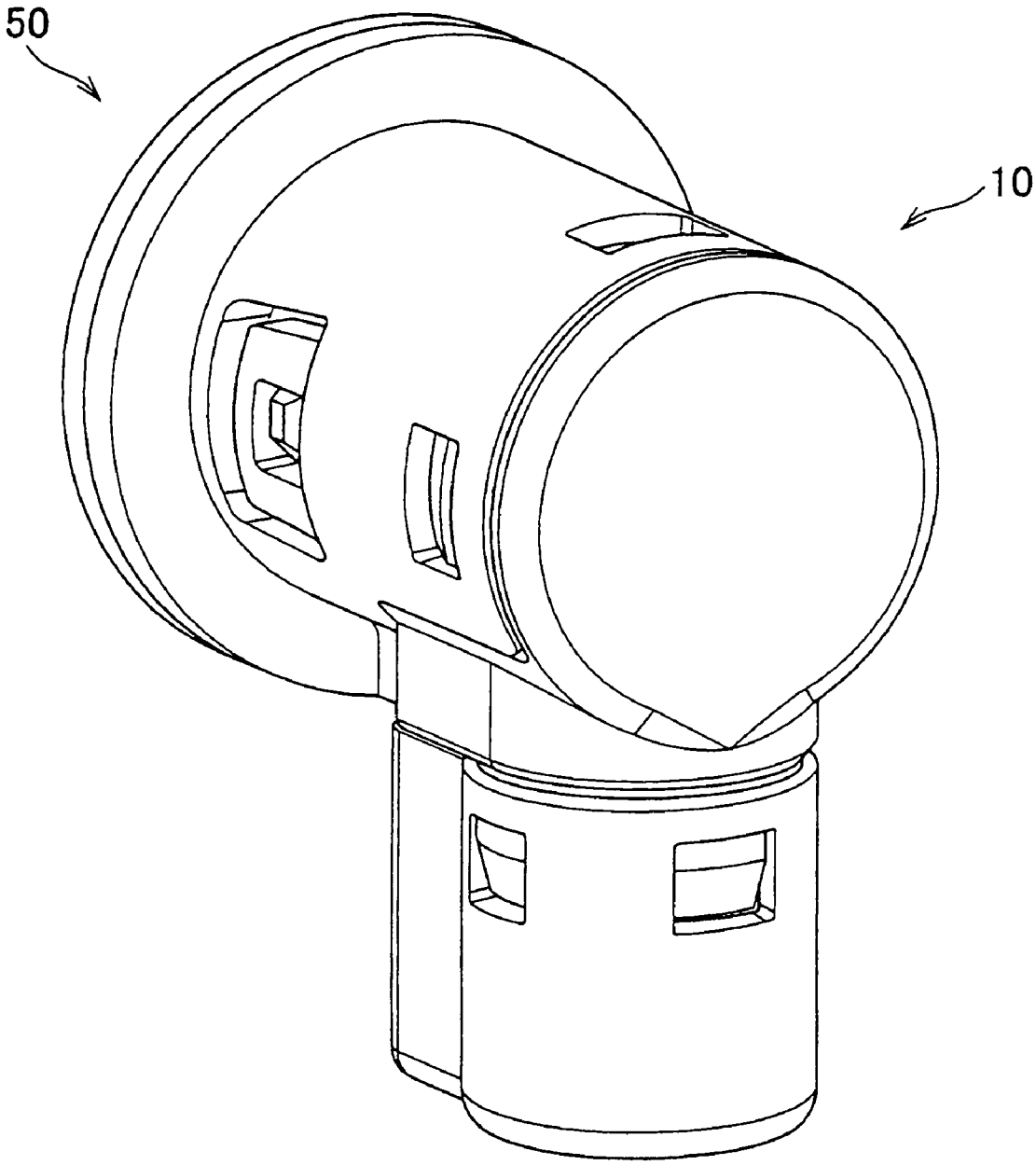
FIG. 14 is a perspective view of the angle-type plug connector shown in FIG. 1 and the receptacle connector shown in FIG. 11, in a state after the former has been connected to the latter.

FIG. 11 is a perspective view of the receptacle connector connected to the angle-type plug connector shown in FIG. 1. FIG. 12 is a cross-sectional view of the receptacle connector shown in FIG. 11. FIG. 13 is a perspective view of the angle-type plug connector shown in FIG. 1 and the receptacle connector shown in FIG. 11, in a state before the former is connected to the latter. FIG. 14 is a perspective view of the angle-type plug connector shown in FIG. 1 and the receptacle connector shown in FIG. 11, in a state after the former has been connected to the latter. It should be noted that illustration of cables is omitted from FIGS. 13 and 14 for the sake of convenience.

Referring to FIGS. 11 and 12, the receptacle connector (mating connector) 50 is comprised of female terminals 51, the receptacle-side housing 52, a gland shell 53, and a shell 54.

Each female terminal 51 includes a contact portion 51*a*, a terminal portion 51*b*, and a connecting portion 51*c*. The contact portion 51*a* is brought into contact with the associated male terminal 11 of the angle-type plug connector 10. The terminal portion 51*b* is soldered to a conductive path, not shown, of a printed circuit board 61. The connecting portion 51*c* connects between the contact portion 51*a* and the terminal portion 51*b*.

The receptacle-side housing 52 has a generally hollow cylindrical shape, and includes a receiving portion 52*a*, terminal accommodating holes 52*b*, and positioning key grooves 52*c*. The receiving portion 52*a* receives the terminal holding portion 121 of the plug-side housing 12 of the angle-type plug connector 10, together with the male terminals 11. The terminal accommodating holes 52*b* receive the female terminals 51, and one end of each terminal accommodating hole 52*b* communicates with the receiving portion 52*a*. The positioning key grooves 52*c* receives the respective associated positioning keys 121*a* of the plug-side housing 12.

The gland shell 53 includes a hollow cylindrical portion 53*a* and a flange portion 53*b*. The hollow cylindrical portion 53*a* and the flange portion 53*b* are integrally made of a conductive thin metal plate. The hollow cylindrical portion 53*a* covers the receptacle-side housing 52. The flange portion 53*b* is fixed to the printed circuit board 61.

The shell 54 includes a hollow cylindrical portion 54*a* and a flange portion 54*b*. The hollow cylindrical portion 54*a* and the flange portion 54*b* are integrally formed of resin. The hollow cylindrical portion 54*a* of the shell 54 surrounds the hollow cylindrical portion 53*a* of the gland shell 53. Formed between the hollow cylindrical portion 54*a* of the shell 54 and the hollow cylindrical portion 53*a* of the gland shell 53 is an annular space 55 (see FIG. 12) into which is inserted the shield portion 131 of the shield member 13 covered with the barrel 16. When the shield portion 131 is inserted into the annular space 55, the lances 131*b* of the shield portion 131 are brought into contact with the gland shell 53. The hollow cylindrical portion 54*a* has eight locking nails (mating connector-side locking portions) 54*c* formed on an outer peripheral surface thereof at circumferentially equally-spaced intervals. Further, the hollow cylindrical portion 54*a* has three main fitting keys 54*d* in an inner peripheral surface thereof at circumferentially equally-spaced intervals. The main fitting keys 54*d* are inserted into the erroneous fitting-preventing key grooves 161*a* of the barrel 16 of the angle-type plug connector 10.

The flange portion 54*b* is abutted against the flange portion 53*b* of the gland shell 53, and a rubber O ring 56 is disposed between the main fitting keys 54*d* and the flange portion 53*b*.

Next, a description will be given of operation for connecting between the angle-type plug connector 10 and the receptacle connector 50.

First, as shown in FIG. 13, the positioning keys 121*a* of the angle-type plug connector 10 are caused to face the positioning key grooves 52*c* of the receptacle connector 50, and the erroneous fitting-preventing key grooves 161*a* of the angle-type plug connector 10 are caused to face the main fitting keys 54*d* of the receptacle connector 50, whereafter the angle-type plug connector 10 is pushed into the receptacle connector 50. At this time, each locking piece 181*b* of the angle-type plug connector 10 is elastically deformed to climb over an associated one of the locking nails 54*c* of the receptacle connector 50, whereby the locking nails 54*c* enter the associated respective holes 181*c* of the locking pieces 181*b* and the locking pieces 181*b* restore their original states. As described above, the angle-type plug connector 10 is locked to the receptacle connector 50, as shown in FIG. 14. Further, when the angle-type plug connector 10 is pushed into the receptacle connector 50, the foremost end of the barrel 16 of the angle-type plug connector 10 is inserted into the annular space 55 of the receptacle connector 50, and the O ring 56 is pressed by the foremost end of the barrel 16 to thereby seal the inner space of the receptacle-side housing 52.

Further, the lances 131*b* of the shield portion 131 of the angle-type plug connector 10 are brought into contact with the gland shell 53 of the receptacle connector 50, whereby the shield member 13 and the gland shell 53 are electrically connected to each other to provide electric shielding.

Figure 15:
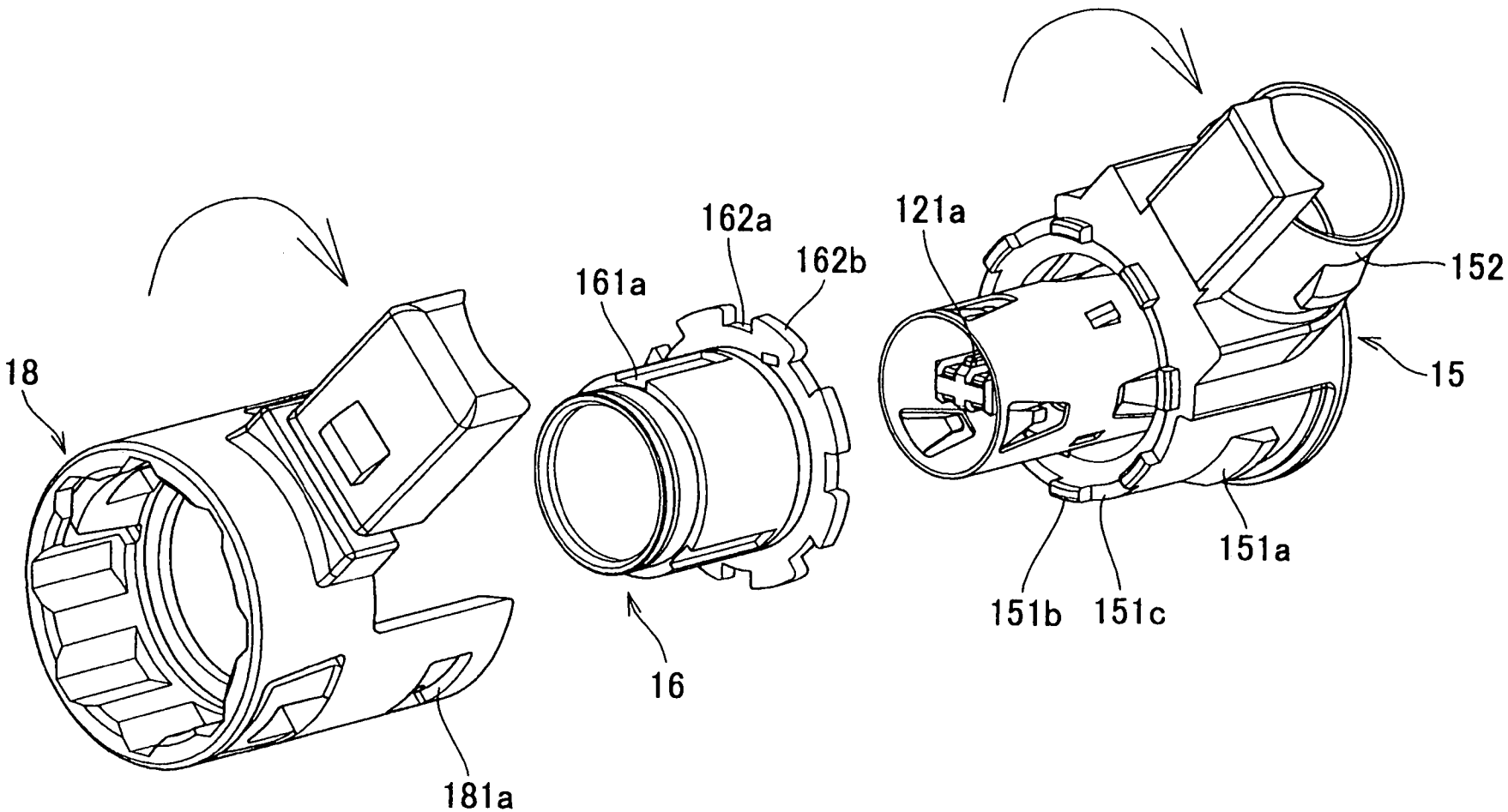
FIG. 15 is an exploded perspective view of the angle-type plug connector shown in FIG. 1 in a disassembled state.

FIG. 15 is an exploded perspective view of the angle-type plug connector shown in FIG. 1 in a disassembled state.

Next, a description will be given of a method of changing the direction of running the cable 28 of the angle-type plug connector 10.

Figure 17:
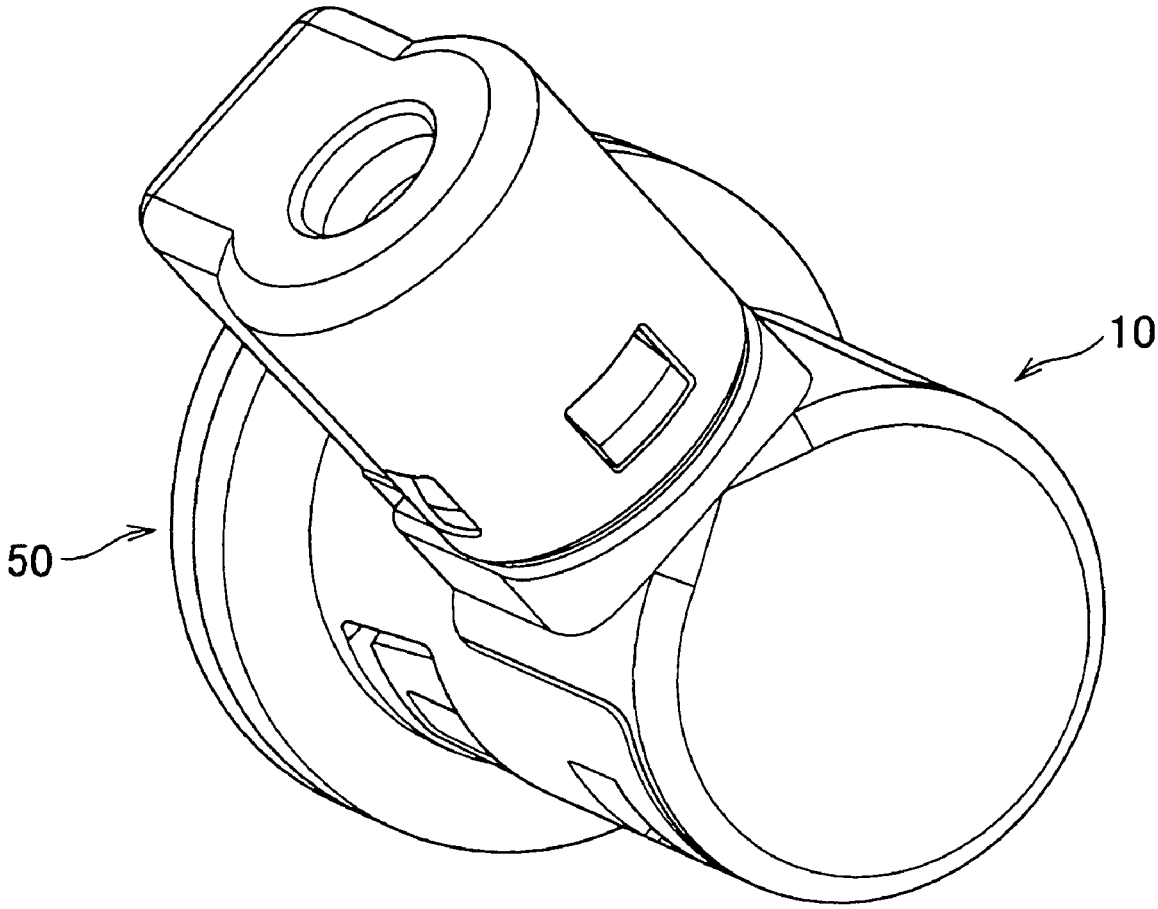
FIG. 17 is a perspective view of the angle-type plug connector shown in FIG. 15 and the receptacle connector shown in FIG. 11, in a state after the former has been connected to the latter.

For example, in changing the direction of running the cable 28 as indicated in FIG. 14 to a direction of running the cable 28 as indicated in FIG. 17, first, the component parts of the angle-type plug connector 10 are disassembled, and the shield member 13 is rotated with respect to the plug-side housing 12 such that the orientation of the clamp portion 132 of the shield member 13 shown in FIG. 4 is changed so as to coincide with that of the cable running portion 152 of the angle end bell 15 shown in FIG. 15, whereafter the positioning keys 131*a* of the shield member 13 are inserted into the associated positioning key grooves 122*a* of the plug-side housing 12, respectively.

After that, the positioning recesses 162*a* and the positioning protrusions 162*b* of the barrel 16 are fitted to the positioning protrusions 151*b* and the positioning recesses 151*c* of the angle end bell 15, respectively, such that the positional relationship between the erroneous fitting-preventing key grooves 161*a* of the barrel 16 and the male terminals 11 becomes equal to the positional relationship shown in FIG. 1.

Then, the coupling nut 18, the bushing 22, and the gland nut 19 are mounted on the angle end bell 15 by the same assembly procedure as described above.

Figure 16:
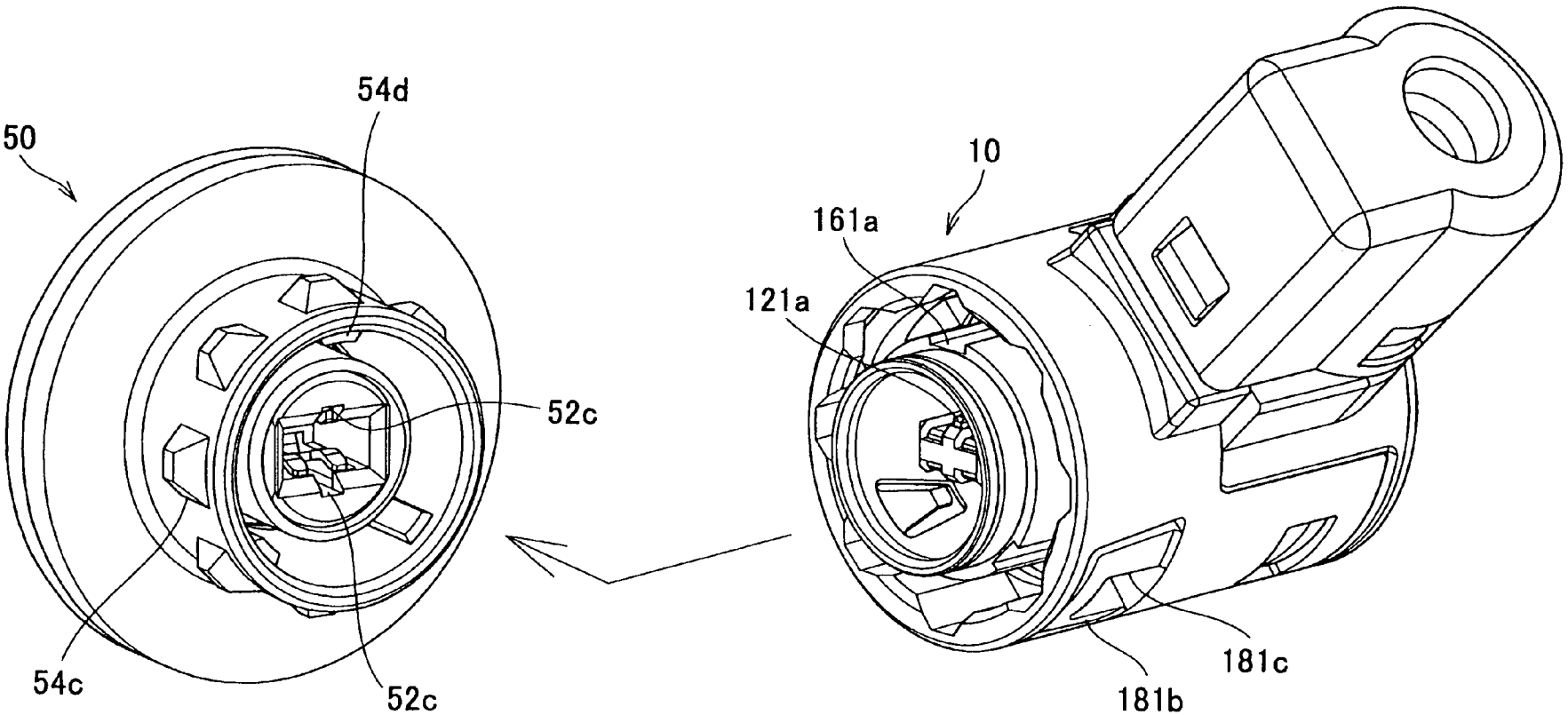
FIG. 16 is a perspective view of the angle-type plug connector shown in FIG. 15 and the receptacle connector shown in FIG. 11, in a state before the former is connected to the latter.

FIG. 16 is a perspective view of the angle-type plug connector shown in FIG. 15 and the receptacle connector shown in FIG. 11, in a state before the former is connected to the latter. FIG. 17 is a perspective view of the angle-type plug connector shown in FIG. 15 and the receptacle connector shown in FIG. 11, in a state after the former has been connected to the latter. It should be noted that illustration of cables is omitted from FIGS. 16 and 17 for the sake of convenience.

This connecting operation is performed similarly to the connecting operation described above with reference to FIGS. 13 and 14. First, as shown in FIG. 16, the positioning keys 121*a* of the angle-type plug connector 10 are caused to face the associated positioning key grooves 52*c* of the receptacle connector 50, and the erroneous fitting-preventing key grooves 161*a* of the angle-type plug connector 10 are caused to face the associated main fitting keys 54*d* of the receptacle connector 50, whereafter the angle-type plug connector 10 is pushed into the receptacle connector 50. This causes the angle-type plug connector 10 to be locked to the receptacle connector 50, as shown in FIG. 17.

According to the angle-type plug connector of the present embodiment, by changing component parts, it is possible to set the direction of running the cable at a predetermined angle as desired. Although in the present embodiment, there are formed eight positioning key grooves 122*a*, eight positioning recesses, and eight positioning protrusions, the number of the respective component parts may be reduced. If the number of the respective component parts is increased, it is possible to set the direction of running the cable to any of a larger number of positions of these members.

Further, since the contour components (the angle end bell 15, the barrel 16, the coupling nut 18, etc.) except for the shield member 13 are formed of resin, it is possible to achieve reduction of the manufacturing costs, size and weight of the angle-type plug connector.

Further, the locking of the coupling nut 18 to the angle end bell 15 and that of the gland nut 19 to the angle end bell 15 can be achieved by a linear pushing operation. This makes it is possible to easily and positively assemble the angle-type plug connector 10.

Further, the angle-type plug connector has waterproof property and shielding property.

It should be noted that although in the present embodiment, the angle-type plug connector is given waterproof property and shielding property, the angle-type plug connector may be without waterproof property and shielding property.

Next, a variation of the angle-type plug connector according to the first embodiment will be described with reference to drawings.

Figure 18:
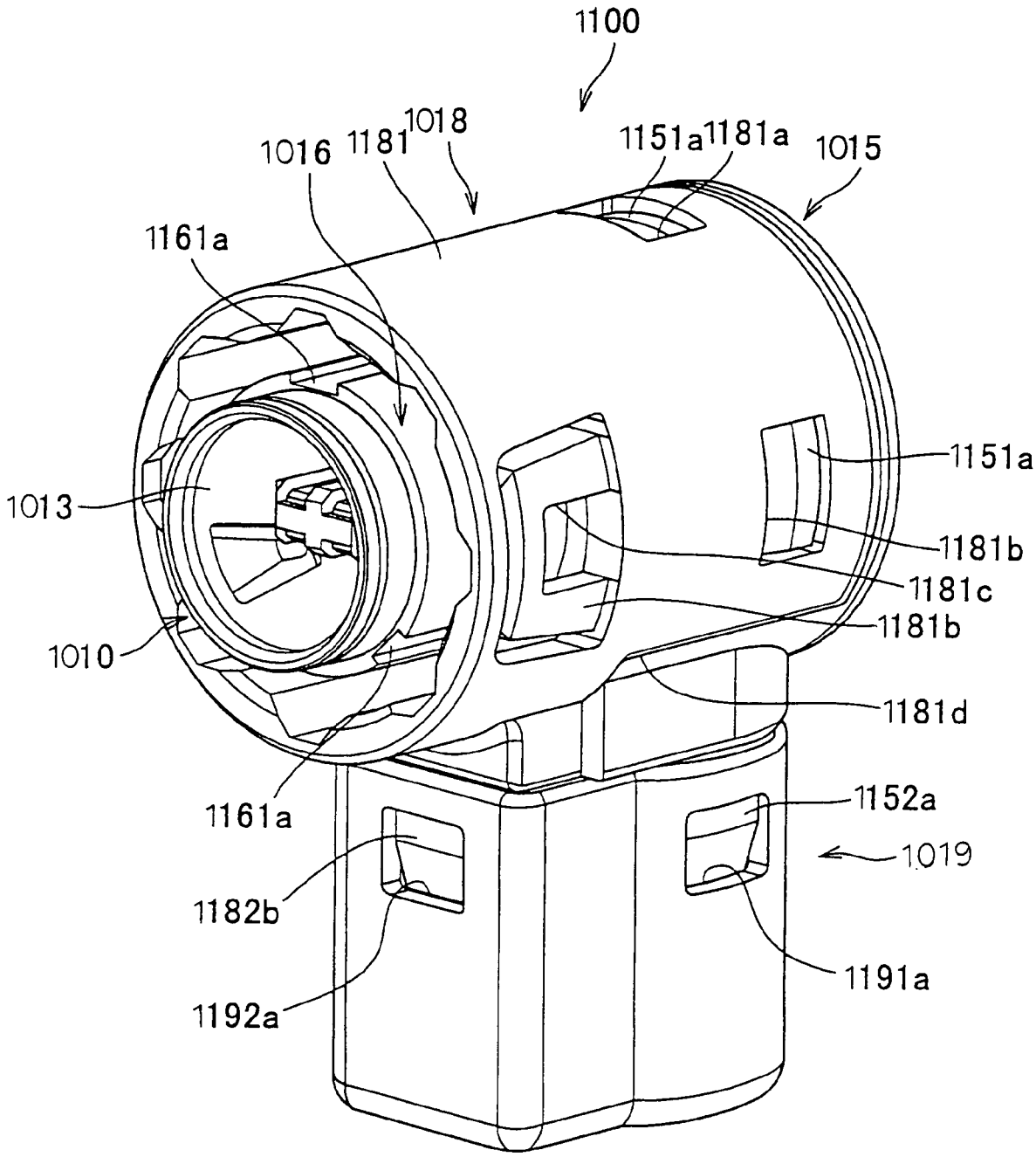
FIG. 18 is an exploded perspective view of a variation of the angle-type plug connector according to the first embodiment of the present invention.
Figure 19:
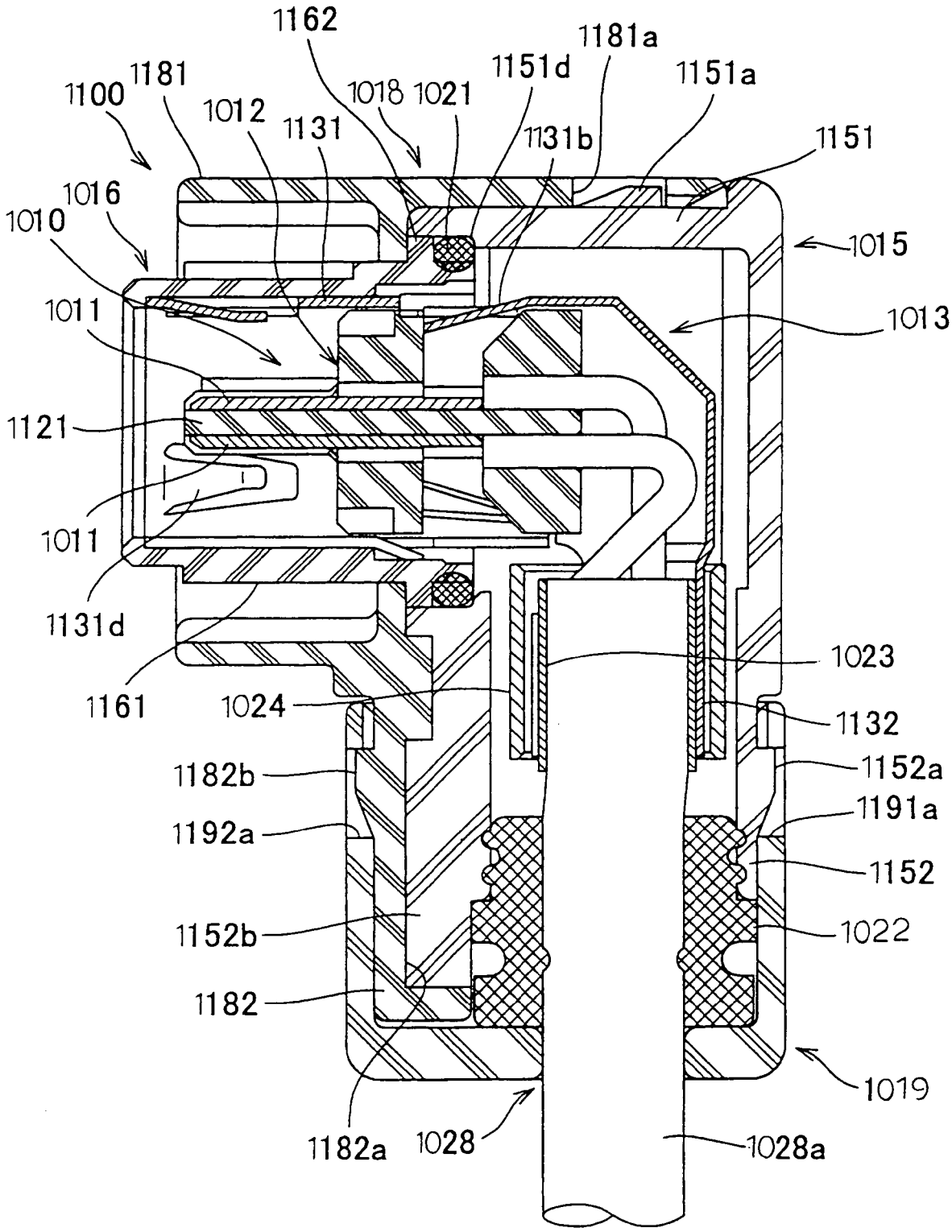
FIG. 19 is a cross-sectional view of the angle-type plug connector shown in FIG. 18.
Figure 20A:
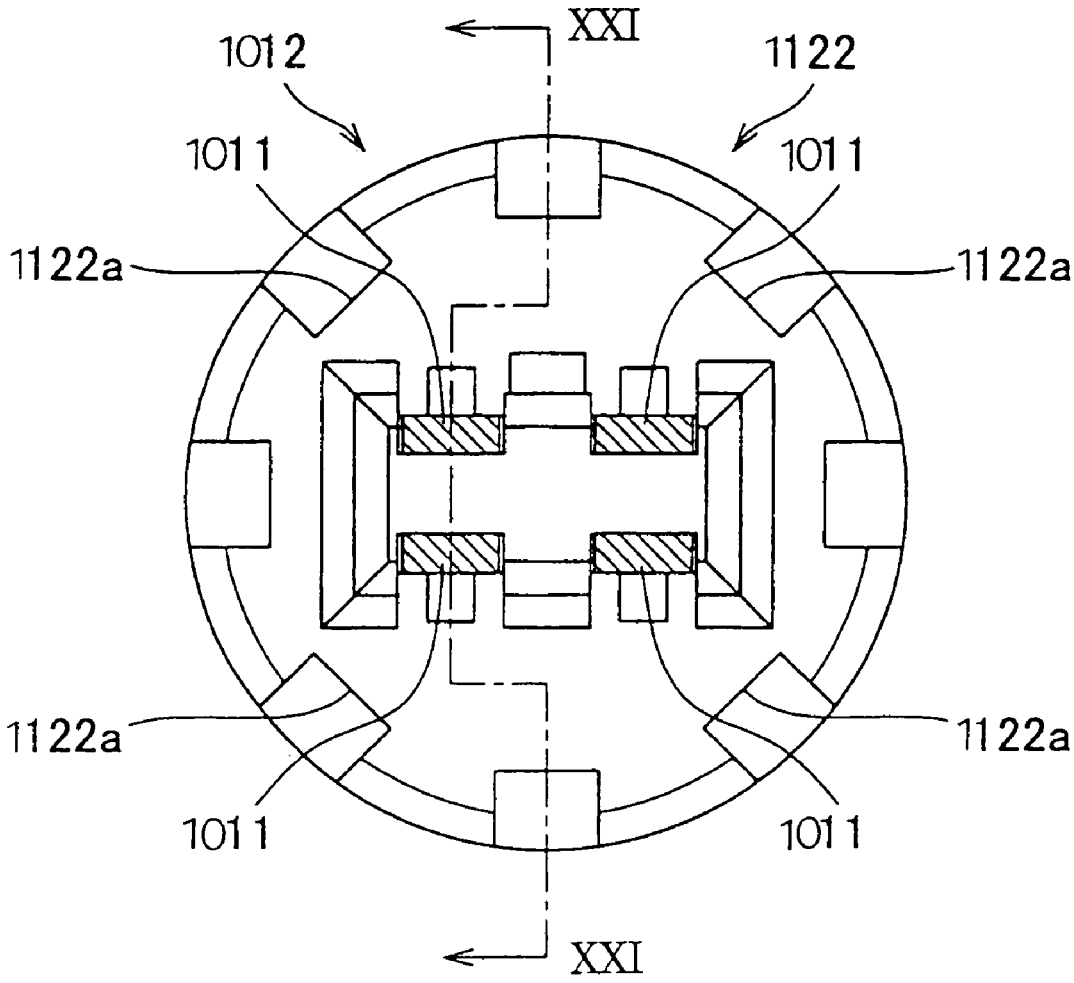
FIG. 20A is a front view of a connector body of the angle-type plug connector shown in FIG. 18.
Figure 20B:
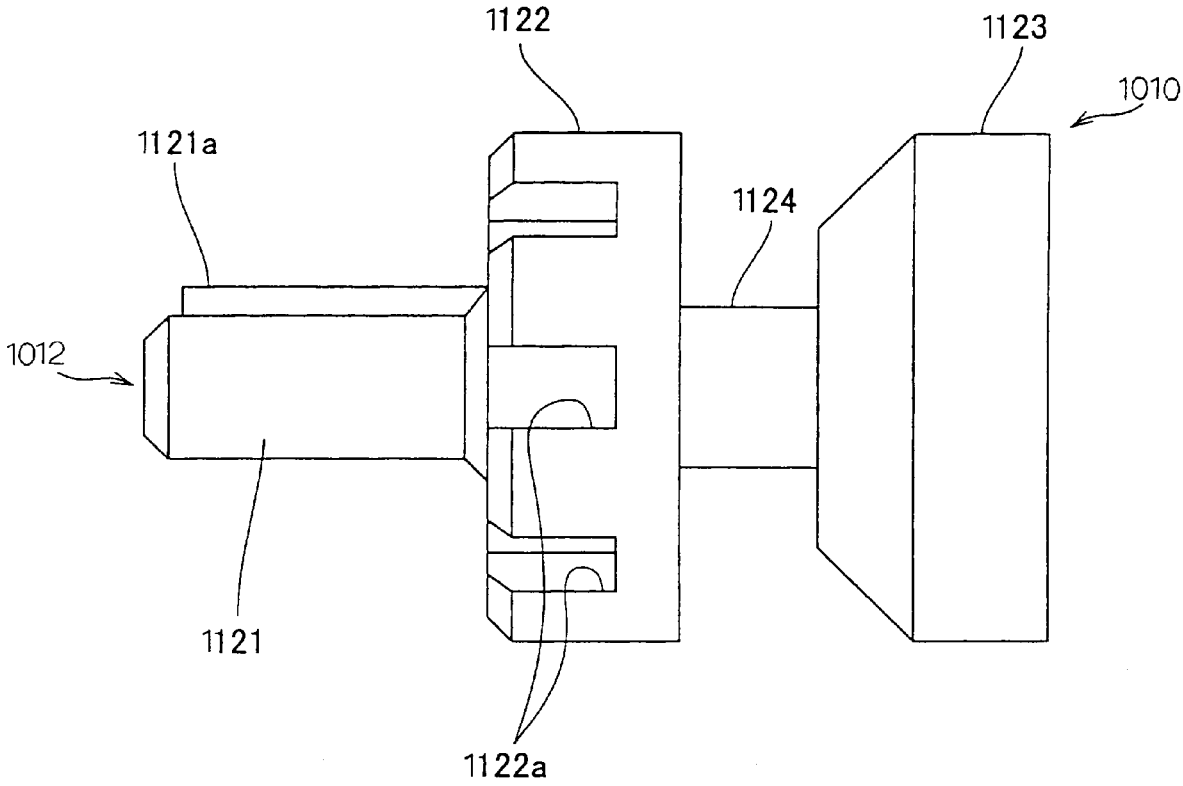
FIG. 20B is a side view of the connector body.
Figure 20C:
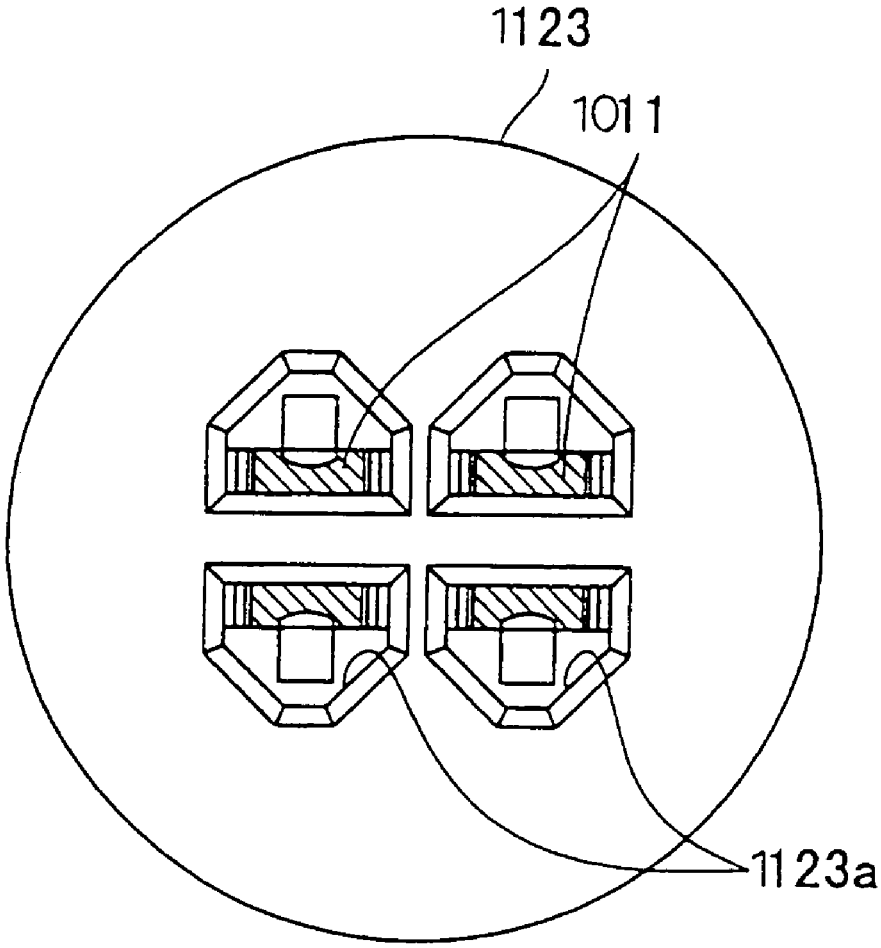
FIG. 20C is a rear view of the connector body.
Figure 20D:
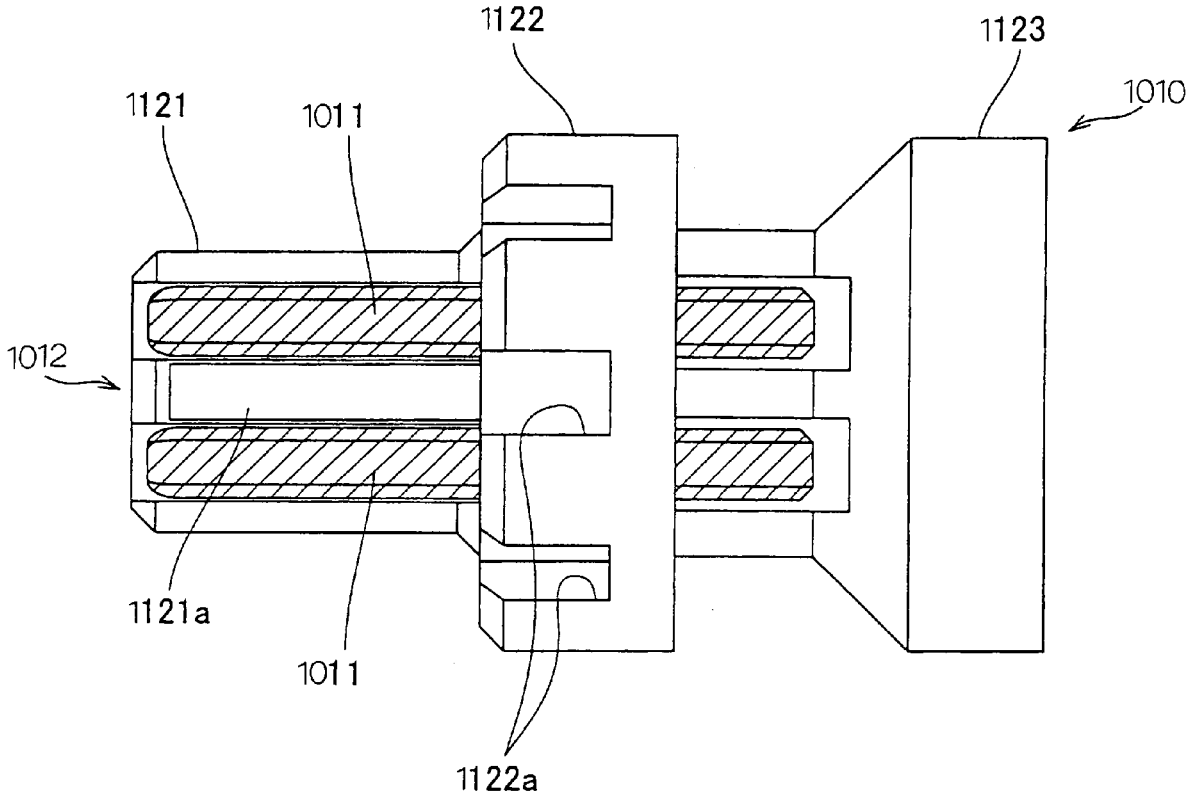
FIG. 20D is a plan view of the connector body.
Figure 21:
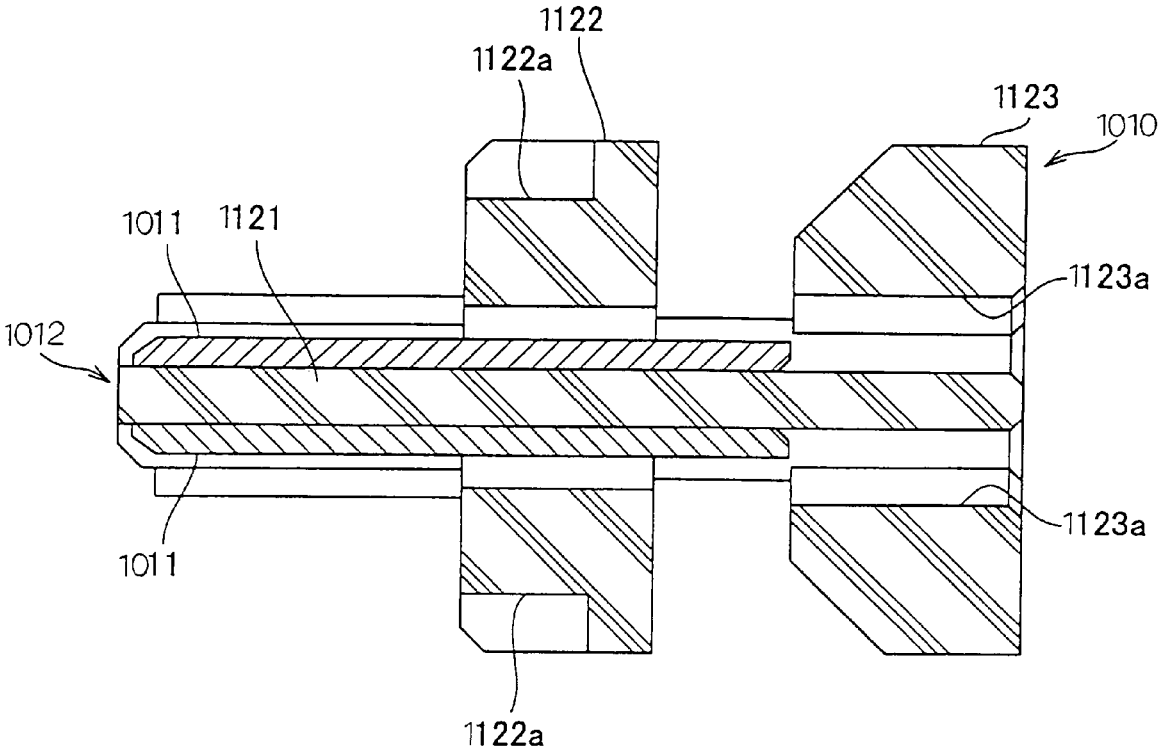
FIG. 21 is a cross-sectional view taken on line XXI-XXI of FIG. 20A.
Figure 22:
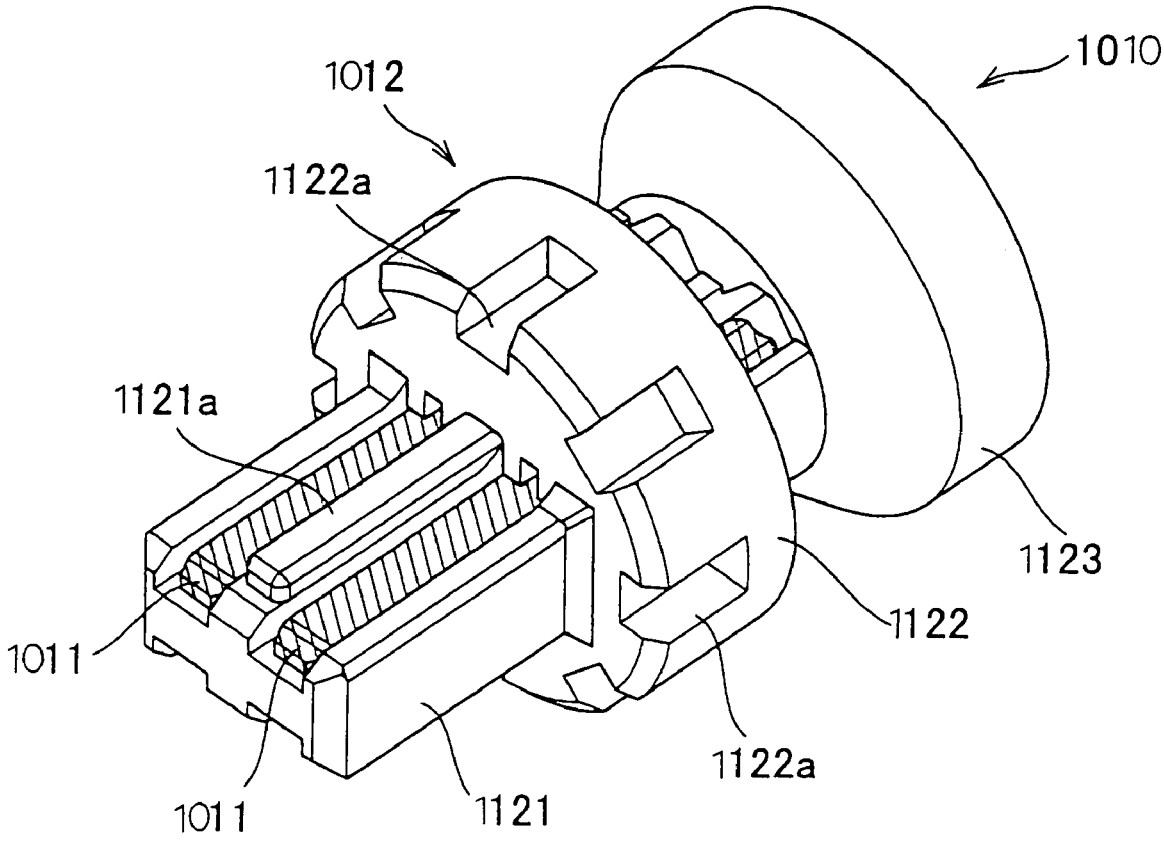
FIG. 22 is a perspective view of the connector body shown in FIGS. 20A to 20D, as taken obliquely from the front and above.
Figure 23:
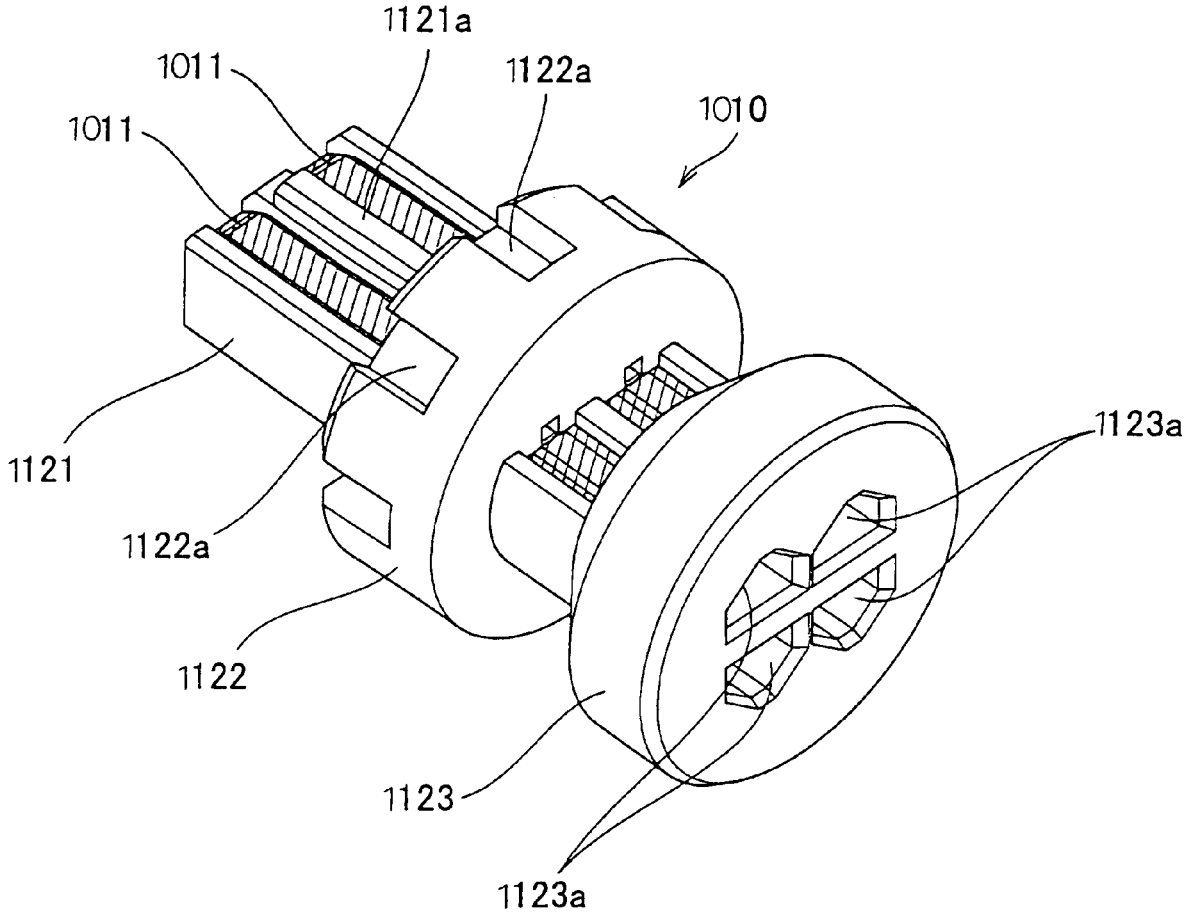
FIG. 23 is a perspective view of the connector body shown in FIGS. 20A to 20D, as taken obliquely from the rear and above.
Figure 24:
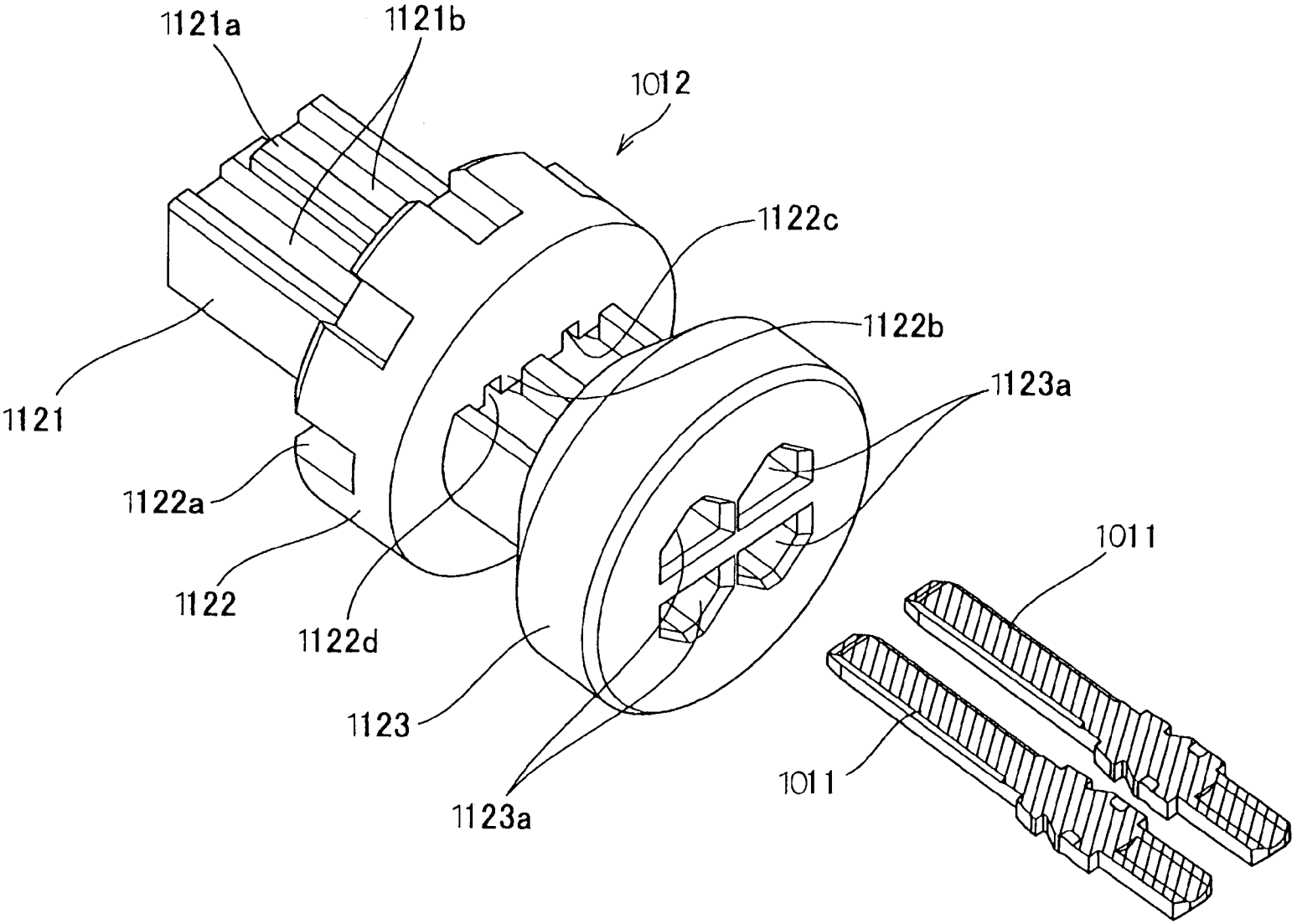
FIG. 24 is an exploded perspective view of the connector body shown in FIGS. 20A to 20D.

FIG. 18 is an exploded perspective view of the variation of the angle-type plug connector according to the first embodiment. FIG. 19 is a cross-sectional view of the angle-type plug connector shown in FIG. 18.

As shown in FIGS. 18 and 19, the angle-type plug connector 1100 according to the second embodiment is comprised of a connector body 1010, a shield member 1013, an angle end bell (end bell) 1015, a barrel 1016, a coupling nut 1018, and a gland nut 1019.

Referring to FIGS. 20A to 24, the connector body 1010 is comprised of male terminals 1011 and a plug-side housing 1012.

Figure 25:
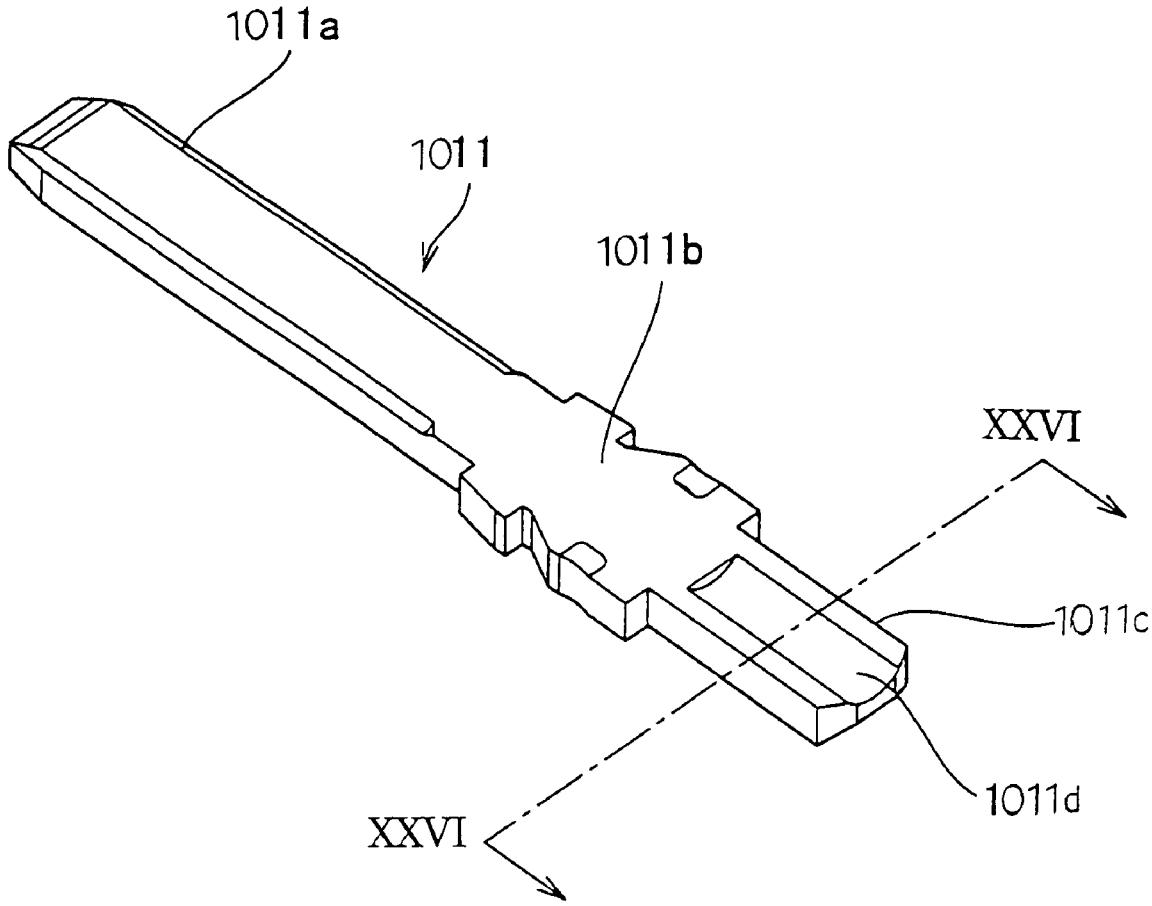
FIG. 25 is a perspective view of a male terminal of the connector body shown in FIGS. 20A to 20D.

Each male terminal 1011 is formed by blanking a thin metal plate such that it has a generally plate-like shape. The male terminal 1011 includes a contact portion 1011*a*, a press-fitting portion 1101*b*, and a cable connecting portion 1011*c* (see FIG. 25).

The contact portions 1011*a* are brought into contact with respective female terminals of a receptacle connector, not shown, which is a mating connector associated with the angle-type plug connector 1100.

The press-fitting portion 1011*b* continues from the contact portion 1011*a*. The press-fitting portion 1011*b* has a width larger than the width of the contact portion 1011*a* and that of the cable connecting portion 1011*c*. Further, the press-fitting portion 1011*b* has sides formed to have a sawtoothed shape.

Figure 26:
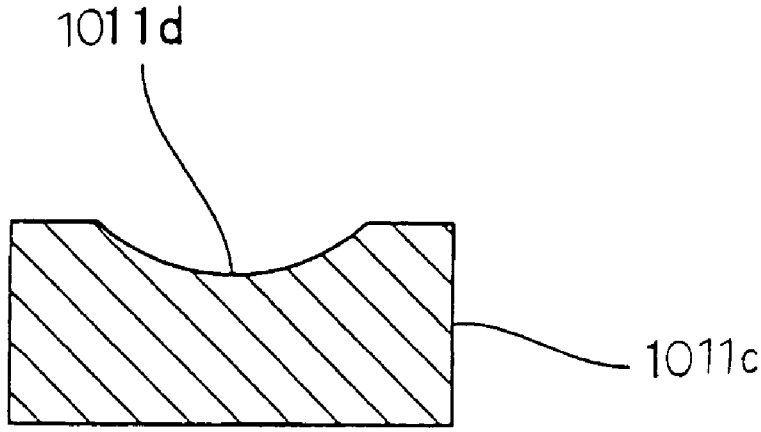
FIG. 26 is a cross-sectional view taken on line XXVI-XXVI of FIG. 25.

The cable connecting portion 1011*c* continues from the press-fitting portion 1011*b*. The cable connecting portion 1011*c* has a central portion formed with a groove-shaped recess 1011*d* (see FIG. 26). The recess 1011*d* is arcuate in cross section, and extends along the direction of the length of the male terminal 1011.

The plug-side housing 1012 includes a terminal holding portion 1121, a contact holding portion 1122, and a wire holding portion 1123. The terminal holding portion 1121, the contact holding portion 1122, and the wire holding portion 1123 are integrally formed of resin (see FIGS. 20B and 20D).

The terminal holding portion 1121 is generally prism-shaped. The terminal holding portion 1121 has upper and lower surfaces formed with two terminal accommodating grooves 1121*b*, respectively. When the male terminals 1011 are inserted into the respective associated terminal accommodating grooves 1121*b*, the press-fitting portions 1011*b* are press-fitted into the contact holding portion 1122. This causes the male terminals 1011 to be held by the contact holding portion 1122. When the male terminals 1011 are held by the contact holding portion 1122, one surfaces of the male terminals 1011 are exposed. Positioning keys 1121*a* are formed on surfaces of the terminal holding portion 1121 (see FIG. 24).

The contact holding portion 1122 is generally disk-shaped. Grooves 1122*d* communicating with the respective terminal accommodating grooves 1121*b* extend through a central portion of the contact holding portion 1122. The contact holding portion 1122 has eight positioning key grooves 1122*a* formed in an outer peripheral surface thereof at circumferentially equally-spaced intervals. Further, the contact holding portion 1122 has an inner peripheral surface formed with four pairs of terminal holders 1122*b*. Each pair of terminal holders 1122*b* hold the press-fitting portions 1011*b* of the respective male terminals 1011. A recess 1122*c* is formed between each pair of terminal holders 1122*b*.

Figure 27:
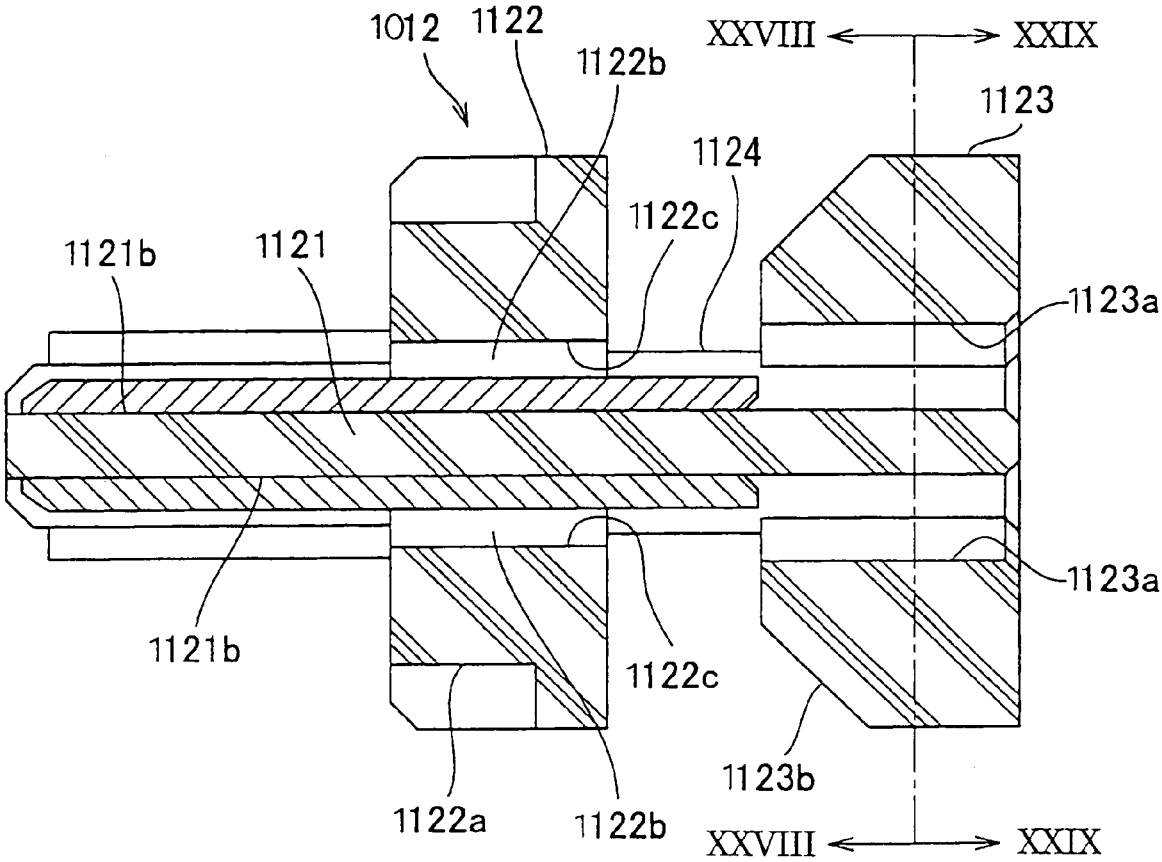
FIG. 27 is a cross-sectional view of the connector body shown in FIGS. 20A to 20D.
Figure 28:
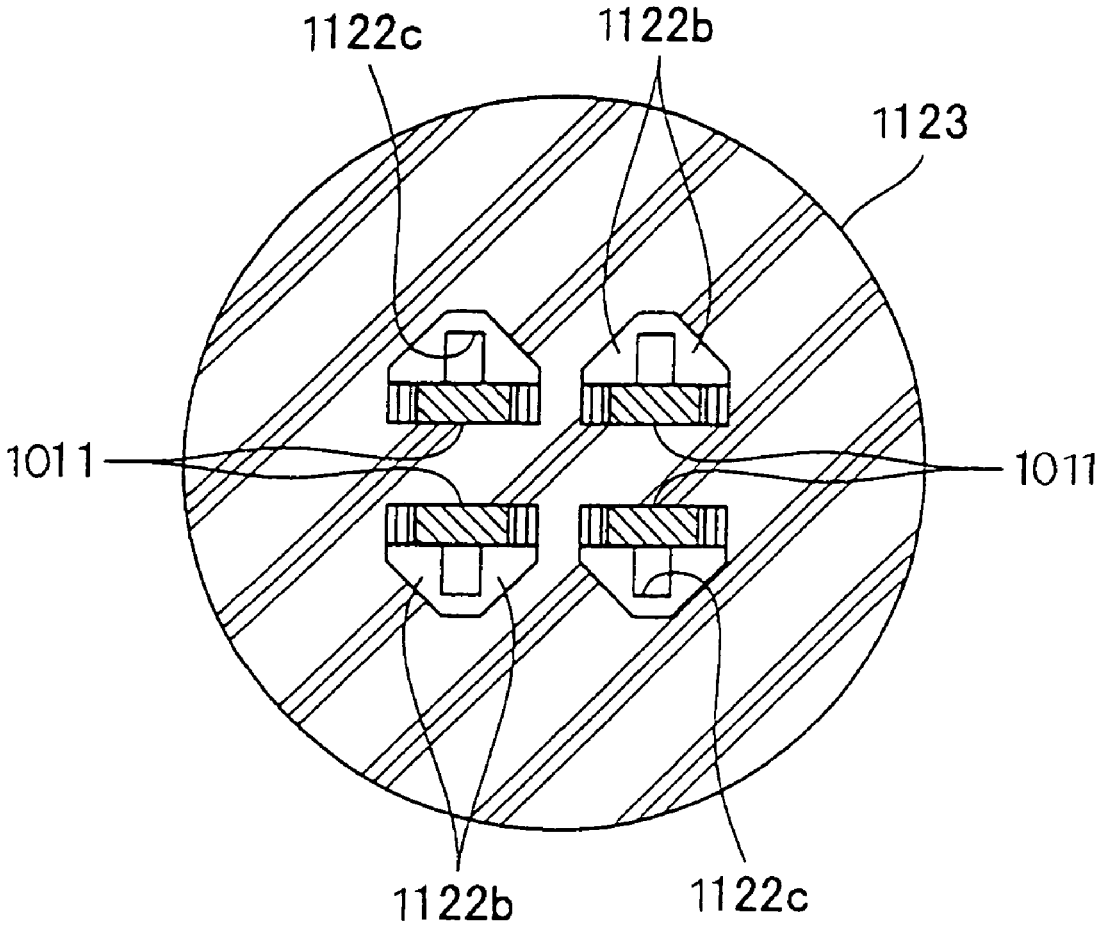
FIG. 28 is a cross-sectional view taken on line XXVIII-XXVIII of FIG. 27.
Figure 29:
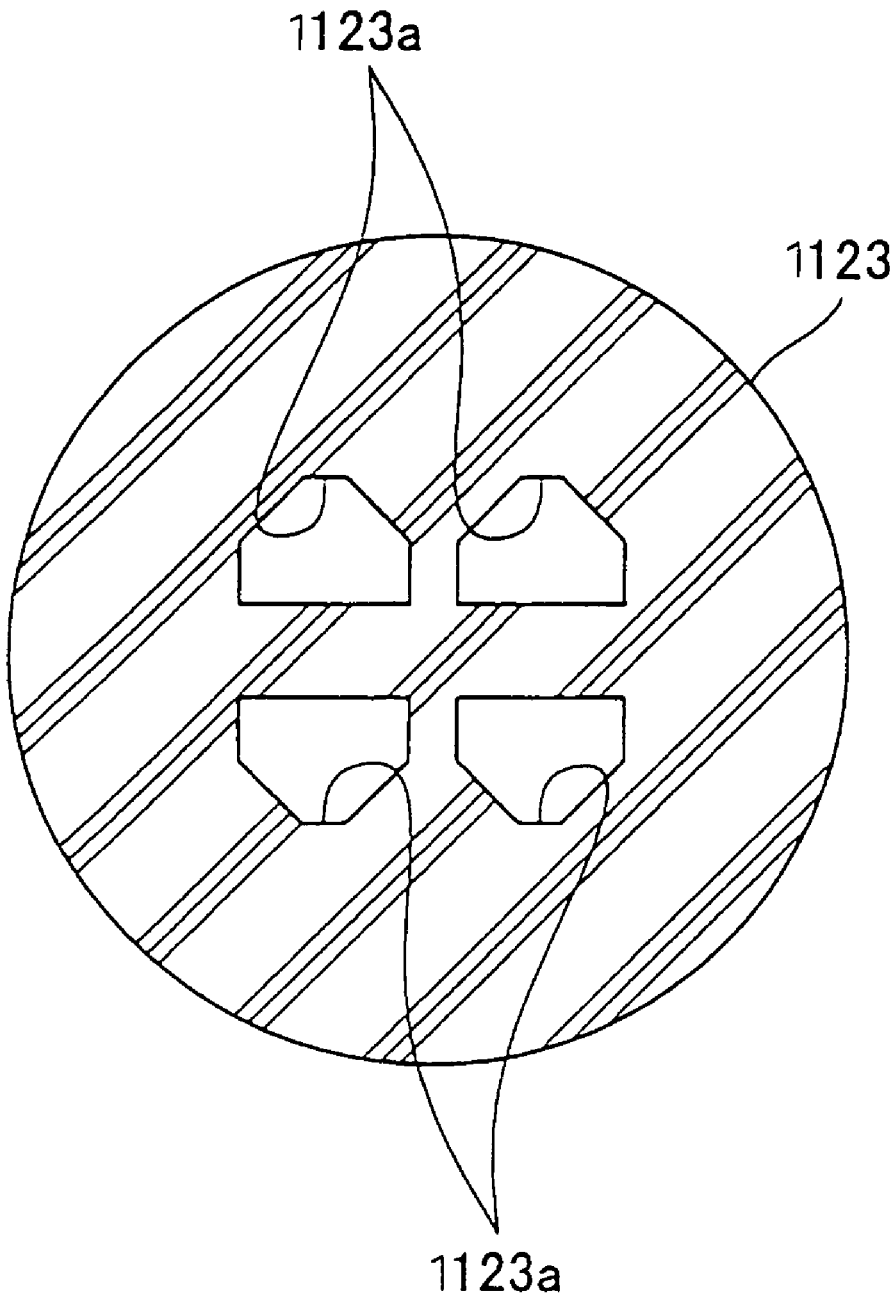
FIG. 29 is a cross-sectional view taken on line XXIX-XXIX of FIG. 27.

Referring to FIGS. 27 to 29, the wire holding portion 1123 has a generally truncated conical shape, and is continuous to the rear end of the contact holding portion 1122 via a connecting portion 1124. The wire holding portion 1123 has four wire insertion holes 123*a* formed therein (see FIG. 20C). The wire insertion holes 123*a* communicate with the respective terminal accommodating grooves 1121*b*. The wire holding portion 1123 has a tapered surface (sloping surface) 1123*b*. The connecting portion 1124 holds the male terminals 1011 with cable connecting portions 1011*c* thereof exposed (see FIG. 30).

As shown in FIGS. 18 and 19, the shield member 1013 includes a shield portion 1131 and a clamp portion 1132. The shield portion 1131 and the clamp portion 1132 are integrally made of a conductive thin metal plate. The shield portion 1131 has a hollow cylindrical shape, and is rotatably mounted on the plug-side housing 1012, for covering the same. The shield portion 1131 has a pair of positioning keys, not shown, formed therein by cutting and raising predetermined portions thereof. The pair of positioning keys are arranged to be point-symmetric with respect to the center of the shield portion 1131, and are retracted inward of the shield portion 1131. The pair of positioning keys are inserted into the positioning key grooves 1122*a* of the plug-side housing 1012. When the positioning keys are inserted into the positioning key grooves 1122*a*, the rotation of the shield portion 1131 with respect to the plug-side housing 1012 is blocked, whereby the orientation of the clamp portion 1132 with respect to the plug-side housing 1012 is held fixed. Further, when the positioning keys are inserted into the positioning key grooves 1122*a*, the plug-side housing 1012 is blocked from moving within the shield portion 1131 in the fitting direction toward the mating connector. The shield portion 1131 has three lances 1131*b* formed in an outer peripheral surface thereof at circumferentially equally-spaced intervals. The lances 1131*b* are formed by cutting and raising portions of the shield portion 1131, and are retracted inward of the shield portion 1131. The lances 1131*b* support the side of the contact holding portion 122. When the positioning keys support the contact holding portion 1122, the plug-side housing 1012 is blocked from moving within the shield portion 1131 in the removal direction from the mating connector.

As shown in FIG. 19, the clamp portion 1132 is connected to the shield portion 1131 substantially at right angles thereto, and clamps one end of a cable 1028. In the present embodiment, the cable 1028 connected to the angle-type plug connector has a shielding wire, not shown. The shielding wire is sandwiched between a sleeve 1023 mounted on the foremost end of an outer covering 1028*a* of the cable 1028 and the clamp portion 1132. A ferrule 1024 is fitted on the outer periphery of the clamp portion 1132, and the ferrule 1024 is swaged to thereby form the sleeve 1023, the shielding wire, the clamp portion 1132, and the ferrule 1024 into a unitary member, and electrically connect the shielding wire to the shield member 1013.

The angle end bell 1015 includes a surrounding portion 1151 and a cable running portion 1152. The surrounding portion 1151 and the cable running portion 1152 are both formed of resin. The surrounding portion 1151 has a hollow cylindrical shape, and covers the shield portion 1131 except for the foremost end of the shield member 1013. The surrounding portion 1151 has three locking nails 1151*a* formed on an outer peripheral surface thereof at circumferentially equally-spaced intervals.

The cable running portion 1152 has a generally cylindrical shape, and is connected to the surrounding portion 1151. The cable running portion 1152 covers the clamp portion 1132 of the shield member 1013. The cable running portion 1152 has three locking nails 1152*a* formed on an outer peripheral surface thereof at equal intervals. A fitting protrusion 1152*b* is formed between the three locking nails 1152*a*. The fitting protrusion 1152*b* has a generally rectangular parallelepiped shape.

The barrel 1016 includes a hollow cylindrical portion 1161 and a flange portion 1162. The hollow cylindrical portion 1161 and the flange portion 1162 are both formed of resin. The hollow cylindrical portion 1161 covers the foremost end of the shield portion 1131 of the shield member 1013. The hollow cylindrical portion 1161 has three erroneous fitting-preventing key grooves (erroneous fitting-preventing portions) 1161*a* formed in an outer peripheral surface thereof at circumferentially equally-spaced intervals. The erroneous fitting-preventing key grooves 1161*a* extend in the fitting/removing direction.

The flange portion 1162 continues from the rear end of the hollow cylindrical portion 1161. The flange portion 1162 is abutted against a riser surface 1151*d* of the angle end bell 1015 via an O ring 1021. This seals the inner space of the angle end bell 1015.

The coupling nut 1018 includes a cover 1181 and a fitting portion 1182. The cover 1181 and the fitting portion 1182 are both formed of resin. The cover 1181 has a generally hollow cylindrical shape, and covers the surrounding portion 1151 of the angle end bell 1015 and the barrel 1161. The cover 1181 has three locking holes 1181*a* formed in a rear end thereof at circumferentially equally-spaced intervals. The locking holes 1181*a* receive the locking nails 1151*a* of the angle end bell 1015, for engagement with the same. Further, a cutout 1181*d* is formed in the rear end of the cover 1181. The cutout 1181*d* is provided for inhibiting the coupling nut 1018 from being brought into contact with the angle end bell 1015. Further, the cutout 1181*d* enables the rear end of the cover 1181 to radially expand and shrink. Therefore, when the coupling nut 1018 is mounted on the angle end bell 1015 along the fitting/removing direction, the rear end of the cover 1181 climbs over the locking nails 1151*a*, and the locking nails 1151*a* of the angle end bell 1015 are inserted into the locking holes 1181*a*. As a result, the coupling nut 1018 is locked to the angle end bell 1015.

The cover 1181 has a front end formed with a pair of locking pieces 1181*b*. The pair of locking pieces 1181*b* are arranged to be point-symmetric with respect to the center of the cover 1181. The locking pieces 1181*b* can be deformed in the radial direction of the cover 1181, and each have a hole 1181*c*. The holes 1181*c* receive locking nails of the receptacle connector, not shown. At this time, the locking pieces 1181*b* and the locking nails are engaged with each other.

The fitting portion 1182 is connected to the cover 1181 substantially at right angles thereto. The fitting portion 1182 has a back surface formed with a fitting recess 1182*a* (see FIG. 19). The fitting recess 1182*a* is fitted on the fitting protrusion 1152*b* of the angle end bell 1015.

The gland nut 1019 has a bottomed hollow cylindrical shape, and is formed of resin. The gland nut 1019 is generally key-hole shaped in transverse cross-section, and has a rear portion thereof formed with three locking holes 1191*a*. The three locking holes 1191*a* receive the locking nails 1152*a* of the angle end bell 1015. Since the rear portion of the gland nut 1019 is capable of expanding and shrinking in a radial direction thereof, the three locking holes 1191*a* are engaged with the locking nails 1152*a* in the radial direction of the rear portion of the gland nut 1019.

The gland nut 1019 has a front portion formed with a locking hole 1192*a*. The locking hole 1192*a* receives a locking nail 1182*b* of the coupling nut 1018. Since the upper end of the gland nut 1019 is capable of bending, the locking hole 1192*a* can be engaged with the locking nail 1182*b* in the radial direction of the gland nut 1019.

Next, a cable connecting procedure for the connector body of the angle-type plug connector according to the present embodiment will be described with reference to FIGS. 30 to 36.

Figure 30:
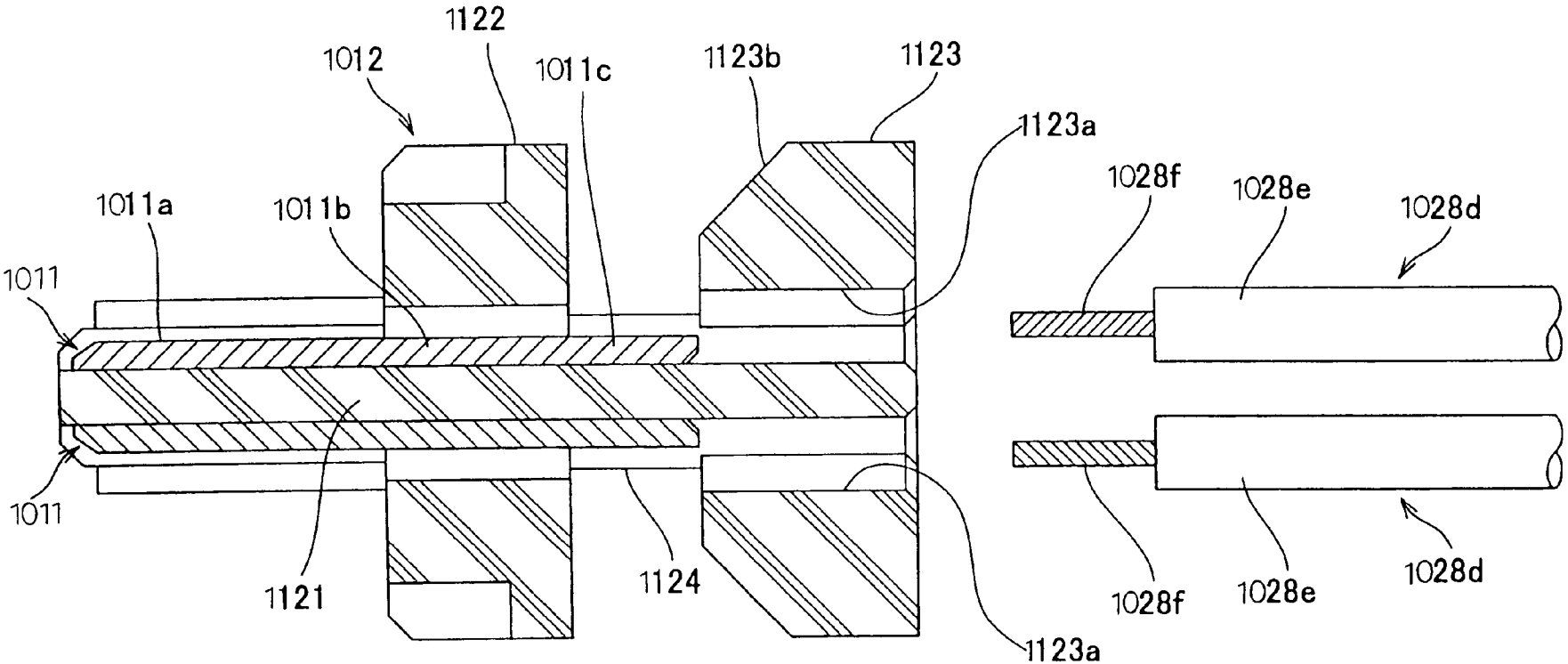
FIG. 30 is a cross-sectional view of the connector body shown in FIGS. 20A to 20D and cables in a state before the cables are soldered to male terminals of the connector body.

First, as shown in FIG. 30, a covering 1028*e* of the leading end of each cable 1028*d* is removed in advance to expose a cable conductor 1028*f*. Further, the cable conductor 1028*f* is subjected to preliminary soldering in advance.

Figure 31:
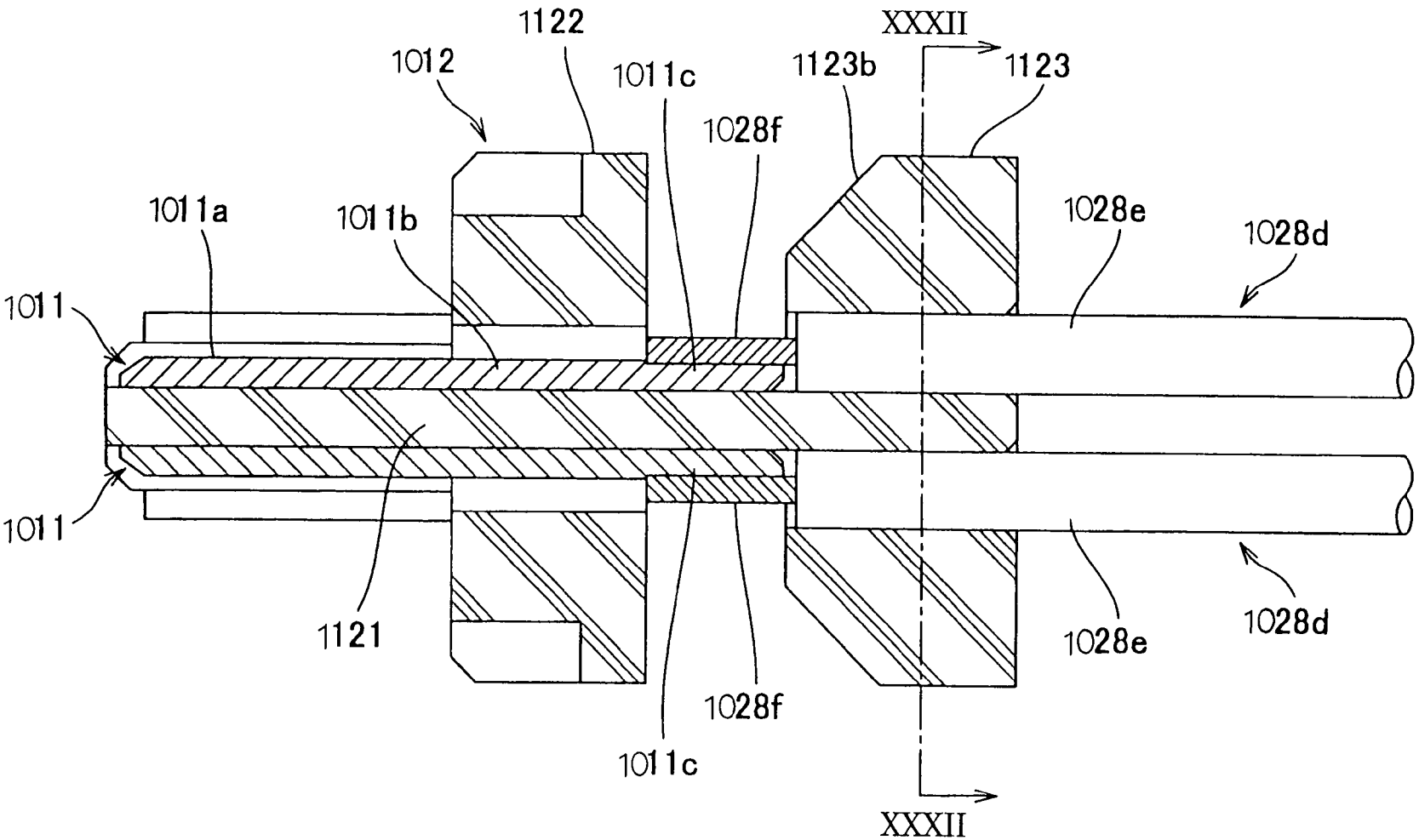
FIG. 31 is a cross-sectional view of the connector body shown in FIG. 30 in a state in which the cables are inserted into wire insertion holes of a plug-side housing of the connector body.
Figure 32:
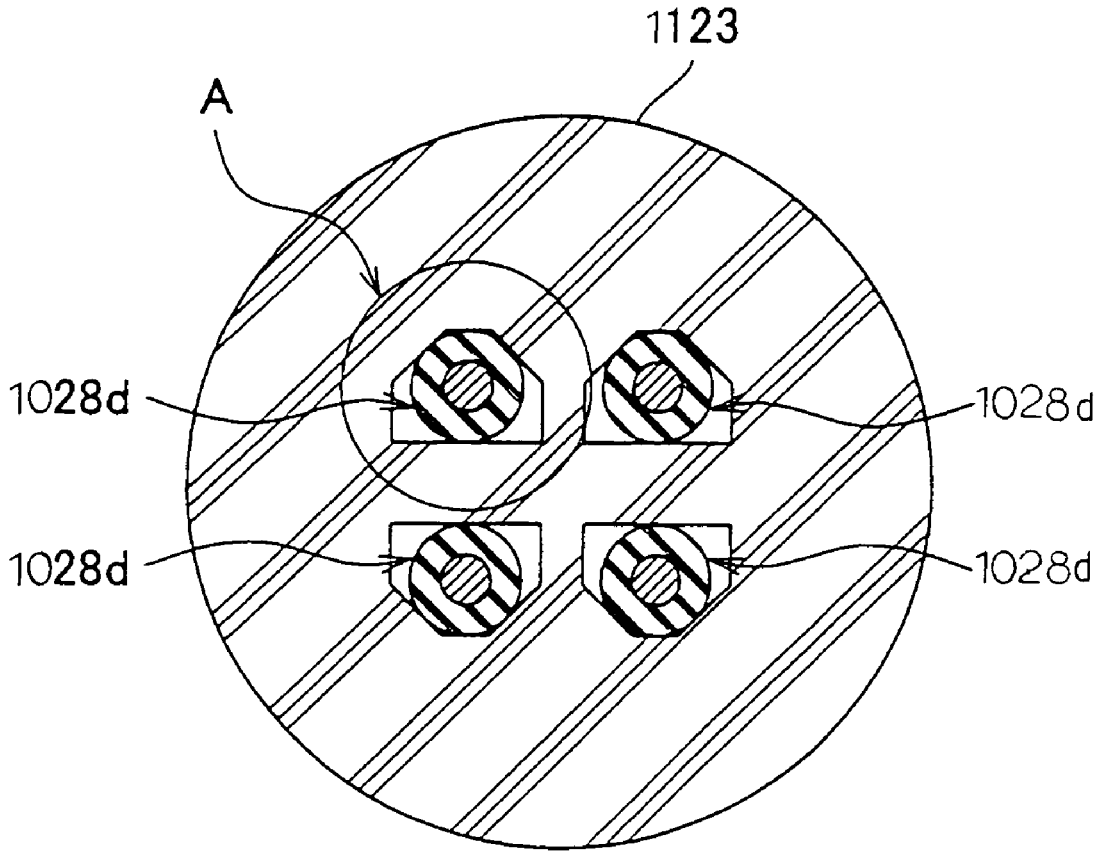
FIG. 32 is a cross-sectional view taken on line XXII-XXII of FIG. 31.
Figure 33:
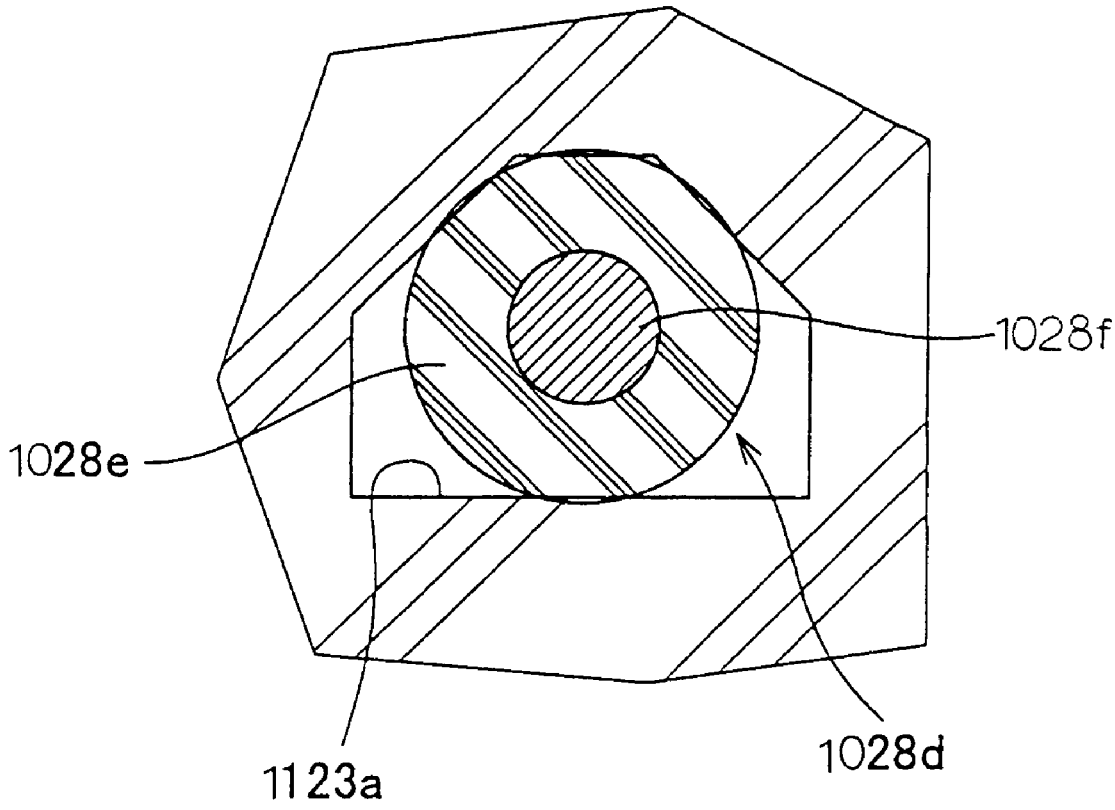
FIG. 33 is an enlarged view of part A appearing in FIG. 32.

Then, as shown in FIG. 31, the cables 1028*d* are inserted into wire insertion holes 1123*a* of the wire holding portion 1123 of the plug-side housing 1012. At this time, as shown in FIGS. 32 and 33, portions of the respective coverings 1028*e* of the cables 1028*d* are lightly press-fitted into the wire insertion holes 1123*a*. Further as shown in FIG. 31, the cable conductors 1028*f* are automatically arranged on the cable connecting portions 1011*c* of the respective male terminals 1011. Moreover, the cable conductors 1028*f* are accurately positioned by the recesses 1011*d* of the cable connecting portions 1011*c*.

Figure 34:
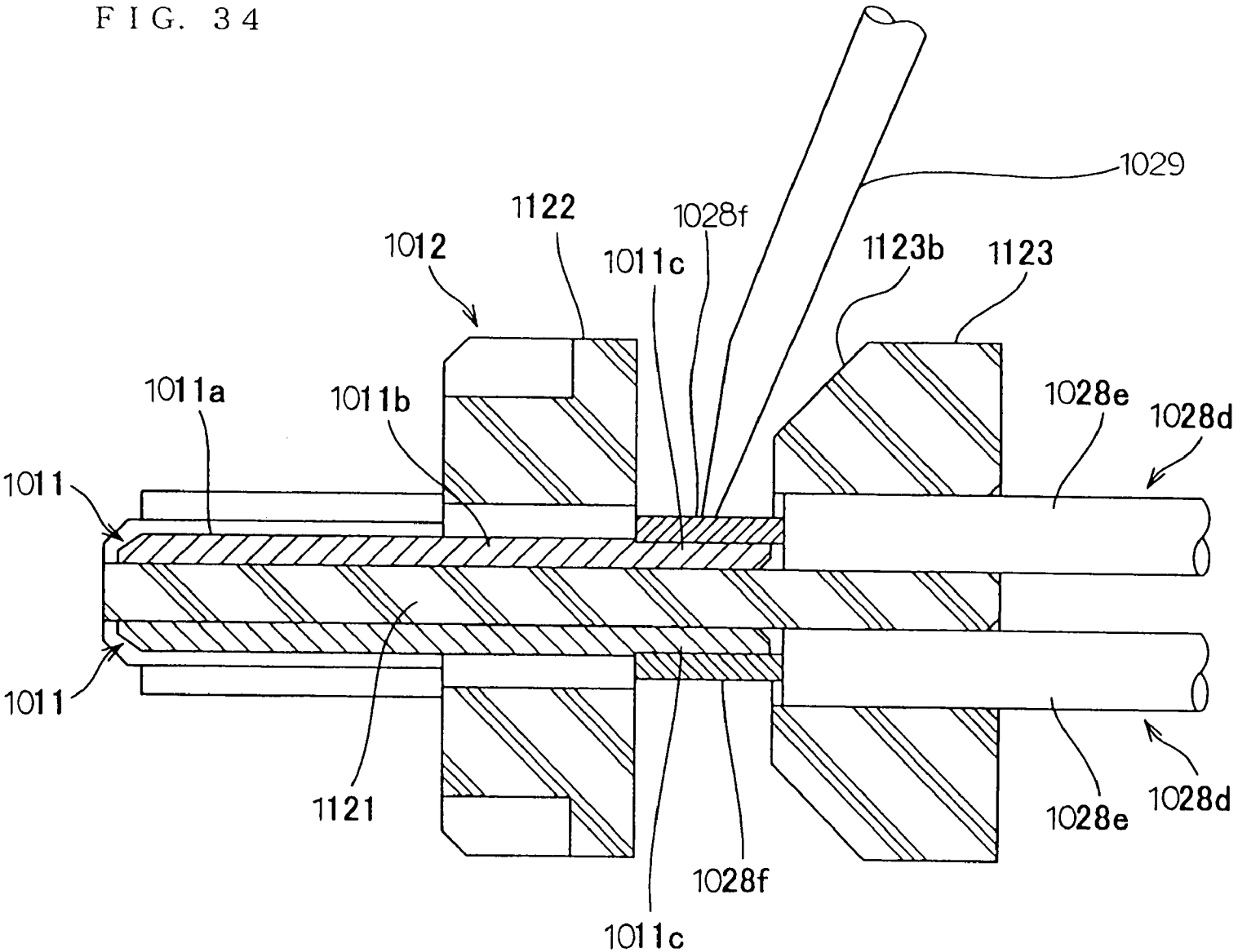
FIG. 34 is a cross-sectional view of the connector body shown in FIG. 31 in a state in which a cable conductor is being soldered to a male terminal of the connector body.

After that, as shown in FIG. 34, a soldering iron 1029 is pressed against the cable conductors 1028*f* to solder the cable conductors 1028*f* to the cable connecting portions 1011*c*. At this time, melted solder is stored in the recesses 1011*d*, and hence there is no fear of the solder leaking from the recesses 1011*d*. Further, the wire holding portion 1123 is formed with the tapered surface 1123*b*, which increases an area in where the soldering iron 1029 can be moved.

Figure 35:
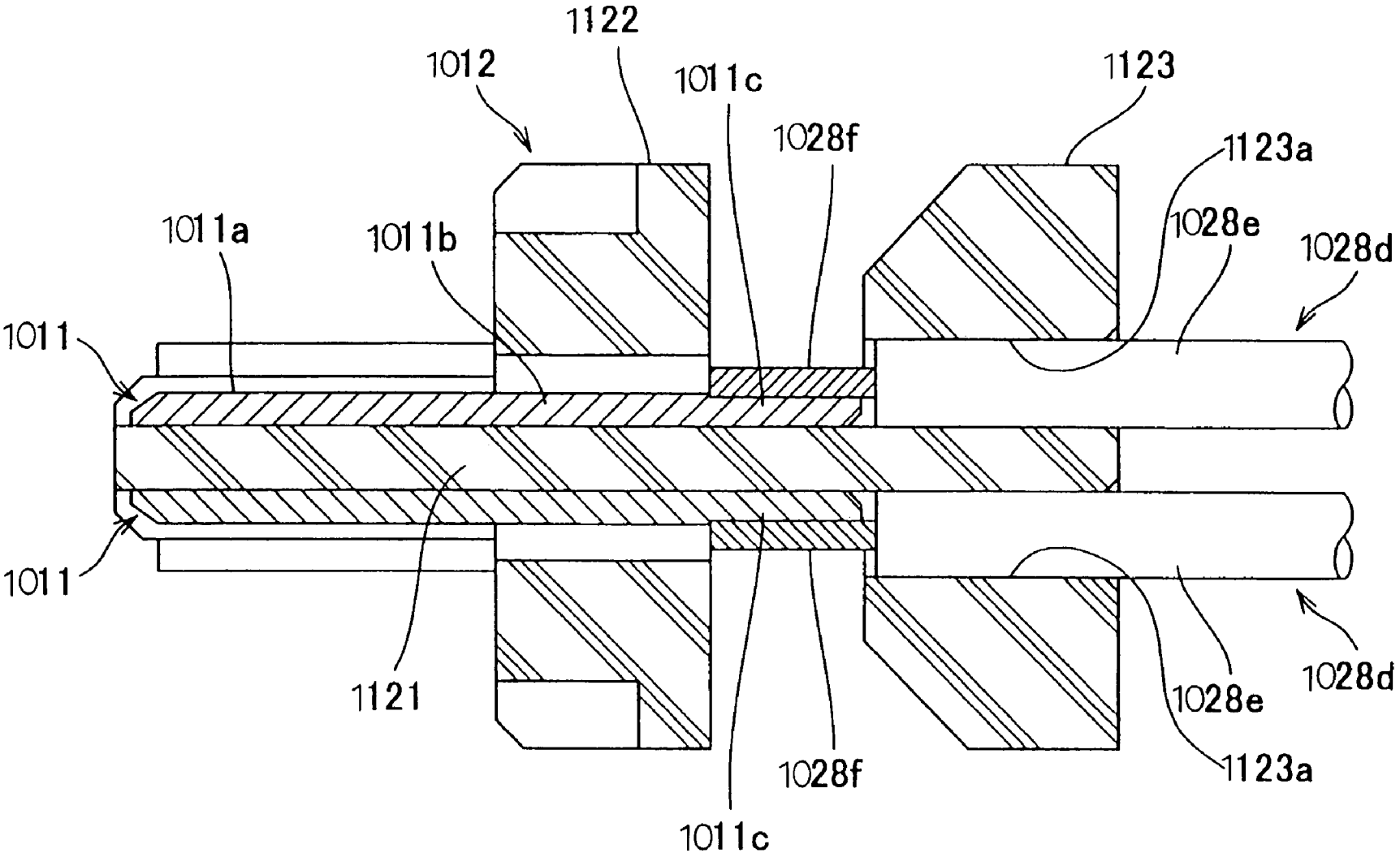
FIG. 35 is a cross-sectional view of the connector body shown in FIG. 34 in a state in which the cable conductors have been soldered to the male terminals of the connector body.

By carrying out the steps described above, connection of the cables 1028*d* to the male terminals 1011 is completed as shown in FIG. 35.

Figure 36:
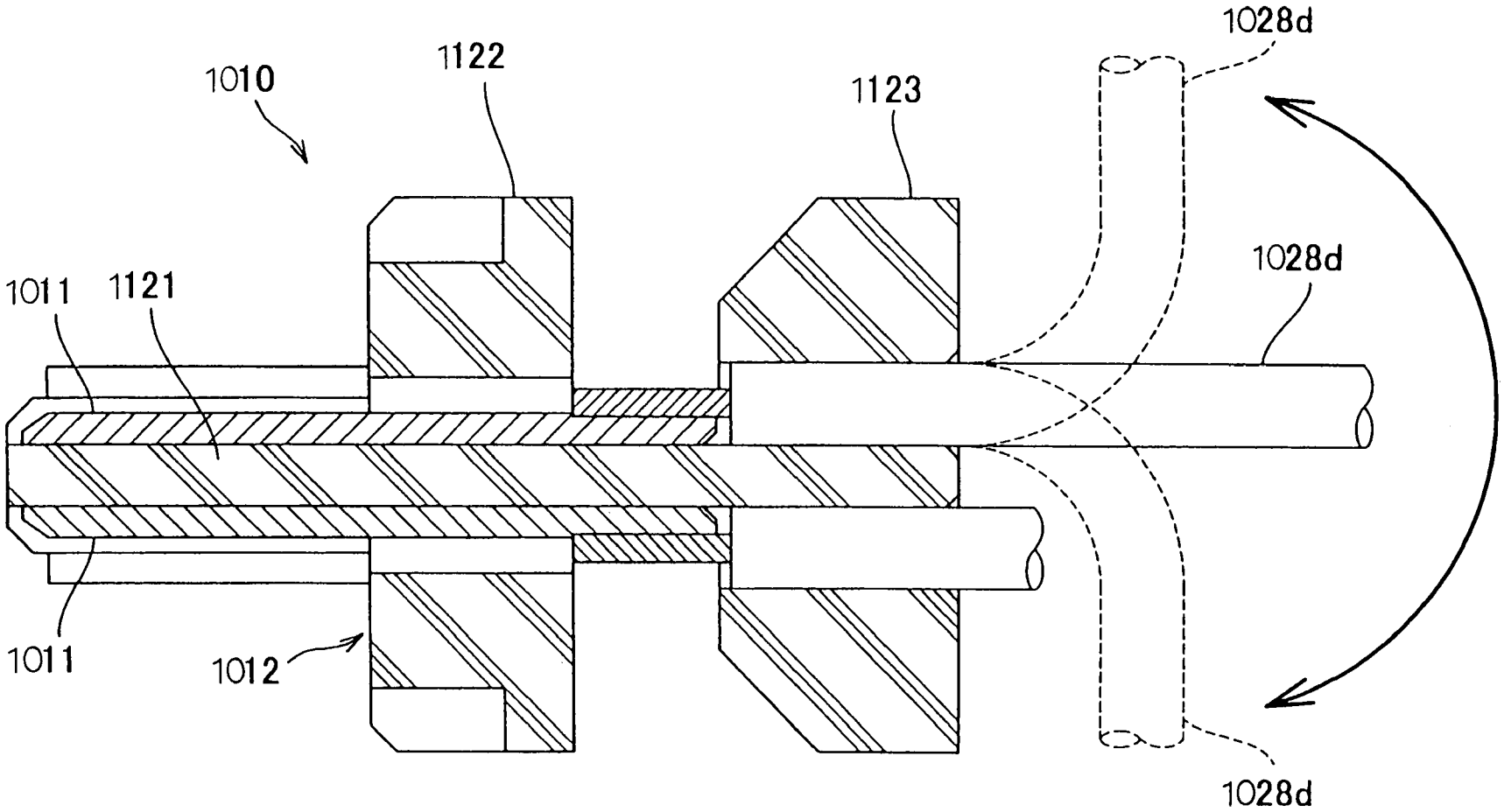
FIG. 36 is a cross-sectional view of the connector body shown in FIG. 35 in a state in which one of the cables inserted into the connector body is bent.

As shown in FIG. 36, after completion of the cable connection of the cables 1028*d*, in whichever direction the cables 1028*d* may be drawn out, the leading ends of the cables 1028*d* are positively held by the wire holding portion 1123.

According to the present embodiment, since the leading ends of the cables 1028*d* are held by the wire holding portion 1123, it is possible to easily solder the cables 1028*d* to the cable connecting portions 1011*c* of the male terminals 1011 without applying any stress to the cable connecting portions.

Further, since the terminal holding portion 1121, the contact holding portion 1122, and the wire holding portion 1123 are integrally formed with each other, it is possible to reduce the number of component parts, thereby making it possible to reduce manufacturing costs of the angle-type plug connector.

Furthermore, since the recesses 1011*d* are formed in the cable connecting portions 1011*c*, the soldering positions of the cable conductors 1028*f* are set to substantially the same locations in the respective male terminals 1011, which facilitates impedance matching.

Further, the tapered surface 1123*b* is formed on the wire holding portion 1123, and therefore the space between the contact holding portion 1122 and the wire holding portion 1123 is large, which facilitates a soldering operation using the soldering iron.

Next, a receptacle connector according to a third embodiment of the present invention will be described with reference to the drawings.

Figure 37A:
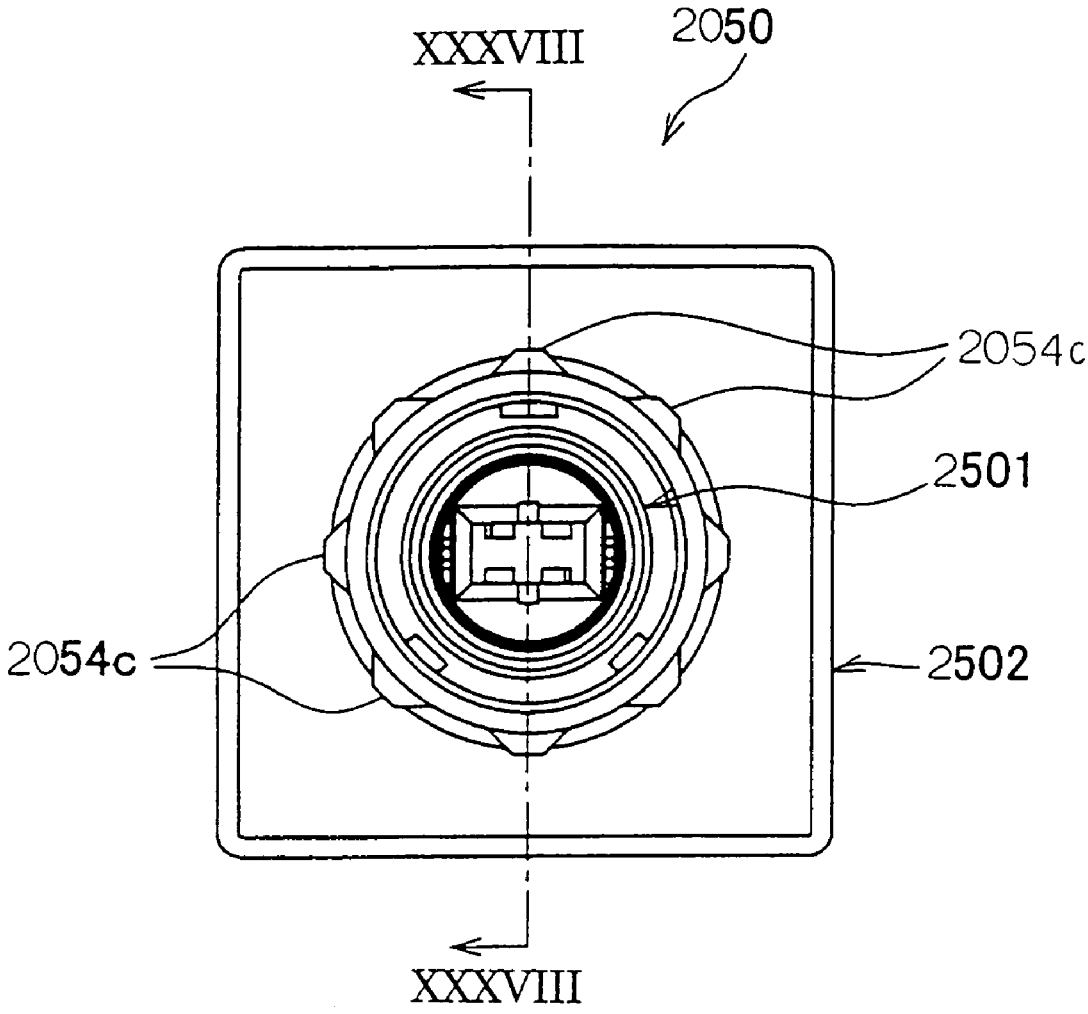
FIG. 37A is a front view of a receptacle connector according to a second embodiment of the present invention.
Figure 37B:
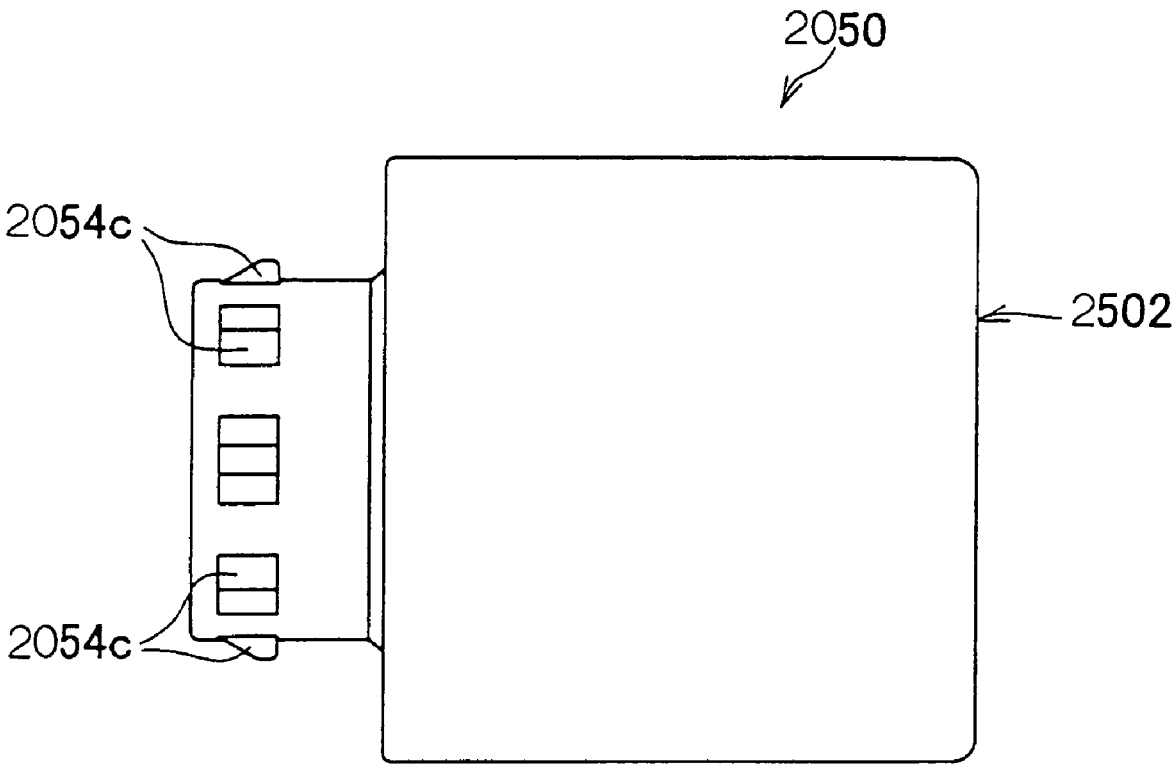
FIG. 37B is a side view of the receptacle connector.
Figure 37C:
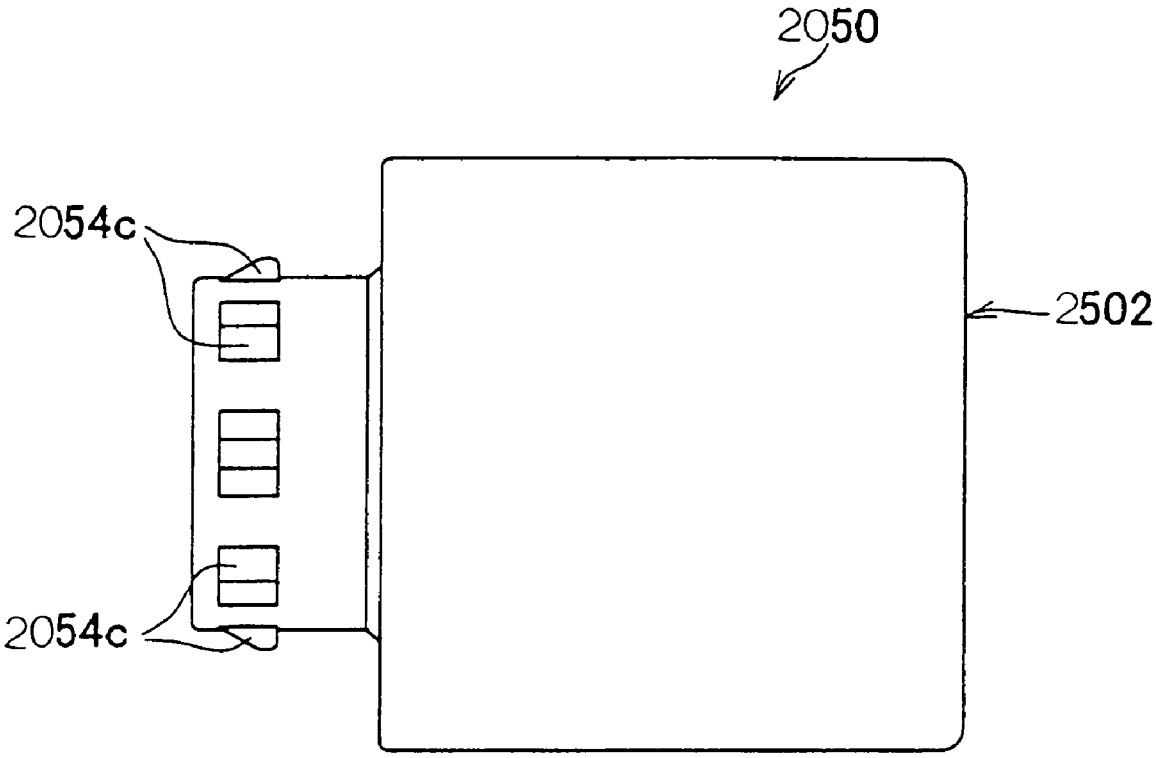
FIG. 37C is a bottom view of the receptacle connector.

Referring to FIGS. 37A and 37C, the receptacle connector 2050 according to the third embodiment is comprised of a connector body 2501, and a casing 2502.

Figure 38:
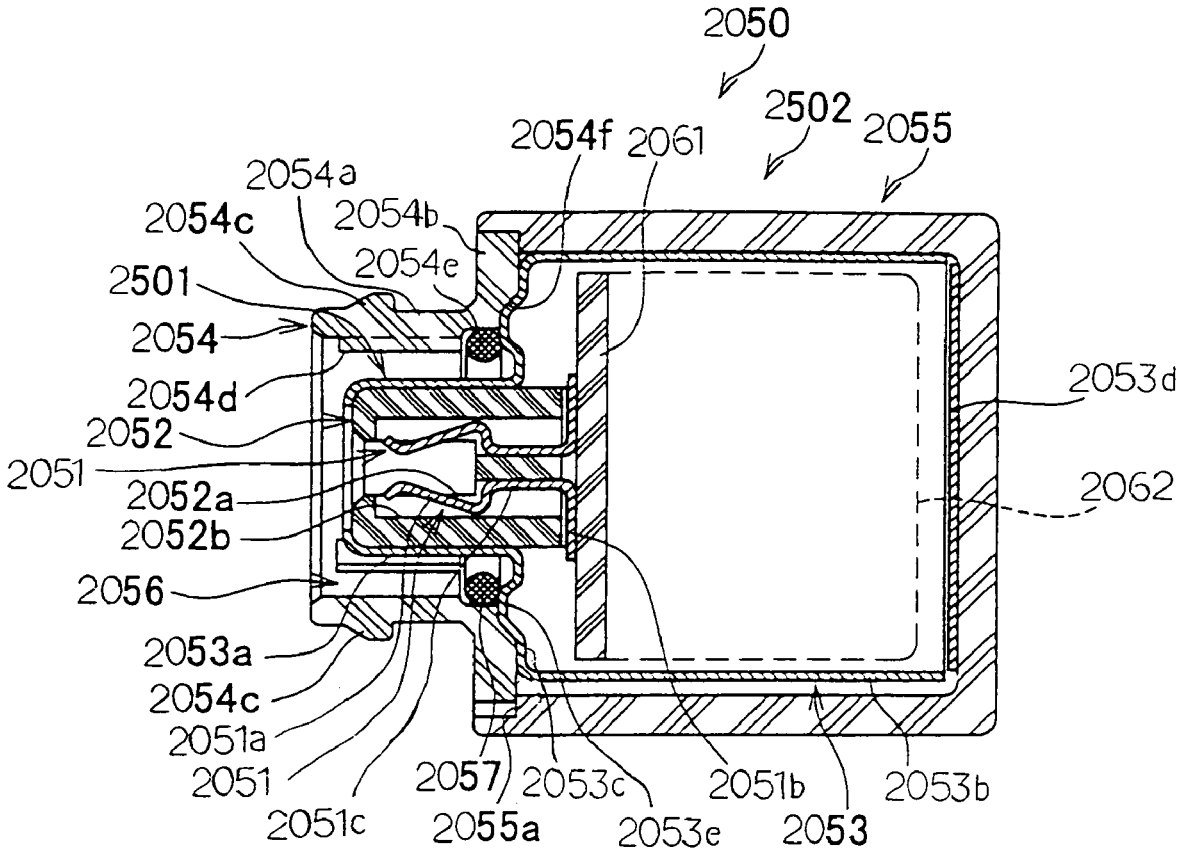
FIG. 38 is a cross-sectional view taken on line XXXVIII-XXXVIII of FIG. 37A.
Figure 40:
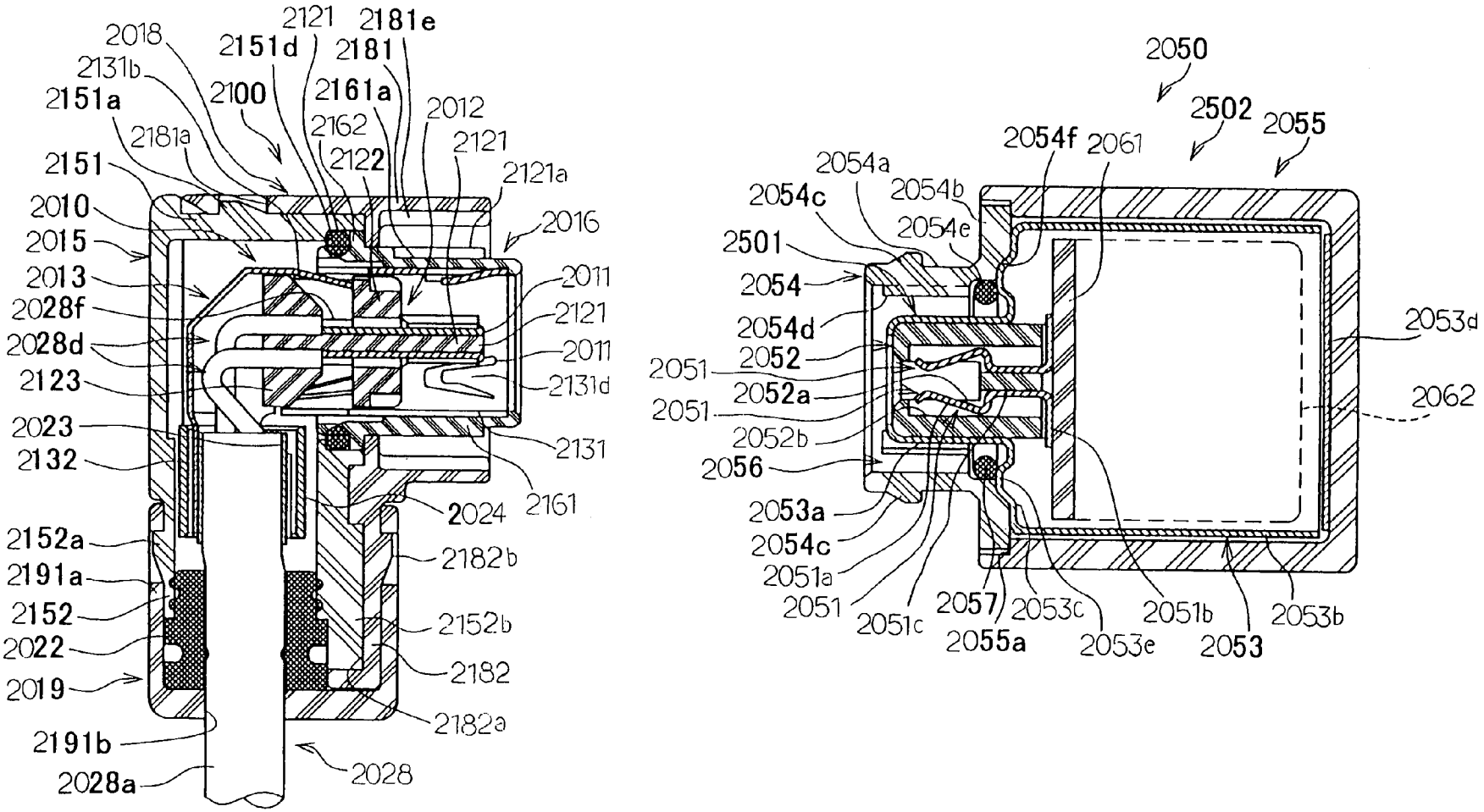
FIG. 40 is a cross-sectional view of the receptacle connector shown in FIGS. 37A to 37C and the plug connector shown in FIGS. 39A to 39C, in a state before the former is connected to the latter.

As shown in FIGS. 38 and 40, the connector body 2501 is comprised of female terminals (contacts) 2051, a housing 2052, and a gland shell 2053.

Each female terminal 2051 includes a contact portion 2051*a*, a terminal section 2051*b*, and a connecting portion 2051*c*. The contact portion 2051*a* is brought into contact with an associated one of male terminals 2011 of a plug connector 2100 described hereinafter. The terminal section 2051*b* is soldered to a conductive path, not shown, of a printed circuit board 2061. The connecting portion 2051*c* connects between the contact portion 2051*a* and the terminal section 2051*b*.

The housing 2052 has a generally hollow cylindrical shape, and includes a receiving portion 2052*a* and terminal accommodating portions 2052*b*. The receiving portion 2052*a* receives the terminal holding portion 2121 of a plug-side housing 2012 of the plug connector 2100, together with the male terminals 2011. The terminal accommodating portions 2052*b* accommodate the female terminals 2051, and each have one end thereof communicating with the receiving portion 2052*a*. Part of the housing 2052, except for the rear-side portion thereof, corresponds to a fitting portion of the connector body 2501.

The gland shell 2053 includes a cover 2053*a*, an accommodating portion 2053*b*, a connecting portion 2053*c*, and a lid 2053*d*. The cover 2053*a*, the accommodating portion 2053*b*, the connecting portion 2053*c*, and the lid 2053*d* are made of conductive thin metal plates. The cover 2053*a* has a hollow cylindrical shape, and covers an outer peripheral surface of the housing 2052. The accommodating portion 2053*b* has a hollow cylindrical shape, and accommodates the printed circuit board 2061, a CCD 2062 mounted on the printed circuit board 2061, and so forth. The connecting portion 2053*c* connects between the cover 2053*a* and the accommodating portion 2053*b*. The connecting portion 2053*c* is formed with an annular protrusion (positioning portion) 2053*e*. The annular protrusion 2053*e* protrudes toward the cover 2053*a*. The central axis of the annular protrusion 2053*e* and that of the cover 2053*a* are coincident with each other. The annular protrusion 2053*e* has a tapered outer peripheral surface. The lid 2053*d* is connected to the accommodating portion 2053*b*, for closing the opening of the accommodating portion 2053*b*. Part of the gland shell 2053, except for the front end thereof, corresponds to the rear-side portion of the connector body 2501.

The casing 2502 is formed by a shell (front-side casing portion) 2054 and a casing body (rear-side casing portion) 2055.

The shell 2054 includes a hollow cylindrical portion 2054*a* and a flange portion 2054*b*. The hollow cylindrical portion 2054*a* and the flange portion 2054*b* are integrally formed of resin. The hollow cylindrical portion 2054*a* surrounds the cover 2053*a* of the gland shell 2053. Formed between the hollow cylindrical portion 2054*a* and the cover 2053*a* is an annular space (space) 2056. The hollow cylindrical portion 2054*a* has eight locking nails 2054*c* formed on an outer peripheral surface thereof at circumferentially equally-spaced intervals. Further, the hollow cylindrical portion 2054*a* has three main fitting keys 2054*d* formed in an inner peripheral surface thereof at circumferentially equally-spaced intervals. The main fitting keys 2054*d* are inserted into the erroneous fitting-preventing key grooves 2161*a* of the barrel 2016 of the plug connector 2100, respectively. The hollow cylindrical portion 2054*a* has an annular cutout 2054*e* formed in a peripheral surface of a rear portion thereof. An O ring 2057 is disposed in the annular cutout 2054*e*.

The flange portion 2054*b* has a back surface formed with an annular recess (positioned portion) 2054*f*. The annular recess 2054*f* is recessed toward the hollow cylindrical portion 2054*a*. The central axis of the annular recess 2054*f* and that of the hollow cylindrical portion 2054*a* are coincident with each other. The annular recess 2054*f* has a tapered inner peripheral surface. The annular recess 2054*f* is engaged with the annular protrusion 2053*e* of the gland shell 2053.

The casing body 2055 has a bottomed hollow prismatic shape, and accommodates the printed circuit board 2061, the CCD 2062, and so forth. The casing body 2055 has a foremost end formed with a riser surface 2055*a*. The inner diameter of the foremost end is larger than the outer diameter of the flange portion 2054*b* (see FIG. 40). Before the flange portion 2054*b* is fixed to the riser surface 2055*a* of the casing body 2055, the shell 2054 can be moved in a direction orthogonal to the fitting direction (vertical direction as viewed in FIG. 38 showing the casing body 2055), with respect to the casing body 2055.

Figure 39A:
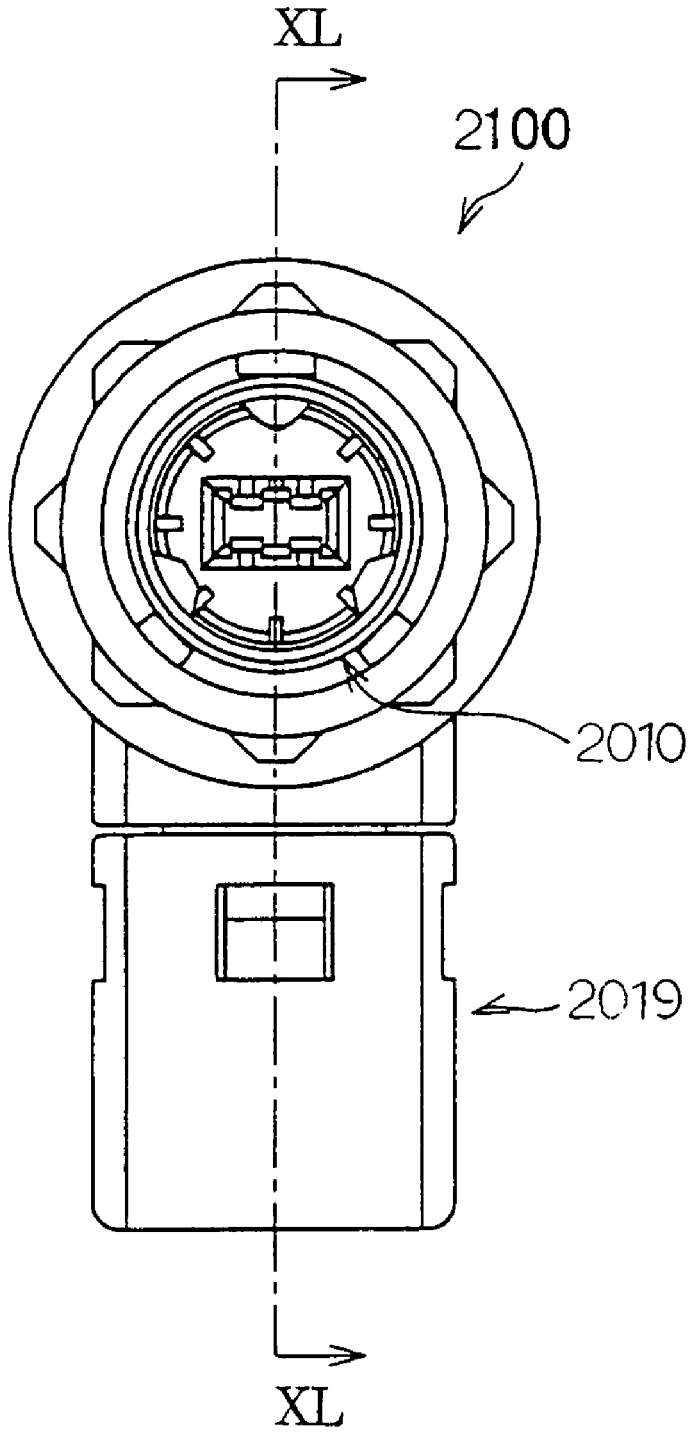
FIG. 39A is a front view of a plug connector connected to the receptacle connector shown in FIGS. 37A to 37C.
Figure 39B:
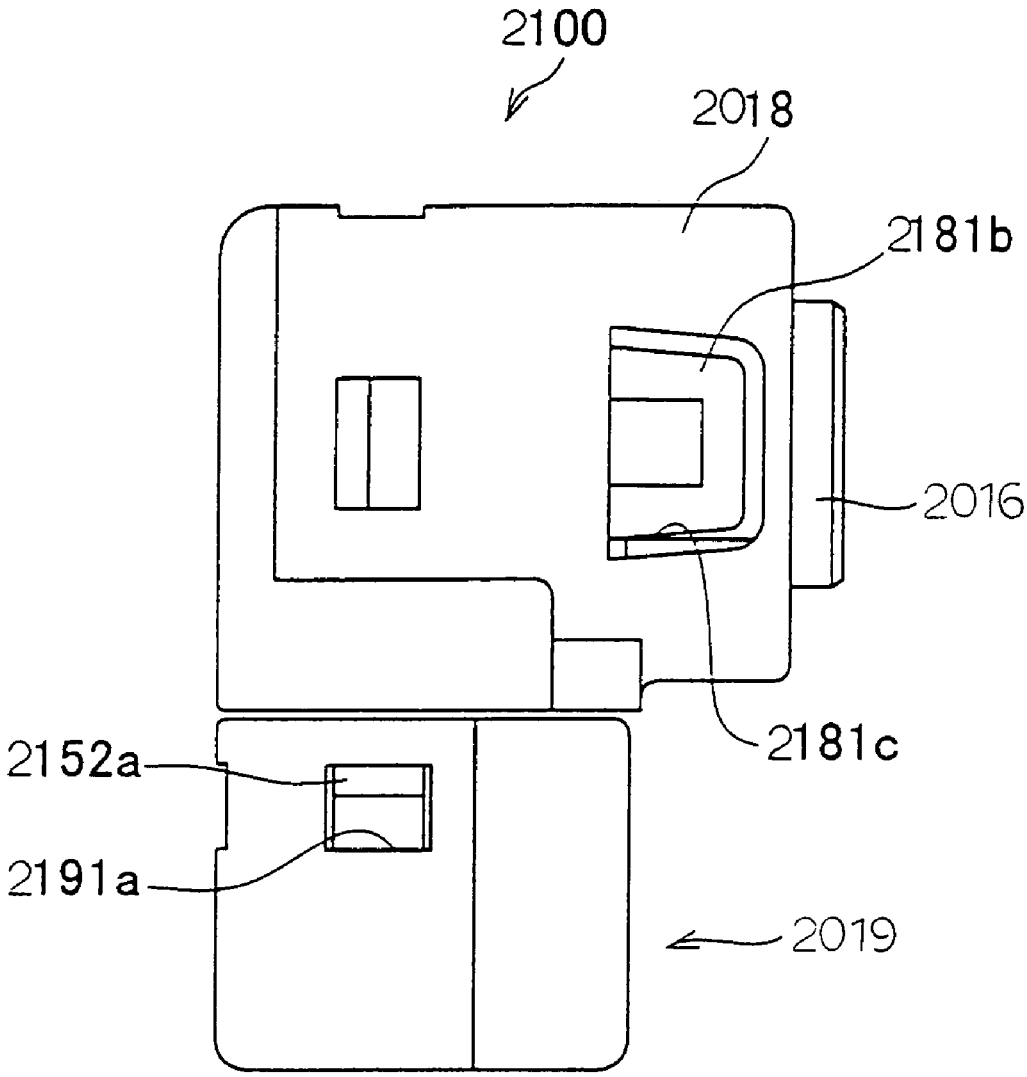
FIG. 39B is a side view of the plug connector.
Figure 39C:
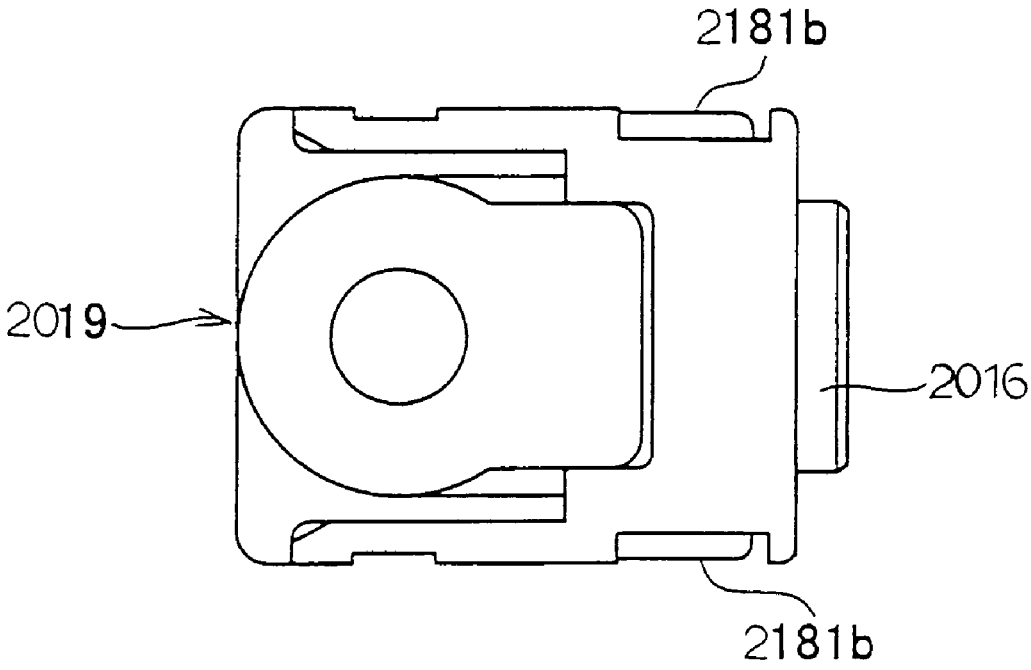
FIG. 39C is a bottom view of the plug connector.

As shown in FIGS. 39A to 40, the plug connector 2100, which is a mating connector associated with the receptacle connector 2050, is an angle-type plug connector. The plug connector 2100 is comprised of a connector body 2010, an angle end bell 2015, a barrel 2016, a coupling nut 2018, and a gland nut 2019.

The connector body 2010 includes male terminals 2011, a plug-side housing 2012, and a shield member 2013.

The male terminals 2011 are each formed by blanking a thin metal plate such that it has a generally plate-like shape. The male terminals 2011 are brought into contact with the respective female terminals 2051 of the receptacle connector 2050. To the male terminals 2011 are connected cable conductors 2028*f* of electrical wires 2028*d* of a cable 2028.

The plug-side housing 2012 includes a terminal holding portion 2121, an engaging portion 2122, and a wire holding portion 2123. The terminal holding portion 2121, the engaging portion 2122, and the wire holding portion 2123 are integrally formed of resin.

The terminal holding portion 2121 is generally prism-shaped. The terminal holding portion 2121 holds the male terminals 2011. The terminal holding portion 2121 has an upper surface formed with a positioning keys 2121*a*.

The engaging portion 2122 is generally disk-shaped. The terminal holding portion 2121 extends through a central portion of the engaging portion 2122. The engaging portion 2122 is engaged with a shield portion 2131 of the shield member 2013, referred to hereinafter.

The wire holding portion 2123 has a generally truncated conical shape, and continues from the rear end of the terminal holding portion 2121. The wire holding portion 2123 holds the electrical wires 2028*d* of the cable 2028.

The shield member 2013 includes a shield portion 2131 and a clamp portion 2132. The shield portion 2131 and the clamp portion 2132 are integrally made of a thin metal plate. The shield portion 2131 has a hollow cylindrical shape, and is mounted on the plug-side housing 2012 to cover the same. The shield portion 2131 has three lances 2131*b* formed in an outer peripheral surface thereof at circumferentially equally-spaced intervals. The lances 2131*b* are formed by cutting and raising portions of the shield portion 2131 and are retracted inward of the shield portion 2131. The lances 2131*b* support a surface of the engaging portion 2122 toward the wire holding portion 2123.

The clamp portion 2132 is connected to the shield portion 2131 substantially at right angles thereto, and clamps one end of the cable 2028. The cable 2028 has a shielding wire, not shown. The shielding wire is sandwiched between a sleeve 2023 mounted on the foremost end of an outer covering 2028*a* of the cable 2028 and the clamp portion 2132. A ferrule 2024 is fitted on the outer periphery of the clamp portion 2132, and the ferrule 2024 is swaged to thereby form the sleeve 2023, the shielding wire, the clamp portion 2132, and the ferrule 2024 into a unitary member and electrically connect the shielding wire to the shield member 2013.

The angle end bell 2015 includes a surrounding portion 2151 and a cable running portion 2152. The surrounding portion 2151 and the cable running portion 2152 are integrally formed of resin. The surrounding portion 2151 has a hollow cylindrical shape, and covers the shield member 2013 except for the foremost end of the shield portion 2131. The surrounding portion 2151 has three locking nails 2151*a* formed on an outer peripheral surface thereof at circumferentially equally-spaced intervals.

The cable running portion 2152 has a generally cylindrical shape, and continues from the surrounding portion 2151. The cable running portion 2152 covers the clamp portion 2132 of the shield member 2013. The cable running portion 2152 has three locking nails 2152*a* formed on an outer peripheral surface thereof at equal intervals. A fitting protrusion 2152*b* is formed between the three locking nails 2152*a*. The fitting protrusion 2152*b* has a generally rectangular parallelepiped shape.

The barrel 2016 includes a hollow cylindrical portion 2161 and a flange portion 2162. The hollow cylindrical portion 2161 and the flange portion 2162 are integrally formed of resin. The hollow cylindrical portion 2161 covers the foremost end of the shield portion 2131 of the shield member 2013. The hollow cylindrical portion 2161 has three erroneous fitting-preventing key grooves 2161*a* formed in an outer peripheral surface thereof at circumferentially equally-spaced intervals. The erroneous fitting-preventing key grooves 2161*a* extend in the fitting/removing direction.

The flange portion 2162 is connected to the rear end of the hollow cylindrical portion 2161. The flange portion 2162 is abutted against a riser surface 2151*d* of the angle end bell 2015 via an O ring 2021, whereby the inner space of the angle end bell 2015 is sealed.

The coupling nut 2018 includes a cover 2181 and a fitting portion 2182. The cover 2181 and the fitting portion 2182 are integrally formed of resin. The cover 2181 has a generally hollow cylindrical shape, and covers the surrounding portion 2151 of the angle end bell 2015 and the barrel 2161. The cover 2181 has three locking holes 2181*a* formed in a rear end thereof at circumferentially equally-spaced intervals. The locking holes 2181*a* receive the locking nails 2151*a* of the angle end bell 2015, for engagement with the same. Further, a cutout, not shown, is formed in the rear end of the cover 2181. The cutout is provided for inhibiting the coupling nut 2018 from being brought into contact with the angle end bell 2015. The locking nails 2151*a* of the angle end bell 2015 are inserted into the locking holes 2181*a*, whereby the coupling nut 2018 is locked to the angle end bell 2015.

The cover 2181 has a front end formed with a pair of locking pieces 2181*b* (see FIG. 39). The pair of locking pieces 2181*b* are arranged to be point-symmetric with respect to the center of the cover 2181. The locking pieces 2181*b* can be deformed in the radial direction of the cover 2181, and each have a hole 2181*c*. The holes 2181*c* receive the locking nails 2054*c* of the receptacle connector 2050. At this time, the locking pieces 2181*b* and the locking nails are engaged with each other.

The fitting portion 2182 is connected to the cover 2181 substantially at right angles thereto. The fitting portion 2182 has a back surface formed with a fitting recess 2182*a*. The fitting recess 2182*a* is fitted on the fitting protrusion 2152*b* of the angle end bell 2015.

The gland nut 2019 has a bottomed hollow cylindrical shape, and is formed of resin. The gland nut 2019 is generally key-hole shaped in transverse cross-section, and has a rear portion thereof formed with three locking holes 2191*a*. The three locking holes 2191*a* receive the locking nails 2152*a* of the angle end bell 2015.

The gland nut 2019 has a front portion formed with a locking hole 2192*a*. The locking hole 2192*a* receives a locking nail 2182*b* of the coupling nut 2018.

Next, a description will be given of a procedure of assembling the receptacle connector 2050.

Referring to FIG. 38, first, the terminal sections 2051*b* of the female terminals 2051 held by the housing 2052 are soldered on one surface of the printed circuit board 2061, and the CCD 2062 is mounted on the other surface of the printed circuit board 2061.

Then, the housing 2052 is inserted into the cover 2053*a* of the gland shell 2053, and the printed circuit board 2061 and the CCD 2062 are received in the accommodating portion 2053*b*. After that, the lid 2053*d* is closed.

Subsequently, the gland shell 2053 is received in the casing body 2055, and the optical axis of the CCD 2062 and the optical axes of a hole, a lens, and so forth, none of which are shown, provided in the casing body 2055 are aligned with each other. After completion of the alignment of the optical axes, the gland shell 2053 is screwed into the casing body 2055, and is fixed e.g. by an adhesive.

Then, the shell 2054 is disposed on the riser surface 2055*a* of the casing body 2055. At this time, the annular protrusion 2053*e* of the gland shell 2053 and the annular recess 2054*f* of the shell 2054 are engaged with each other. Since the outer peripheral surface of the annular protrusion 2053*e* and the inner peripheral surface of the annular recess 2054*f* are tapered, respectively, the shell 2054 is positioned such that it becomes coaxial with the cover 2053*a*.

After the shell 2054 is positioned by engagement of the annular protrusion 2053*e* and the annular recess 2054*f*, the shell 2054 is rigidly fixed to the casing body 2055 by fixation means, such as screws.

Next, a description will be given of operation for connecting the plug connector 2100 to the receptacle connector 2050.

Referring to FIG. 40, the main fitting keys 2054*d* of the receptacle connector 2050 and the erroneous fitting-preventing key grooves 2161*a* of the plug connector 2100 are arranged in a manner opposed to each other, and the plug connector 2100 is pushed straight into the receptacle connector 2050 along the fitting direction.

Figure 41:
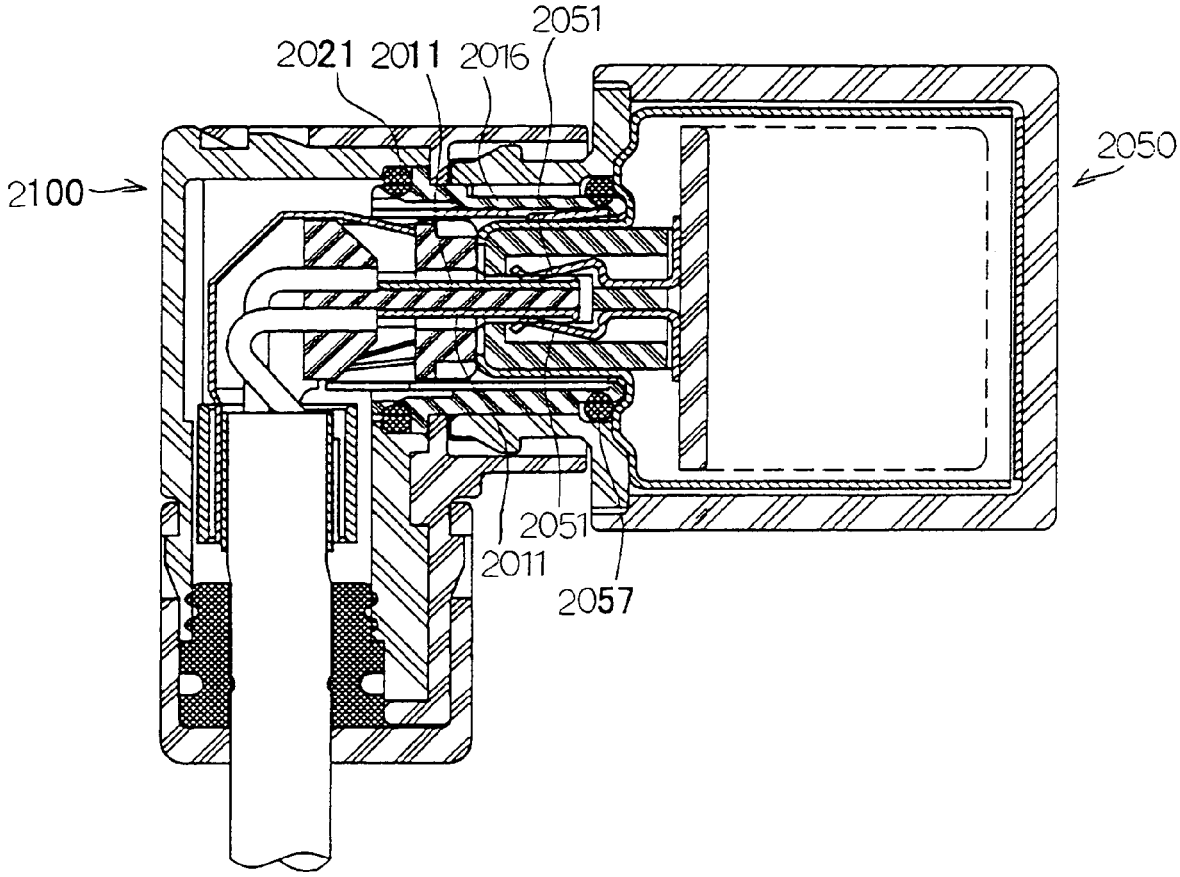
FIG. 41 is a cross-sectional view of the receptacle connector shown in FIGS. 37A to 37C and the plug connector shown in FIGS. 39A to 39C, in a state after the former has been connected to the latter.

As a result, the locking nails 2054*c* of the receptacle connector 2050 are fitted in the associated holes 2181*c* of the locking pieces 2181*b* of the plug connector 2100, and the plug connector 2100 is locked to the receptacle connector 2050, as shown in FIG. 41. Further, the male terminals 2011 are brought into contact with the associated female terminals 2051, whereby the plug connector 2100 is connected to the receptacle connector 2050.

At this time, the O ring 56 of the receptacle connector 2050 is pressed by the foremost end of the barrel 2016 of the plug connector 2100, whereby the inner space of the receptacle connector 2050 is sealed.

As described above, according to the receptacle connector 2050 of the present embodiment, during assembly of the receptacle connector 2050, even when the position of the connector body 2501 is adjusted so as to put the optical axis of the CCD 2062 in position, it is possible to accurately position the shell 2054 with respect to the connector body 2501 by engagement between the annular protrusion 2053*e* of the gland shell 2053 and the annular recess 2054*f* of the shell 2054. This makes it possible to connect the plug connector 2100 to the receptacle connector 2050 without inconvenience. Further, the receptacle connector 2050 and the plug connector 2100 are fitted to each other without misalignment, which prevents the watertight sealing surface from misalignment to thereby increase the reliability of sealing.

Further, the connector body 2501 can be mounted on the printed circuit board 2061 having the CCD 2062 mounted thereon, which makes it unnecessary to use two printed circuit boards as in the prior art. This makes it possible to make the casing 2502 compact in size, and in turn, make the connector body 2501 compact in size.

It should be noted that although in the above-described embodiment, the connector body 2501 includes the gland shell 2053, it is possible to omit the gland shell 2053 e.g. when there is no need to take measures against EMI. In this case, it is only required to form the positioning portion of the connector body 2501 on the housing 2012 of the connector body 2501.

Further, although in the above-described embodiment, the annular protrusion 2053*e* is used as the positioning portion, and the annular recess 2054*f* is used as the positioned portion, the shapes of the positioning portion and the positioned portion are not limited to the shapes of them.

It is further understood by those skilled in the art that the foregoing are the preferred embodiments of the present invention, and that various changes and modification may be made thereto without departing from the spirit and scope thereof.

What is claimed is:

1. A connector for being fitted to a mating connector in a predetermined fitting direction, comprising:

a connector body including a contact which has a cable connected thereto, and a housing for holding said contact;

an end bell including a surrounding portion which surrounds at least part of said housing, a cable running portion which is connected to said surrounding portion, for running the cable in a direction at right angles to the fitting direction, and an end bell-side locking portion which is formed on an outer peripheral surface of said surrounding portion;

a barrel including an erroneous fitting-preventing portion which prevents erroneous fitting of the connector to the mating connector, and is coaxially abutted against a foremost end of said surrounding portion such that said barrel covers a remaining part of said housing;

barrel rotational position-determining means for determining a relative position of said barrel with respect to said end bell in a rotational direction, thereby causing the position of said erroneous fitting-preventing portion in the rotational direction to correspond to a position of said contact; and a coupling nut including a first coupling nut-side locking portion which is engaged with said end bell-side locking portion, and a second coupling nut-side locking portion which is engaged with a mating connector-side locking portion provided on the mating connector, for locking the mating connector, said coupling nut covering said end bell and said barrel, and causing said barrel to abut against said end bell.

2. A connector as claimed in claim 1, wherein said barrel rotational position-determining means comprises a plurality of positioning protrusions, and a plurality of positioning recesses associated with said positioning protrusions.

3. A connector as claimed in claim 1, wherein said end bell-side locking portion is a locking nail, said first coupling nut-side locking portion being a locking hole, said second coupling nut-side locking portion being a locking piece having a hole for engagement with the mating connector-side locking portion.

4. A connector as claimed in claim 1, wherein said connector body has a shield member for covering said housing, the cable having a shielding wire, the shielding wire being electrically connected to said shield member.

5. A connector as claimed in claim 4, wherein said end bell has an end bell-side fitting portion formed thereon such that said end bell-side fitting portion extends along one end of the cable, wherein said coupling nut has a coupling nut-side fitting portion formed thereon for being fitted to said end bell-side fitting portion, and wherein a gland nut is mounted on said end bell and said coupling nut in a state in which said gland nut has received said end bell-side fitting portion and said coupling nut-side fitting portion.

6. A connector as claimed in claim 5, further comprising:

a first seal member disposed between said end bell and said barrel, for sealing between said end bell and said barrel; and a second seal member mounted on one end of the cable, for sealing between the cable and said end bell and between the cable and said gland nut.

7. A connector as claimed in claim 1, wherein said contact includes a cable connecting portion soldered to a cable conductor of the cable, and wherein said housing includes a contact holding portion for holding said contact in a state in which said cable connecting portion is exposed, and a cable holding portion for holding one end of the cable and positioning the cable conductor with respect to said cable connecting portion.

8. A connector as claimed in claim 7, wherein said contact holding portion and said cable holding portion are integrally formed.

9. A connector as claimed in claim 7, wherein said contact has a generally plate-like shape.

10. A connector as claimed in claim 9, wherein said cable connecting portion has a central portion formed with a recess for positioning the cable conductor.

11. A connector as claimed in claim 7, wherein said cable holding portion has a sloping surface formed thereon for soldering.

* * * * *